US010713928B1

(12) United States Patent
Gerstberger et al.

(10) Patent No.: US 10,713,928 B1
(45) Date of Patent: Jul. 14, 2020

(54) ARMING SECURITY SYSTEMS BASED ON COMMUNICATIONS AMONG A NETWORK OF SECURITY SYSTEMS

(71) Applicant: Amazon Technologies, Inc., Seattle, WA (US)

(72) Inventors: Peter Gerstberger, Laguna Niguel, CA (US); James Siminoff, Pacific Palisades, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/101,440

(22) Filed: Aug. 11, 2018

Related U.S. Application Data

(60) Provisional application No. 62/544,240, filed on Aug. 11, 2017.

(51) Int. Cl.

| | |
|---|---|
| ***G08B 27/00*** | (2006.01) |
| ***G08B 25/00*** | (2006.01) |
| ***G08B 19/00*** | (2006.01) |
| ***G08B 13/196*** | (2006.01) |

(52) U.S. Cl.
CPC ..... *G08B 25/008* (2013.01); *G08B 13/19639* (2013.01); *G08B 19/005* (2013.01); *G08B 27/003* (2013.01); *G08B 25/006* (2013.01)

(58) Field of Classification Search
CPC ..... G08B 3/10; G08B 13/19695; G08B 13/19656; G08B 25/001; G08B 25/002; G08B 25/003; G08B 25/14; G08B 25/006; G08B 25/008; G08B 19/00; G08B 27/003; H04L 12/2803
See application file for complete search history.

(56) References Cited

U.S. PATENT DOCUMENTS

| | | | |
|---|---|---|---|
| 4,764,953 | A | 8/1988 | Chern et al. |
| 5,428,388 | A | 6/1995 | von Bauer et al. |
| 5,760,848 | A | 6/1998 | Cho |
| 6,072,402 | A | 6/2000 | Kniffin et al. |
| 6,192,257 | B1 | 2/2001 | Ray |

(Continued)

FOREIGN PATENT DOCUMENTS

| | | | |
|---|---|---|---|
| CN | 2585521 | Y | 11/2003 |
| CN | 2792061 | Y | 6/2006 |

(Continued)

*Primary Examiner* — Benyam Haile
(74) *Attorney, Agent, or Firm* — Lathrop GPM LLP

(57) ABSTRACT

Arming security systems based on communications among a network of security systems in accordance with various embodiments of the present disclosure are provided. In one embodiment, a method for a client device associated with a first security system of a security network is provided, the security network including the first security system installed at a first address and a second security system installed at a second address, the client device including a processor, a communication module, and a display, the method comprising: in response to a security event detected by the second security system at the second address, receiving a user alert; in response to receiving the user alert, displaying the user alert; receiving an input including an arming action for the first security system; and in response to receiving the input, transmitting the arming action to the first security system.

30 Claims, 19 Drawing Sheets

(56) References Cited

U.S. PATENT DOCUMENTS 6,271,752 B1 8/2001 Vaios
6,429,893 B1 8/2002 Xin
6,456,322 B1 9/2002 Marinacci
6,476,858 B1 11/2002 Ramirez Diaz et al.
6,633,231 B1 10/2003 Okamoto et al.
6,658,091 B1 12/2003 Naidoo et al.
6,753,774 B2 6/2004 Pan et al.
6,970,183 B1 11/2005 Monroe
7,062,291 B2 6/2006 Ryley et al.
7,065,196 B2 6/2006 Lee
7,085,361 B2 8/2006 Thomas
7,109,860 B2 9/2006 Wang
7,113,090 B1 * 9/2006 Saylor ..... G08B 13/19682 340/5.33
7,193,644 B2 3/2007 Carter
7,304,572 B2 12/2007 Sheynman et al.
7,382,249 B2 6/2008 Fancella
7,450,638 B2 11/2008 Iwamura
7,643,056 B2 1/2010 Silsby
7,683,924 B2 3/2010 Oh et al.
7,683,929 B2 3/2010 Elazar et al.
7,738,917 B2 6/2010 Ryley et al.
8,139,098 B2 3/2012 Carter
8,144,183 B2 3/2012 Carter
8,154,581 B2 4/2012 Carter
8,619,136 B2 12/2013 Howarter et al.
8,872,915 B1 5/2014 Scalisi et al.
8,780,201 B1 7/2014 Scalisi et al.
8,823,795 B1 9/2014 Scalisi et al.
8,842,180 B1 9/2014 Kasmir et al.
8,937,659 B1 1/2015 Scalisi et al.
8,941,736 B1 1/2015 Scalisi
8,947,530 B1 2/2015 Scalisi
8,953,040 B1 2/2015 Scalisi et al.
9,013,575 B2 4/2015 Scalisi
9,049,352 B2 6/2015 Scalisi et al.
9,053,622 B2 6/2015 Scalisi
9,058,738 B1 6/2015 Scalisi
9,060,103 B2 6/2015 Scalisi
9,060,104 B2 6/2015 Scalisi
9,065,987 B2 6/2015 Scalisi
9,094,584 B2 7/2015 Scalisi et al.
9,113,051 B1 8/2015 Scalisi
9,113,052 B1 8/2015 Scalisi et al.
9,118,819 B1 8/2015 Scalisi et al.
9,142,214 B2 9/2015 Scalisi
9,160,987 B1 10/2015 Kasmir et al.
9,165,444 B2 10/2015 Scalisi
9,172,920 B1 10/2015 Kasmir et al.
9,172,921 B1 10/2015 Scalisi et al.
9,172,922 B1 10/2015 Kasmir et al.
9,179,107 B1 11/2015 Scalisi
9,179,108 B1 11/2015 Scalisi
9,179,109 B1 11/2015 Kasmir et al.
9,196,133 B2 11/2015 Scalisi et al.
9,197,867 B1 11/2015 Scalisi et al.
9,230,424 B1 1/2016 Scalisi et al.
9,237,318 B2 1/2016 Kasmir et al.
9,247,219 B2 1/2016 Kasmir et al.
9,253,455 B1 2/2016 Harrison et al.
9,342,936 B2 5/2016 Scalisi
9,508,239 B1 11/2016 Harrison et al.
9,736,284 B2 8/2017 Scalisi et al.
9,743,049 B2 8/2017 Scalisi et al.
9,769,435 B2 9/2017 Scalisi et al.
9,786,133 B2 10/2017 Harrison et al.
9,799,183 B2 10/2017 Harrison et al.
2002/0094111 A1 7/2002 Puchek et al.
2002/0147982 A1 10/2002 Naidoo et al.
2003/0043047 A1 3/2003 Braun
2004/0085205 A1 5/2004 Yeh
2004/0085450 A1 5/2004 Stuart
2004/0086093 A1 5/2004 Schranz
2004/0095254 A1 5/2004 Maruszczak
2004/0135686 A1 7/2004 Parker
2005/0111660 A1 5/2005 Hosoda
2006/0010199 A1 1/2006 Brailean et al.
2006/0022816 A1 2/2006 Yukawa
2006/0139449 A1 6/2006 Cheng et al.
2006/0156361 A1 7/2006 Wang et al.
2007/0008081 A1 1/2007 Tylicki et al.
2010/0225455 A1 9/2010 Claiborne et al.
2013/0057695 A1 3/2013 Huisking
2014/0267716 A1 9/2014 Child et al.
2015/0163463 A1 6/2015 Hwang et al.
2017/0213447 A1 * 7/2017 Horrocks ..... G08B 19/00

FOREIGN PATENT DOCUMENTS

EP 0944883 A1 6/1998
EP 1480462 A1 11/2004
GB 2286283 A 8/1995
GB 2354394 A 3/2001
GB 2357387 A 6/2001
GB 2400958 A 10/2004
JP 2001-103463 A 4/2001
JP 2002-033839 A 1/2002
JP 2002-125059 A 4/2002
JP 2002-342863 A 11/2002
JP 2002-344640 A 11/2002
JP 2002-354137 A 12/2002
JP 2002-368890 A 12/2002
JP 2003-283696 A 10/2003
JP 2004-128835 A 4/2004
JP 2005-341040 A 12/2005
JP 2006-147650 A 6/2006
JP 2006-262342 A 9/2006
JP 2009-008925 A 1/2009
WO 1998/39894 A1 9/1998
WO 2001/13638 A1 2/2001
WO 2001/93220 A1 12/2001
WO 2002/085019 A1 10/2002
WO 2003/028375 A1 4/2003
WO 2003/096696 A1 11/2003
WO 2006/038760 A1 4/2006
WO 2006/067782 A1 6/2006
WO 2007/125143 A1 8/2007

* cited by examiner

756
MIRACLE MILE
754
752
750
CARTHAY SQUARE
PICO ROBERTS
720
728
W Olympic Blvd
W Pico Blvd
S Crescent Heights Blvd
La Cienega Blvd
S Fairfax
S Curson Ave
S Ogden Dr
S Fairfax Ave
S Hauser Blvd
S Hauser Blvd
S Hauser Blvd

ARMING SECURITY SYSTEMS BASED ON COMMUNICATIONS AMONG A NETWORK OF SECURITY SYSTEMS

CROSS-REFERENCE TO RELATED APPLICATION

This application claims priority to provisional application Ser. No. 62/544,240, filed on Aug. 11, 2017, the entire contents of which are hereby incorporated by reference.

TECHNICAL FIELD

The present embodiments relate to security systems, including security systems that include sensors, automation devices, and/or audio/video (AN) recording and communication devices. In particular, the present embodiments relate to improvements in the functionality of security systems that strengthen the ability of such systems to reduce crime and enhance public safety.

BACKGROUND

Home safety is a concern for many homeowners and renters. Those seeking to protect or monitor their homes often wish to be informed of breaches to the security of their homes and also have video and audio communications with visitors/trespassers, for example, those visiting/trespassing near an external door or entryway. Security systems that include sensors, automation devices, and/or A/V recording and communication devices, such as doorbells, provide this functionality, and can also aid in crime detection and prevention. For example, sensor information, audio, and/or video captured by a security system, such as by an A/V recording and communication doorbell of a security system, can be uploaded to the cloud and recorded on a remote server. Subsequent review of the sensor information and/or the A/V footage can aid law enforcement in capturing perpetrators of home burglaries and other crimes. Further, the presence of a security system including one or more an A/V recording and communication devices on the exterior of a home, such as a doorbell unit at the entrance of a home, acts as a powerful deterrent against would-be burglars.

BRIEF DESCRIPTION OF THE DRAWINGS

The various embodiments of the arming security systems based on communications among a network of security systems now will be discussed in detail with an emphasis on highlighting the advantageous features. These embodiments depict the novel and non-obvious arming security systems based on communications among a network of security systems shown in the accompanying drawings, which are for illustrative purposes only. These drawings include the following figures, in which like numerals indicate like parts.

DETAILED DESCRIPTION

Figure 1:
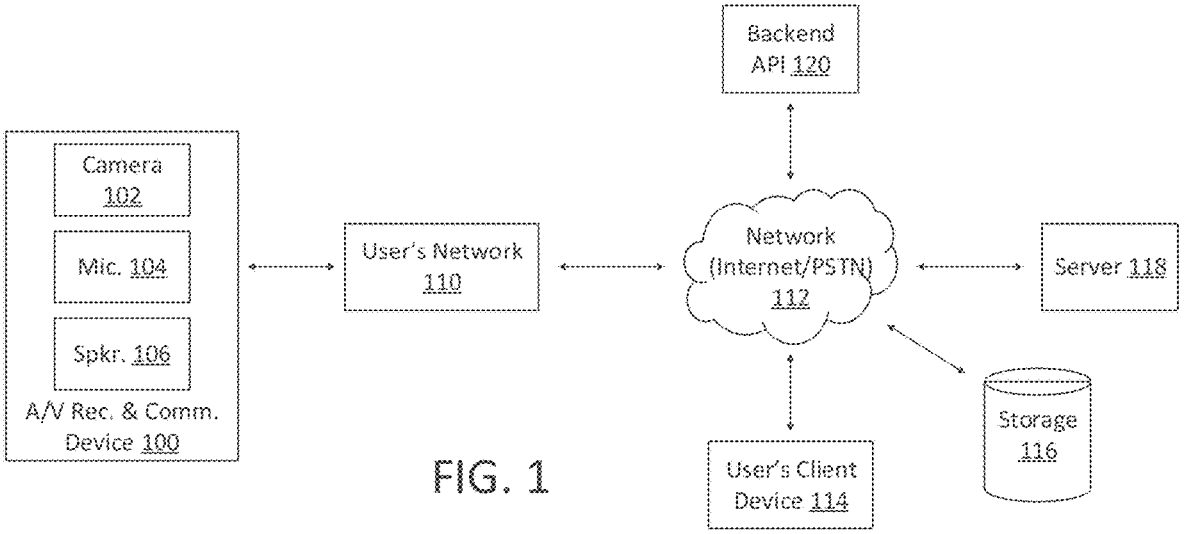
FIG. 1 is a functional block diagram illustrating one embodiment of a system including an A/V recording and communication device according to various aspects of the present disclosure.

The various embodiments of the present arming security systems based on communications among a network of security systems have several features, no single one of which is solely responsible for their desirable attributes. Without limiting the scope of the present embodiments as expressed by the claims that follow, their more prominent features now will be discussed. After considering this discussion, and particularly after reading the section entitled "Detailed Description," one will understand how the features of the present embodiments provide the advantages described herein.

One aspect of the present embodiments includes the realization that, historically, security systems have been designed and intended to protect only the property at which the security systems are installed. A typical security system is self-contained, and provides a warning to the property owner only when an intrusion is detected at that same property, and only when the security system is armed. However, potential threats to the property may occur before an intruder crosses the property boundary where the security system is installed, such as when an intrusion occurs at a nearby property. The present embodiments solve this problem by leveraging the functionality of security systems to link together security systems at multiple properties, where each property is protected by a security system and/or an A/V recording and communication device. When an intrusion is detected by a security system and/or an A/V recording and communication device at one of the properties in the network of properties, warnings may be provided to users associated with the other properties in the network that include security systems. Such warnings may provide the users with opportunity to take corrective action, such as by arming their own alarm systems, before the potential threat at the nearby property becomes an actual threat at that user's property. As a result, the safety of that user's property is increased, as well as the safety of the other properties in the network, thereby contributing to public safety.

The following detailed description describes the present embodiments with reference to the drawings. In the drawings, reference numbers label elements of the present embodiments. These reference numbers are reproduced below in connection with the discussion of the corresponding drawing features.

With reference to FIG. 1, the present embodiments may include an audio/video (A/V) recording and communication device 100. The A/V recording and communication device 100 may in some embodiments comprise a doorbell, and may be located near the entrance to a structure (not shown), such as a dwelling, a business, a storage facility, etc. The A/V recording and communication device 100 may include a camera 102, a microphone 104, and a speaker 106. The camera 102 may comprise, for example, a high definition (HD) video camera, such as one capable of capturing video images at an image display resolution of 720p, or 1080p, or better. While not shown, the A/V recording and communication device 100 may also include other hardware and/or components, such as a housing, one or more motion sensors (and/or other types of sensors), a button, etc. The A/V recording and communication device 100 may further include similar componentry and/or functionality as the wireless communication doorbells described in US Patent Application Publication Nos. 2015/0022620 (application Ser. No. 14/499,828) and 2015/0022618 (application Ser. No. 14/334,922), both of which are incorporated herein by reference in their entireties as if fully set forth.

With further reference to FIG. 1, the A/V recording and communication device 100 communicates with a user's network 110, which may be for example a wired and/or wireless network. If the user's network 110 is wireless, or includes a wireless component, the network 110 may be a Wi-Fi network compatible with the IEEE 802.11 standard and/or other wireless communication standard(s). The user's network 110 is connected to another network 112, which may comprise, for example, the Internet and/or a public switched telephone network (PSTN). As described below, the A/V recording and communication device 100 may communicate with a user's client device 114 via the user's network 110 and the network 112 (Internet/PSTN). The user's client device 114 may comprise, for example, a mobile telephone (may also be referred to as a cellular telephone), such as a smartphone, a personal digital assistant (PDA), or another communication device. The user's client device 114 comprises a display (not shown) and related components capable of displaying streaming and/or recorded video images. The user's client device 114 may also comprise a speaker and related components capable of broadcasting streaming and/or recorded audio, and may also comprise a microphone. The A/V recording and communication device 100 may also communicate with one or more remote storage device(s) 116 (may be referred to interchangeably as "cloud storage device(s)"), one or more servers 118, and/or a backend API (application programming interface) 120 via the user's network 110 and the network 112 (Internet/PSTN). While FIG. 1 illustrates the storage device 116, the server 118, and the backend API 120 as components separate from the network 112, it is to be understood that the storage device 116, the server 118, and/or the backend API 120 may be considered to be components of the network 112.

The network 112 may be any wireless network or any wired network, or a combination thereof, configured to operatively couple the above-mentioned modules, devices, and systems as shown in FIG. 1. For example, the network 112 may include one or more of the following: a PSTN (public switched telephone network), the Internet, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, a Digital Data Service (DDS) connection, a DSL (Digital Subscriber Line) connection, an Ethernet connection, an ISDN (Integrated Services Digital Network) line, a dial-up port such as a V.90, V.34, or V.34bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), LTE, VoLTE, LoRaWAN, LPWAN, RPMA, LTE Cat-"X" (e.g., LTE Cat 1, LTE Cat 0, LTE CatM1, LTE Cat NB1), CDMA (Code Division Multiple Access), TDMA (Time Division Multiple Access), FDMA (Frequency Division Multiple Access), and/or OFDMA (Orthogonal Frequency Division Multiple Access) cellular phone networks, GPS, CDPD (cellular digital packet data), RIM (Research in Motion, Limited) duplex paging network, Bluetooth radio, or an IEEE 802.11-based radio frequency network. The network can further include or interface with any one or more of the following: RS-232 serial connection, IEEE-1394 (Firewire) connection, Fibre Channel connection, IrDA (infrared) port, SCSI (Small Computer Systems Interface) connection, USB (Universal Serial Bus) connection, or other wired or wireless, digital or analog, interface or connection, mesh or Digi® networking.

According to one or more aspects of the present embodiments, when a person (may be referred to interchangeably as "visitor") arrives at the A/V recording and communication device 100, the A/V recording and communication device 100 detects the visitor's presence and begins capturing video images within a field of view of the camera 102. The A/V recording and communication device 100 may also capture audio through the microphone 104. The A/V recording and communication device 100 may detect the visitor's presence by detecting motion using the camera 102 and/or a motion sensor, and/or by detecting that the visitor has depressed the front button on the A/V recording and communication device 100 (in embodiments in which the A/V recording and communication device 100 comprises a doorbell).

In response to the detection of the visitor, the A/V recording and communication device 100 sends an alert to the user's client device 114 (FIG. 1) via the user's network 110 and the network 112. The A/V recording and communication device 100 also sends streaming video, and may also send streaming audio, to the user's client device 114. If the user answers the alert, two-way audio communication may then occur between the visitor and the user through the A/V recording and communication device 100 and the user's client device 114. The user may view the visitor throughout the duration of the call, but the visitor cannot see the user (unless the A/V recording and communication device 100 includes a display, which it may in some embodiments).

The video images captured by the camera 102 of the A/V recording and communication device 100 (and the audio captured by the microphone 104) may be uploaded to the cloud and recorded on the remote storage device 116 (FIG. 1). In some embodiments, the video and/or audio may be recorded on the remote storage device 116 even if the user chooses to ignore the alert sent to his or her client device 114.

With further reference to FIG. 1, the system may further comprise a backend API 120 including one or more components. A backend API (application programming interface) may comprise, for example, a server (e.g., a real server, or a virtual machine, or a machine running in a cloud infrastructure as a service), or multiple servers networked together, exposing at least one API to client(s) accessing it. These servers may include components such as application servers (e.g., software servers), depending upon what other components are included, such as a caching layer, or database layers, or other components. A backend API may, for example, comprise many such applications, each of which communicate with one another using their public APIs. In some embodiments, the API backend may hold the bulk of the user data and offer the user management capabilities, leaving the clients to have very limited state.

The backend API 120 illustrated FIG. 1 may include one or more APIs. An API is a set of routines, protocols, and tools for building software and applications. An API expresses a software component in terms of its operations, inputs, outputs, and underlying types, defining functionalities that are independent of their respective implementations, which allows definitions and implementations to vary without compromising the interface. Advantageously, an API may provide a programmer with access to an application's functionality without the programmer needing to modify the application itself, or even understand how the application works. An API may be for a web-based system, an operating system, or a database system, and it provides facilities to develop applications for that system using a given programming language. In addition to accessing databases or computer hardware like hard disk drives or video cards, an API can ease the work of programming GUI components. For example, an API can facilitate integration of new features into existing applications (a so-called "plug-in API"). An API can also assist otherwise distinct applications with sharing data, which can help to integrate and enhance the functionalities of the applications.

The backend API 120 illustrated in FIG. 1 may further include one or more services (also referred to as network services). A network service is an application that provides data storage, manipulation, presentation, communication, and/or other capability. Network services are often implemented using a client-server architecture based on application-layer network protocols. Each service may be provided by a server component running on one or more computers (such as a dedicated server computer offering multiple services) and accessed via a network by client components running on other devices. However, the client and server components can both be run on the same machine. Clients and servers may have a user interface, and sometimes other hardware associated with them.

Figure 2:
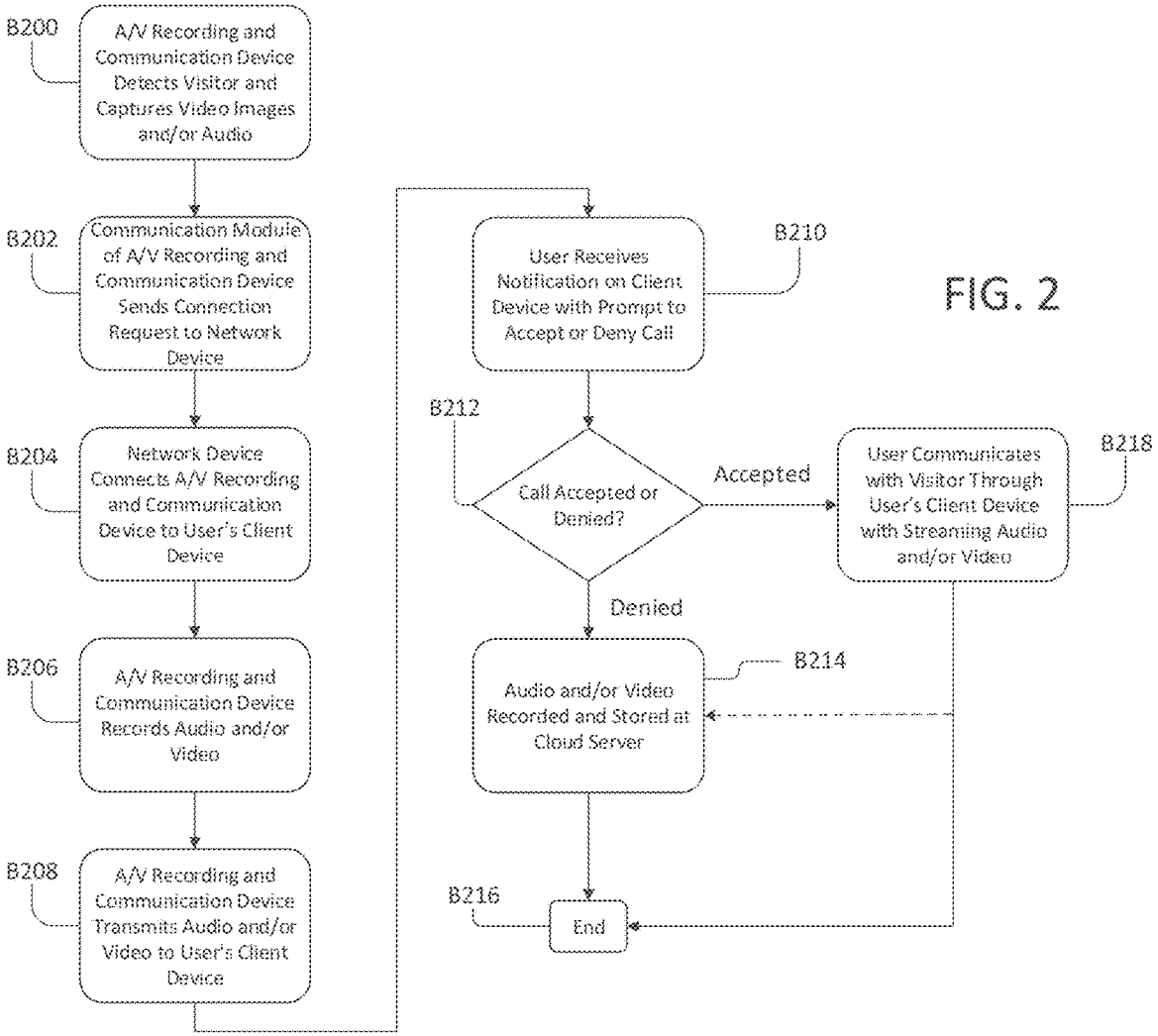
FIG. 2 is a flowchart illustrating one embodiment of a process for streaming and storing A/V content from an A/V recording and communication device according to various aspects of the present disclosure.

FIG. 2 is a flowchart illustrating a process for streaming and storing A/V content from an A/V recording and communication doorbell system according to various aspects of the present disclosure. At block B200, the A/V recording and communication device 100 detects the visitor's presence and begins capturing video images within a field of view of the camera 102. The A/V recording and communication device 100 may also capture audio through the microphone 104. As described above, the A/V recording and communication device 100 may detect the visitor's presence by detecting motion using the camera 102 and/or a motion sensor, and/or by detecting that the visitor has depressed the front button on the A/V recording and communication device 100 (in embodiments in which the A/V recording and communication device 100 comprises a doorbell).

At block B202, a communication module of the A/V recording and communication device 100 sends a connection request, via the user's network 110 and the network 112, to a device in the network 112. For example, the network device to which the request is sent may be a server such as the server 118. The server 118 may comprise a computer program and/or a machine that waits for requests from other machines or software (clients) and responds to them. A server typically processes data. One purpose of a server is to share data and/or hardware and/or software resources among clients. This architecture is called the client-server model. The clients may run on the same computer or may connect to the server over a network. Examples of computing servers include database servers, file servers, mail servers, print servers, web servers, game servers, and application servers. The term server may be construed broadly to include any computerized process that shares a resource to one or more client processes.

In response to the request, at block B204 the network device may connect the A/V recording and communication device 100 to the user's client device 114 through the user's network 110 and the network 112. At block B206, the A/V recording and communication device 100 may record available audio and/or video data using the camera 102, the microphone 104, and/or any other sensor available. At block B208, the audio and/or video data is transmitted (streamed) from the A/V recording and communication device 100 to the user's client device 114 via the user's network 110 and the network 112. At block B210, the user may receive a notification on his or her client device 114 with a prompt to either accept or deny the call.

At block B212, the process determines whether the user has accepted or denied the call. If the user denies the notification, then the process advances to block B214, where the audio and/or video data is recorded and stored at a cloud server. The session then ends at block B216 and the connection between the A/V recording and communication device 100 and the user's client device 114 is terminated. If, however, the user accepts the notification, then at block B218 the user communicates with the visitor through the user's client device 114 while audio and/or video data captured by the camera 102, the microphone 104, and/or other sensors is streamed to the user's client device 114. At the end of the call, the user may terminate the connection between the user's client device 114 and the A/V recording and communication device 100 and the session ends at block B216. In some embodiments, the audio and/or video data may be recorded and stored at a cloud server (block B214) even if the user accepts the notification and communicates with the visitor through the user's client device 114.

Figure 3:
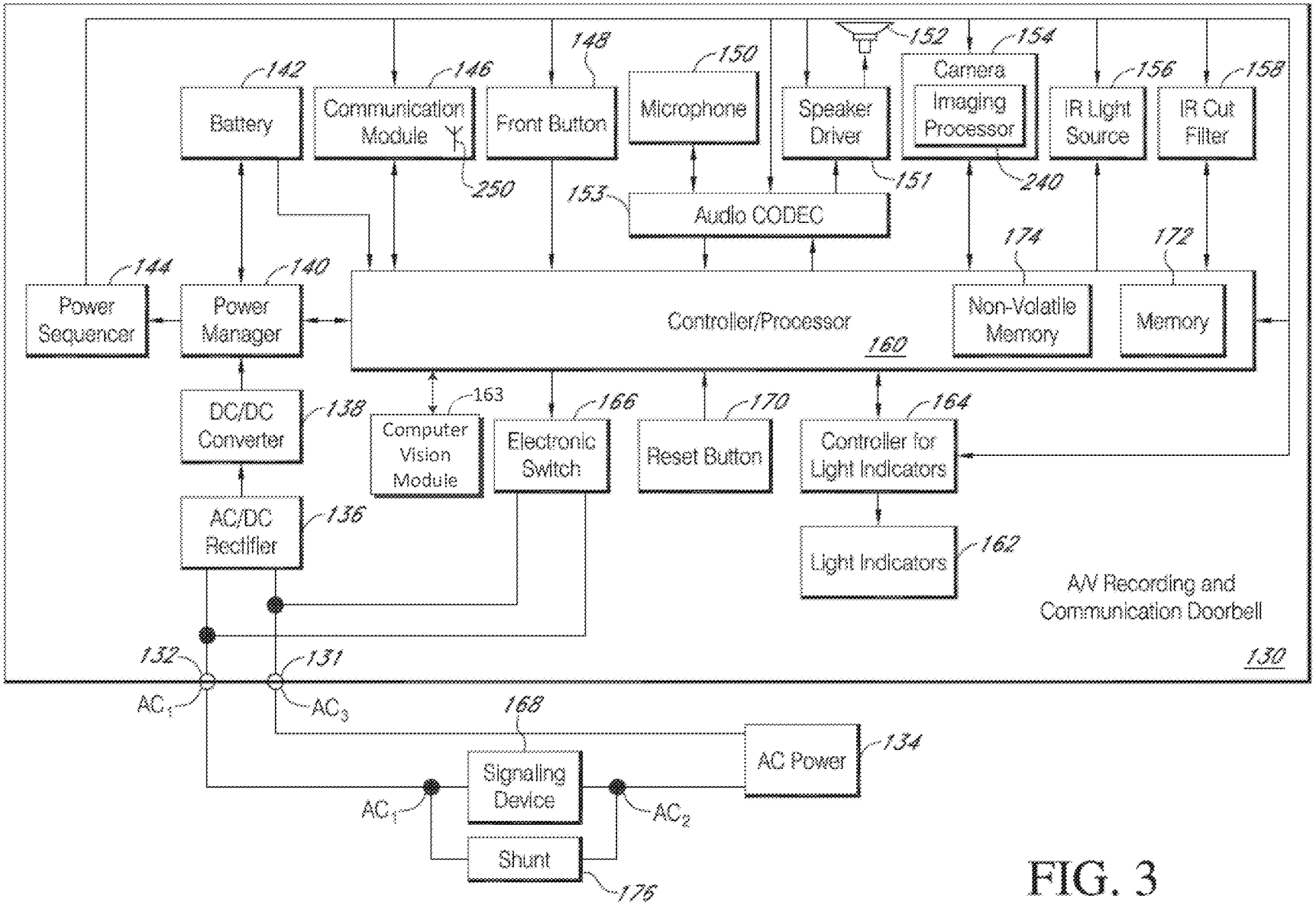
FIG. 3 is a functional block diagram illustrating an embodiment of an A/V recording and communication doorbell according to various aspects of the present disclosure.
Figure 4:
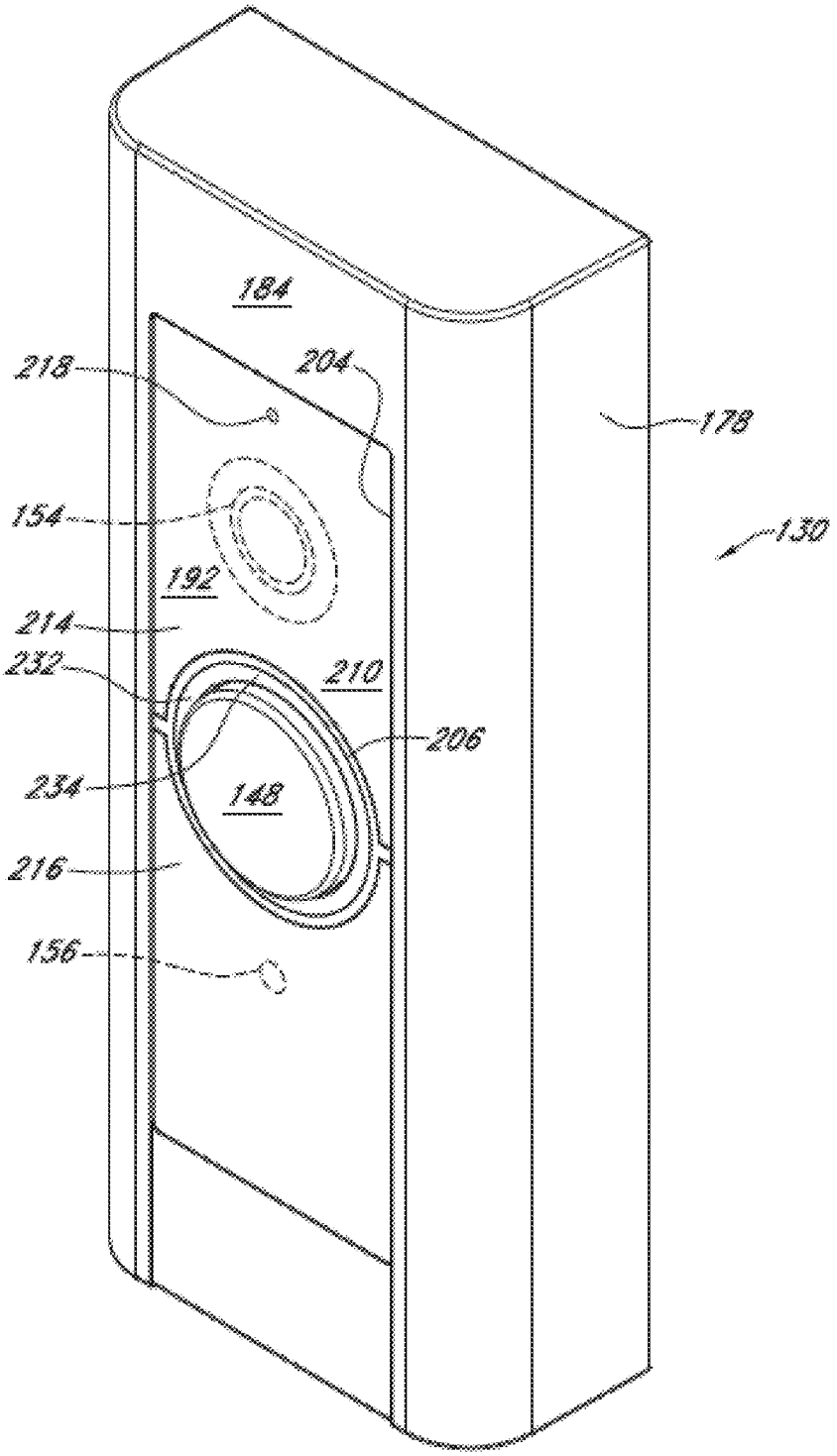
FIG. 4 is a front perspective view of an embodiment of an A/V recording and communication doorbell according to various aspects of the present disclosure.

FIGS. 3-4 illustrate one embodiment of a low-power-consumption A/V recording and communication doorbell 130 according to various aspects of the present disclosure. FIG. 3 is a functional block diagram illustrating various components of the A/V recording and communication doorbell 130 and their relationships to one another. For example, the A/V recording and communication doorbell 130 includes a pair of terminals 131, 132 configured to be connected to a source of external AC (alternating-current) power, such as a household AC power supply 134 (may also be referred to as AC mains). The AC power 134 may have a voltage in the range of 16-24 VAC, for example. The incoming AC power 134 may be converted to DC (direct-current) by an AC/DC rectifier 136. An output of the AC/DC rectifier 136 may be connected to an input of a DC/DC converter 138, which may step down the voltage from the output of the AC/DC rectifier 136 from 16-24 VDC to a lower voltage of about 5 VDC, for example. In various embodiments, the output of the DC/DC converter 138 may be in a range of from about 2.5 V to about 7.5 V, for example.

With further reference to FIG. 3, the output of the DC/DC converter 138 is connected to a power manager 140, which may comprise an integrated circuit including a processor core, memory, and/or programmable input/output peripherals. In one non-limiting example, the power manager 140 may be an off-the-shelf component, such as the BQ24773 chip manufactured by Texas Instruments. As described in detail below, the power manager 140 controls, among other things, an amount of power drawn from the external power supply 134, as well as an amount of supplemental power drawn from a battery 142, to power the A/V recording and communication doorbell 130. The power manager 140 may, for example, limit the amount of power drawn from the external power supply 134 so that a threshold power draw is not exceeded. In one non-limiting example, the threshold power, as measured at the output of the DC/DC converter 138, may be equal to 1.4 A. The power manager 140 may also control an amount of power drawn from the external power supply 134 and directed to the battery 142 for recharging of the battery 142. An output of the power manager 140 is connected to a power sequencer 144, which controls a sequence of power delivery to other components of the A/V recording and communication doorbell 130, including a communication module 146, a front button 148, a microphone 150, a speaker driver 151, a speaker 152, an audio CODEC (Coder-DECoder) 153, a camera 154, an infrared (IR) light source 156, an IR cut filter 158, a processor 160 (may also be referred to as a controller 160), a plurality of light indicators 162, and a controller 164 for the light indicators 162. Each of these components is described in detail below. The power sequencer 144 may comprise an integrated circuit including a processor core, memory, and/or programmable input/output peripherals. In one non-limiting example, the power sequencer 144 may be an off-the-shelf component, such as the RT5024 chip manufactured by Richtek.

With further reference to FIG. 3, the A/V recording and communication doorbell 130 further comprises an electronic switch 166 that closes when the front button 148 is depressed. When the electronic switch 166 closes, power from the AC power source 134 is diverted through a signaling device 168 that is external to the A/V recording and communication doorbell 130 to cause the signaling device 168 to emit a sound, as further described below. In one non-limiting example, the electronic switch 166 may be a triac device. The A/V recording and communication doorbell 130 further comprises a reset button 170 configured to initiate a hard reset of the processor 160, as further described below.

With further reference to FIG. 3, the processor 160 may perform data processing and various other functions, as described below. The processor 160 may comprise an integrated circuit including a processor core, memory 172, non-volatile memory 174, and/or programmable input/output peripherals (not shown). The memory 172 may comprise, for example, DDR3 (double data rate type three synchronous dynamic random-access memory). The non-volatile memory 174 may comprise, for example, NAND flash memory. In the embodiment illustrated in FIG. 3, the memory 172 and the non-volatile memory 174 are illustrated within the box representing the processor 160. It is to be understood that the embodiment illustrated in FIG. 3 is merely an example, and in some embodiments the memory 172 and/or the non-volatile memory 174 are not necessarily physically incorporated with the processor 160. The memory 172 and/or the non-volatile memory 174, regardless of their physical location, may be shared by one or more other components (in addition to the processor 160) of the present A/V recording and communication doorbell 130.

The transfer of digital audio between the user and a visitor may be compressed and decompressed using the audio CODEC 153, which is operatively coupled to the processor 160. When the visitor speaks, audio from the visitor is compressed by the audio CODEC 153, digital audio data is sent through the communication module 146 to the network 112 via the user's network 110, routed by the server 118 and delivered to the user's client device 114. When the user speaks, after being transferred through the network 112, the user's network 110, and the communication module 146, the digital audio data is decompressed by the audio CODEC 153 and emitted to the visitor through the speaker 152, which is driven by the speaker driver 151.

With further reference to FIG. 3, some of the present embodiments may include a shunt 176 connected in parallel with the signaling device 168. The shunt 176 facilitates the ability of the A/V recording and communication doorbell 130 to draw power from the AC power source 134 without inadvertently triggering the signaling device 168. The shunt 176, during normal standby operation, presents a relatively low electrical impedance, such as a few ohms, across the terminals of the signaling device 168. Most of the current drawn by the A/V recording and communication doorbell 130, therefore, flows through the shunt 176, and not through the signaling device 168. The shunt 176, however, contains electronic circuitry (described below) that switches the shunt 176 between a state of low impedance, such as a few ohms, for example, and a state of high impedance, such as >1K ohms, for example. When the front button 148 of the A/V recording and communication doorbell 130 is pressed, the electronic switch 166 closes, causing the voltage from the AC power source 134 to be impressed mostly across the shunt 176 and the signaling device 168 in parallel, while a small amount of voltage, such as about 1V, is impressed across the electronic switch 166. The circuitry in the shunt 176 senses this voltage, and switches the shunt 176 to the high impedance state, so that power from the AC power source 134 is diverted through the signaling device 168. The diverted AC power 134 is above the threshold necessary to cause the signaling device 168 to emit a sound. Pressing the front button 148 of the doorbell 130 therefore causes the signaling device 168 to "ring," alerting any person(s) within the structure to which the doorbell 130 is mounted that there is a visitor at the front door (or at another location corresponding to the location of the doorbell 130). In one non-limiting example, the electronic switch 166 may be a triac device.

With reference to FIG. 4, the A/V recording and communication doorbell 130 further comprises a housing 178 having an enclosure (not shown), a back plate (not shown) secured to the rear of the enclosure, and a shell 184 overlying the enclosure. A front surface of the A/V recording and communication doorbell 130 may include the button 148 (may also be referred to as front button 148), which is operatively connected to a processor (not shown). In a process similar to that described above with reference to FIG. 2, when a visitor presses the front button 148, an alert may be sent to the user's client device to notify the user that someone is at his or her front door (or at another location corresponding to the location of the A/V recording and communication doorbell 130). With further reference to FIG. 4, the A/V recording and communication doorbell 130 further includes the camera 154, which is operatively connected to the processor 160, and which is located behind a shield 192. As described in detail below, the camera 154 is configured to capture video images from within its field of view. Those video images can be streamed to the user's client device and/or uploaded to a remote network device for later viewing according to a process similar to that described above with reference to FIG. 2.

With further reference to FIG. 4, the shell 184 includes a central opening 204 in a front surface. The central opening 204 is sized and shaped to accommodate the shield 192. The shield 192 includes an upper portion 214 (located above and to the sides of the front button 148) and a lower portion 216 (located below and to the sides of the front button 148). The upper portion 214 of the shield 192 may be transparent or translucent so that it does not interfere with the field of view of the camera 154. As described in detail below, a microphone, which is operatively connected to the processor, is located behind the upper portion 214 of the shield 192. The upper portion 214, therefore, may include an opening 218 that facilitates the passage of sound through the shield 192 so that the microphone is better able to pick up sounds from the area around the A/V recording and communication doorbell 130.

The lower portion 216 of the shield 192 may comprise a material that is substantially transparent to infrared (IR) light, but partially or mostly opaque with respect to light in the visible spectrum. The lower portion 216 of the shield 192, therefore, does not interfere with transmission of IR light from the IR light source, which is located behind the lower portion 216. As described in detail below, the IR light source and the IR cut filter, which are both operatively connected to the processor, facilitate "night vision" functionality of the camera 154.

Several advantages flow from the ability of the present embodiments to be connected to the existing household AC power supply. For example, the camera of the present A/V recording and communication doorbell can be powered on continuously. In a typical battery-powered A/V recording and communication doorbell, the camera is powered on only part of the time so that the battery does not drain too rapidly. The present embodiments, by contrast, do not rely on a battery as a primary (or sole) power supply, and are thus able to keep the camera powered on continuously. Because the camera is able to be powered on continuously, it can always be recording, and recorded footage can be continuously stored in a rolling buffer or sliding window. In some embodiments, about 10-15 seconds of recorded footage can be continuously stored in the rolling buffer or sliding window. Also, because the camera is able to be powered on continuously, it can be used for motion detection, thus eliminating any need for a separate motion detection device, such as a passive infrared sensor (PIR). Eliminating the PIR simplifies the design of the A/V recording and communication doorbell and enables the doorbell to be made more compact, although in some alternative embodiments the doorbell may include one or more PIRs and/or other motion detectors, heat source detectors, etc. Also, because the camera is able to be powered on continuously, it can be used as a light detector for use in controlling the current state of the IR cut filter and turning the IR LED on and off. Using the camera as a light detector eliminates any need for a separate light detector, thereby further simplifying the design of the A/V recording and communication doorbell and enabling the doorbell to be made even more compact, although in some alternative embodiments the doorbell may include a separate light detector.

Figure 5:
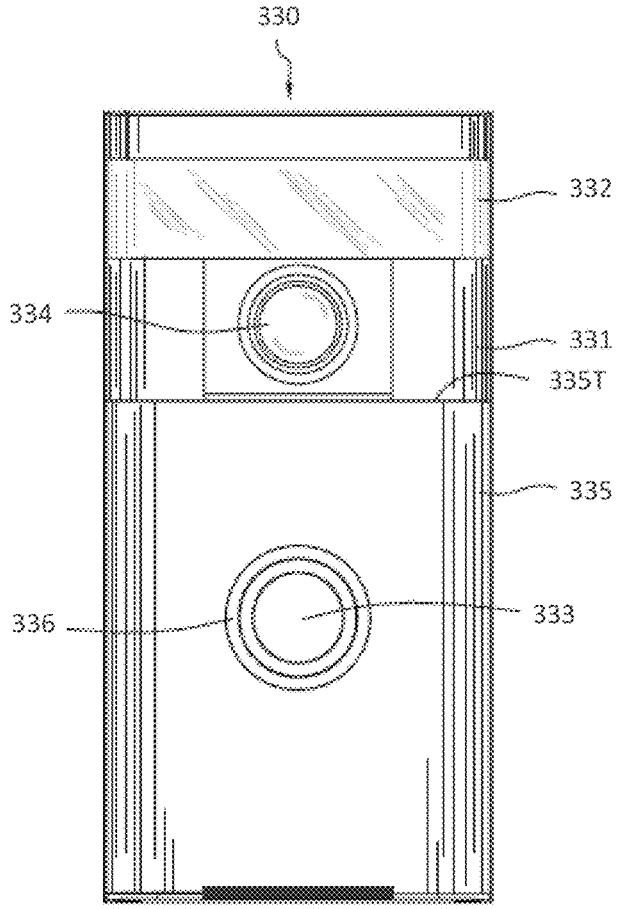
FIG. 5 is a front view of another embodiment of an A/V recording and communication doorbell according to various aspects of the present disclosure.
Figure 6:
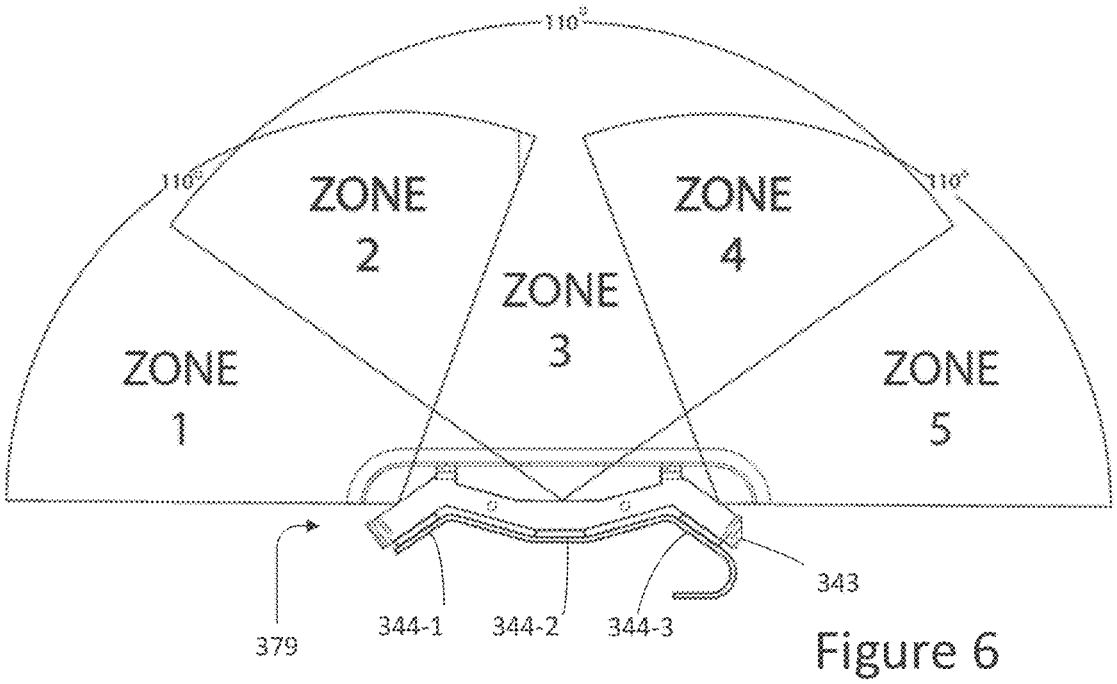
FIG. 6 is a top view of a passive infrared sensor assembly of the A/V recording and communication doorbell of FIG. 5, illustrating fields of view of passive infrared sensors of the passive infrared sensor assembly according to various aspects of the present disclosure.
Figure 7:
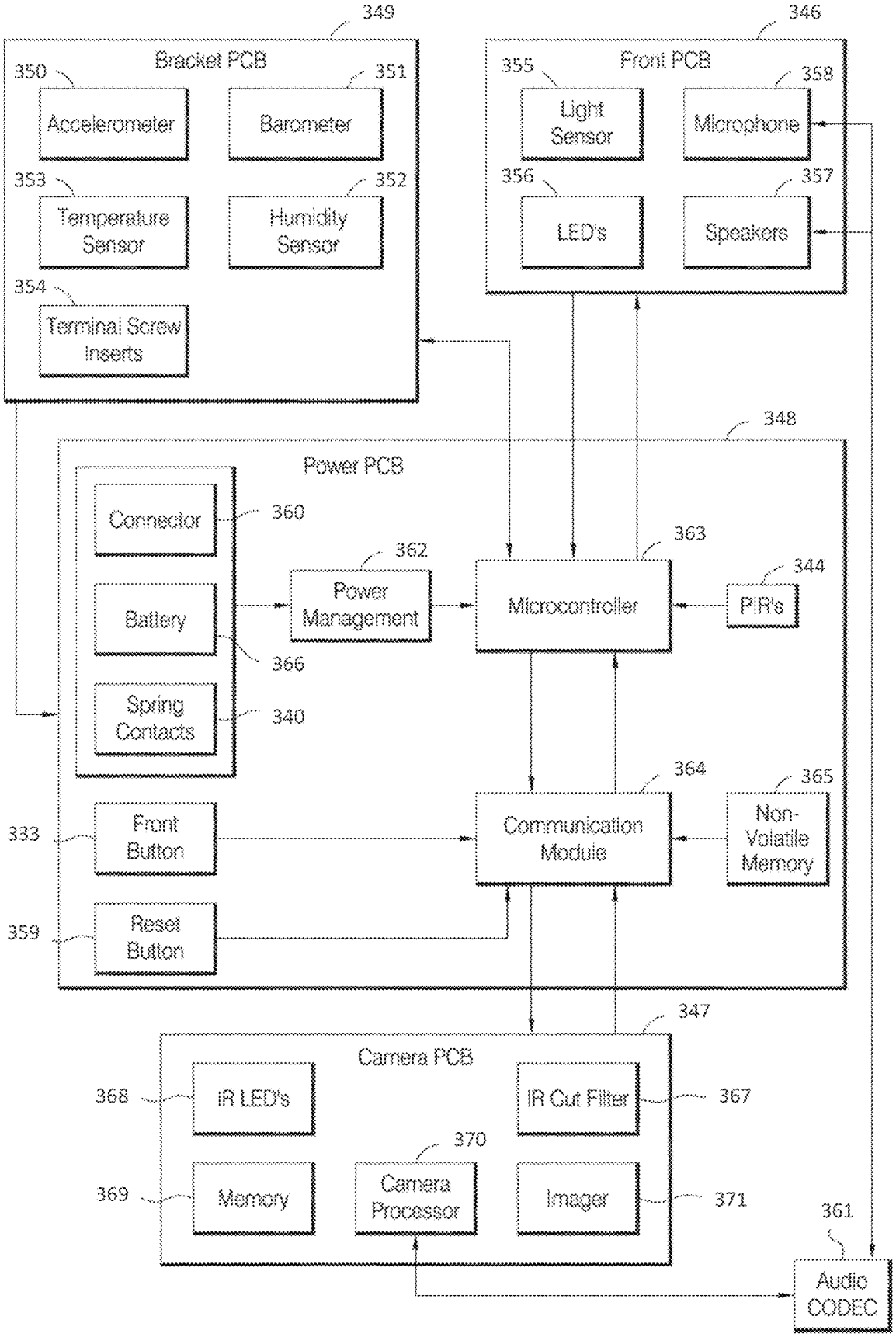
FIG. 7 is a functional block diagram of the components of the A/V recording and communication doorbell of FIG. 5.

FIGS. 5-7 illustrate another embodiment of a wireless audio/video (A/V) communication doorbell 330 according to an aspect of present embodiments. FIG. 5 is a front view of the wireless A/V communication doorbell 330. As described below, the doorbell 330 is configured to be connected to an external power source, such as household wiring, but is also configured to be powered by an on-board rechargeable battery instead of, or in addition to, the external power source.

The doorbell 330 includes a faceplate 335 mounted to a back plate (not shown). The faceplate 335 protects the internal contents of the doorbell 330 and serves as an exterior front surface of the doorbell 330. The faceplate 335 may include a button 333 and a light pipe 336. The light pipe 336 may comprise any suitable material, including, without limitation, transparent plastic, that is capable of allowing light produced within the doorbell 330 to pass through. The light may be produced by one or more light-emitting components, such as light-emitting diodes (LED's), contained within the doorbell 330, as further described below. The button 333 may make contact with a button actuator (not shown) located within the doorbell 330 when the button 333 is pressed by a visitor. When pressed, the button 333 may trigger one or more functions of the doorbell 330, as further described below.

With further reference to FIG. 5, the doorbell 330 further includes an enclosure 331 that engages the faceplate 335. The doorbell 330 further includes a lens 332. In some embodiments, the lens may comprise a Fresnel lens, which may be patterned to deflect incoming light into one or more infrared sensors located within the doorbell 330. The doorbell 330 further includes a camera 334, which captures video data when activated, as described below.

The doorbell 330 further comprises passive infrared (PIR) sensors 344-1, 344-2, 344-3 (FIG. 6) (hereinafter collectively referred to as the PIR sensors 344), which are secured on or within a PIR sensor holder 343 (FIG. 6), and the assembly resides behind the lens 332. In some embodiments, the doorbell 330 may comprise three PIR sensors 344-1, 344-2, 344-3, as further described below, but in other embodiments any number of PIR sensors 344 may be provided. In some embodiments, one or more of the PIR sensors 344 may comprise a pyroelectric infrared sensor.

The PIR sensors 344 may be any type of sensor capable of detecting and communicating the presence of a heat source within their field of view. Further, alternative embodiments may comprise one or more motion sensors either in place of or in addition to the PIR sensors 344.

FIG. 6 is a top view of the passive infrared sensor assembly 379 illustrating the fields of view of the passive infrared sensors 344. In the illustrated embodiment, the side faces of the passive infrared sensor holder 343 are angled at 55° facing outward from the center face, and each PIR sensor 344 has a field of view of 110°. However, these angles may be increased or decreased as desired. Zone 1 is the area that is visible only to a first one of the passive infrared sensors 344-1. Zone 2 is the area that is visible only to the first one of the PIR sensor 344-1 and a second one of the PIR sensors 344-2. Zone 3 is the area that is visible only to a second one of the PIR sensors 344-2. Zone 4 is the area that is visible only to the second one of the PIR sensors 344-2 and a third one of the passive infrared sensors 344-3. Zone 5 is the area that is visible only to the third one of the PIR sensors 344-3. In some embodiments, the doorbell 130 may be capable of determining the direction that an object is moving based upon which zones are triggered in a time sequence.

FIG. 7 is a functional block diagram of the components within or in communication with the doorbell 330, according to an aspect of the present embodiments. The bracket PCB 349 may comprise an accelerometer 350, a barometer 351, a humidity sensor 352, and a temperature sensor 353. The accelerometer 350 may be one or more sensors capable of sensing motion and/or acceleration. The barometer 351 may be one or more sensors capable of determining the atmospheric pressure of the surrounding environment in which the bracket PCB 349 may be located. The humidity sensor 352 may be one or more sensors capable of determining the amount of moisture present in the atmospheric environment in which the bracket PCB 349 may be located. The temperature sensor 353 may be one or more sensors capable of determining the temperature of the ambient environment in which the bracket PCB 349 may be located. The bracket PCB 349 may be located outside the housing of the doorbell 330 so as to reduce interference from heat, pressure, moisture, and/or other stimuli generated by the internal components of the doorbell 330.

With further reference to FIG. 7, the bracket PCB 349 may further comprise terminal screw inserts 354, which may be configured to receive the terminal screws and transmit power to the electrical contacts on the mounting bracket. The bracket PCB 349 may be electrically and/or mechanically coupled to the power PCB 348 through the terminal screws, the terminal screw inserts 354, the spring contacts 340, and the electrical contacts. The terminal screws may receive electrical wires located at the surface to which the doorbell 330 is mounted, such as the wall of a building, so that the doorbell can receive electrical power from the building's electrical system. Upon the terminal screws being secured within the terminal screw inserts 354, power may be transferred to the bracket PCB 349, and to all of the components associated therewith, including the electrical contacts. The electrical contacts may transfer electrical power to the power PCB 348 by mating with the spring contacts 340.

With further reference to FIG. 7, the front PCB 346 may comprise a light sensor 355, one or more light-emitting components, such as LED's 356, one or more speakers 357, and a microphone 358. The light sensor 355 may be one or more sensors capable of detecting the level of ambient light of the surrounding environment in which the doorbell 330 may be located. LED's 356 may be one or more light-emitting diodes capable of producing visible light when supplied with power. The speakers 357 may be any electromechanical device capable of producing sound in response to an electrical signal input. The microphone 358 may be an acoustic-to-electric transducer or sensor capable of converting sound waves into an electrical signal. When activated, the LED's 356 may illuminate the light pipe 336 (FIG. 5). The front PCB 346 and all components thereof may be electrically coupled to the power PCB 348, thereby allowing data and/or power to be transferred to and from the power PCB 348 and the front PCB 346.

The speakers 357 and the microphone 358 may be coupled to the camera processor 370 through an audio CODEC 361. For example, the transfer of digital audio from the user's client device 114 and the speakers 357 and the microphone 358 may be compressed and decompressed using the audio CODEC 361, coupled to the camera processor 370. Once compressed by audio CODEC 361, digital audio data may be sent through the communication module 364 to the network 112, routed by one or more servers 118, and delivered to the user's client device 114 (FIG. 1). When the user speaks, after being transferred through the network 112, digital audio data is decompressed by audio CODEC 361 and emitted to the visitor via the speakers 357.

With further reference to FIG. 7, the power PCB 348 may comprise a power management module 362, a microcontroller 363 (may also be referred to as "processor," "CPU," or "controller"), the communication module 364, and power PCB non-volatile memory 365. In certain embodiments, the power management module 362 may comprise an integrated circuit capable of arbitrating between multiple voltage rails, thereby selecting the source of power for the doorbell 330. The battery 366, the spring contacts 340, and/or the connector 360 may each provide power to the power management module 362. The power management module 362 may have separate power rails dedicated to the battery 366, the spring contacts 340, and the connector 360. In one aspect of the present disclosure, the power management module 362 may continuously draw power from the battery 366 to power the doorbell 330, while at the same time routing power from the spring contacts 340 and/or the connector 360 to the battery 366, thereby allowing the battery 366 to maintain a substantially constant level of charge. Alternatively, the power management module 362 may continuously draw power from the spring contacts 340 and/or the connector 360 to power the doorbell 330, while only drawing from the battery 366 when the power from the spring contacts 340 and/or the connector 360 is low or insufficient. Still further, the battery 366 may comprise the sole source of power for the doorbell 330. In such embodiments, the spring contacts 340 may not be connected to a source of power. When the battery 366 is depleted of its charge, it may be recharged, such as by connecting a power source to the connector 360. The power management module 362 may also serve as a conduit for data between the connector 360 and the microcontroller 363.

With further reference to FIG. 7, in certain embodiments the microcontroller 363 may comprise an integrated circuit including a processor core, memory, and programmable input/output peripherals. The microcontroller 363 may receive input signals, such as data and/or power, from the PIR sensors 344, the bracket PCB 349, the power management module 362, the light sensor 355, the microphone 358, and/or the communication module 364, and may perform various functions as further described below. When the microcontroller 363 is triggered by the PIR sensors 344, the microcontroller 363 may be triggered to perform one or more functions. When the light sensor 355 detects a low level of ambient light, the light sensor 355 may trigger the microcontroller 363 to enable "night vision," as further described below. The microcontroller 363 may also act as a conduit for data communicated between various components and the communication module 364.

With further reference to FIG. 7, the communication module 364 may comprise an integrated circuit including a processor core, memory, and programmable input/output peripherals. The communication module 364 may also be configured to transmit data wirelessly to a remote network device, and may include one or more transceivers (not shown). The wireless communication may comprise one or more wireless networks, such as, without limitation, Wi-Fi, cellular, Bluetooth, and/or satellite networks. The communication module 364 may receive inputs, such as power and/or data, from the camera PCB 347, the microcontroller 363, the button 333, the reset button 359, and/or the power PCB non-volatile memory 365. When the button 333 is pressed, the communication module 364 may be triggered to perform one or more functions. When the reset button 359 is pressed, the communication module 364 may be triggered to erase any data stored at the power PCB non-volatile memory 365 and/or at the camera PCB memory 369. The communication module 364 may also act as a conduit for data communicated between various components and the microcontroller 363. The power PCB non-volatile memory 365 may comprise flash memory configured to store and/or transmit data. For example, in certain embodiments the power PCB non-volatile memory 365 may comprise serial peripheral interface (SPI) flash memory.

With further reference to FIG. 7, the camera PCB 347 may comprise components that facilitate the operation of the camera 334. For example, an imager 371 may comprise a video recording sensor and/or a camera chip. In one aspect of the present disclosure, the imager 371 may comprise a complementary metal-oxide semiconductor (CMOS) array, and may be capable of recording high definition (e.g., 1080p or better) video files. A camera processor 370 may comprise an encoding and compression chip. In some embodiments, the camera processor 370 may comprise a bridge processor. The camera processor 370 may process video recorded by the imager 371 and audio recorded by the microphone 358, and may transform this data into a form suitable for wireless transfer by the communication module 364 to a network. The camera PCB memory 369 may comprise volatile memory that may be used when data is being buffered or encoded by the camera processor 370. For example, in certain embodiments the camera PCB memory 369 may comprise synchronous dynamic random-access memory (SD RAM). IR LED's 368 may comprise light-emitting diodes capable of radiating infrared light. IR cut filter 367 may comprise a system that, when triggered, configures the imager 371 to see primarily infrared light as opposed to visible light. When the light sensor 355 detects a low level of ambient light (which may comprise a level that impedes the performance of the imager 371 in the visible spectrum), the IR LED's 368 may shine infrared light through the doorbell 330 enclosure out to the environment, and the IR cut filter 367 may enable the imager 371 to see this infrared light as it is reflected or refracted off of objects within the field of view of the doorbell. This process may provide the doorbell 330 with the "night vision" function mentioned above.

Some of the present embodiments may comprise computer vision for one or more aspects, such as object and/or facial recognition. Computer vision includes methods for acquiring, processing, analyzing, and understanding images and, in general, high-dimensional data from the real world in order to produce numerical or symbolic information, e.g., in the form of decisions. Computer vision seeks to duplicate the abilities of human vision by electronically perceiving and understanding an image. Understanding in this context means the transformation of visual images (the input of the retina) into descriptions of the world that can interface with other thought processes and elicit appropriate action. This image understanding can be seen as the disentangling of symbolic information from image data using models constructed with the aid of geometry, physics, statistics, and learning theory. Computer vision has also been described as the enterprise of automating and integrating a wide range of processes and representations for vision perception. As a scientific discipline, computer vision is concerned with the theory behind artificial systems that extract information from images. The image data can take many forms, such as video sequences, views from multiple cameras, or multi-dimensional data from a scanner. As a technological discipline, computer vision seeks to apply its theories and models for the construction of computer vision systems.

One aspect of computer vision comprises determining whether or not the image data contains some specific object, feature, or activity. Different varieties of computer vision recognition include: Object Recognition (also called object classification)—One or several pre-specified or learned objects or object classes can be recognized, usually together with their 2D positions in the image or 3D poses in the scene. Identification—An individual instance of an object is recognized. Examples include identification of a specific person's face or fingerprint, identification of handwritten digits, or identification of a specific vehicle. Detection—The image data are scanned for a specific condition. Examples include detection of possible abnormal cells or tissues in medical images or detection of a vehicle in an automatic road toll system. Detection based on relatively simple and fast computations is sometimes used for finding smaller regions of interesting image data that can be further analyzed by more computationally demanding techniques to produce a correct interpretation.

Several specialized tasks based on computer vision recognition exist, such as: Optical Character Recognition (OCR)—Identifying characters in images of printed or handwritten text, usually with a view to encoding the text in a format more amenable to editing or indexing (e.g., ASCII). 2D Code Reading—Reading of 2D codes such as data matrix and QR codes. Facial Recognition. Shape Recognition Technology (SRT)—Differentiating human beings (e.g., head and shoulder patterns) from objects.

Typical functions and components (e.g., hardware) found in many computer vision systems are described in the following paragraphs. The present embodiments may include at least some of these aspects. For example, with reference to FIG. 3, embodiments of the present AN recording and communication doorbell 130 may include a computer vision module 163. The computer vision module 163 may include any of the components (e.g., hardware) and/or functionality described herein with respect to computer vision, including, without limitation, one or more cameras, sensors, and/or processors. In some of the present embodiments, the microphone 150, the camera 154, and/or the imaging processor 240 may be components of the computer vision module 163.

Image acquisition—A digital image is produced by one or several image sensors, which, besides various types of light-sensitive cameras, may include range sensors, tomography devices, radar, ultra-sonic cameras, etc. Depending on the type of sensor, the resulting image data may be a 2D image, a 3D volume, or an image sequence. The pixel values may correspond to light intensity in one or several spectral bands (gray images or color images), but can also be related to various physical measures, such as depth, absorption or reflectance of sonic or electromagnetic waves, or nuclear magnetic resonance.

Pre-processing—Before a computer vision method can be applied to image data in order to extract some specific piece of information, it is usually beneficial to process the data in order to assure that it satisfies certain assumptions implied by the method. Examples of pre-processing include, but are not limited to re-sampling in order to assure that the image coordinate system is correct, noise reduction in order to assure that sensor noise does not introduce false information, contrast enhancement to assure that relevant information can be detected, and scale space representation to enhance image structures at locally appropriate scales.

Feature extraction—Image features at various levels of complexity are extracted from the image data. Typical examples of such features are: Lines, edges, and ridges; Localized interest points such as corners, blobs, or points; More complex features may be related to texture, shape, or motion.

Detection/segmentation—At some point in the processing a decision may be made about which image points or regions of the image are relevant for further processing. Examples are: Selection of a specific set of interest points; Segmentation of one or multiple image regions that contain a specific object of interest; Segmentation of the image into nested scene architecture comprising foreground, object groups, single objects, or salient object parts (also referred to as spatial-taxon scene hierarchy).

High-level processing—At this step, the input may be a small set of data, for example a set of points or an image region that is assumed to contain a specific object. The remaining processing may comprise, for example: Verification that the data satisfy model-based and application-specific assumptions; Estimation of application-specific parameters, such as object pose or object size; Image recognition—classifying a detected object into different categories; Image registration—comparing and combining two different views of the same object.

Decision making—Making the final decision required for the application, for example match/no-match in recognition applications.

One or more of the present embodiments may include a vision processing unit (not shown separately, but may be a component of the computer vision module 163). A vision processing unit is an emerging class of microprocessor; it is a specific type of AI (artificial intelligence) accelerator designed to accelerate machine vision tasks. Vision processing units are distinct from video processing units (which are specialized for video encoding and decoding) in their suitability for running machine vision algorithms such as convolutional neural networks, SIFT, etc. Vision processing units may include direct interfaces to take data from cameras (bypassing any off-chip buffers), and may have a greater emphasis on on-chip dataflow between many parallel execution units with scratchpad memory, like a manycore DSP (digital signal processor). But, like video processing units, vision processing units may have a focus on low precision fixed-point arithmetic for image processing.

Some of the present embodiments may use facial recognition hardware and/or software, as a part of the computer vision system. Various types of facial recognition exist, some or all of which may be used in the present embodiments.

Some face recognition algorithms identify facial features by extracting landmarks, or features, from an image of the subject's face. For example, an algorithm may analyze the relative position, size, and/or shape of the eyes, nose, cheekbones, and jaw. These features are then used to search for other images with matching features. Other algorithms normalize a gallery of face images and then compress the face data, only saving the data in the image that is useful for face recognition. A probe image is then compared with the face data. One of the earliest successful systems is based on template matching techniques applied to a set of salient facial features, providing a sort of compressed face representation.

Recognition algorithms can be divided into two main approaches, geometric, which looks at distinguishing features, or photometric, which is a statistical approach that distills an image into values and compares the values with templates to eliminate variances.

Popular recognition algorithms include principal component analysis using eigenfaces, linear discriminant analysis, elastic bunch graph matching using the Fisherface algorithm, the hidden Markov model, the multilinear subspace learning using tensor representation, and the neuronal motivated dynamic link matching.

Further, a newly emerging trend, claimed to achieve improved accuracy, is three-dimensional face recognition. This technique uses 3D sensors to capture information about the shape of a face. This information is then used to identify distinctive features on the surface of a face, such as the contour of the eye sockets, nose, and chin.

One advantage of 3D face recognition is that it is not affected by changes in lighting like other techniques. It can also identify a face from a range of viewing angles, including a profile view. Three-dimensional data points from a face vastly improve the precision of face recognition. 3D research is enhanced by the development of sophisticated sensors that do a better job of capturing 3D face imagery. The sensors work by projecting structured light onto the face. Up to a dozen or more of these image sensors can be placed on the same CMOS chip—each sensor captures a different part of the spectrum.

Another variation is to capture a 3D picture by using three tracking cameras that point at different angles; one camera pointing at the front of the subject, a second one to the side, and a third one at an angle. All these cameras work together to track a subject's face in real time and be able to face detect and recognize.

Another emerging trend uses the visual details of the skin, as captured in standard digital or scanned images. This technique, called skin texture analysis, turns the unique lines, patterns, and spots apparent in a person's skin into a mathematical space.

Another form of taking input data for face recognition is by using thermal cameras, which may only detect the shape of the head and ignore the subject accessories such as glasses, hats, or make up.

Further examples of automatic identification and data capture (AIDC) and/or computer vision that can be used in the present embodiments to verify the identity and/or authorization of a person include, without limitation, biometrics. Biometrics refers to metrics related to human characteristics. Biometrics authentication (or realistic authentication) is used in various forms of identification and access control. Biometric identifiers are the distinctive, measurable characteristics used to label and describe individuals. Biometric identifiers can be physiological characteristics and/or behavioral characteristics. Physiological characteristics may be related to the shape of the body. Examples include, but are not limited to, fingerprints, palm veins, facial recognition, three-dimensional facial recognition, skin texture analysis, DNA, palm prints, hand geometry, iris recognition, retina recognition, and odor/scent recognition. Behavioral characteristics may be related to the pattern of behavior of a person, including, but not limited to, typing rhythm, gait, and voice recognition.

The present embodiments may use any one, or any combination of more than one, of the foregoing biometrics to identify and/or authenticate a person who is either suspicious or who is authorized to take certain actions with respect to a property or expensive item of collateral. For example, the computer vision module 163, and/or the camera 154 and/or the processor 160 may receive information about the person using any one, or any combination of more than one, of the foregoing biometrics.

One aspect of the present embodiments includes the realization that, historically, security systems have been designed and intended to protect only the property at which the security systems are installed. A typical security system is self-contained, and provides a warning to the property owner only when an intrusion is detected at that same property, and only when the security system is armed. However, potential threats to the property may occur before an intruder crosses the property boundary where the security system is installed, such as when an intrusion occurs at a nearby property. The present embodiments solve this problem by leveraging the functionality of security systems to link together security systems at multiple properties, where each property is protected by a security system and/or an A/V recording and communication device. When an intrusion is detected by a security system and/or an A/V recording and communication device at one of the properties in the network of properties, warnings may be provided to users associated with the other properties in the network that include security systems. Such warnings may provide the users with opportunity to take corrective action, such as by arming their own alarm systems, before the potential threat at the nearby property becomes an actual threat at that user's property. As a result, the safety of that user's property is increased, as well as the safety of the other properties in the network, thereby contributing to public safety.

For example, in some of the present embodiments, a method for a security network may include, in response to a security event detected by a first security system, receiving security event data from the first security system; analyzing the security event data to determine a security event procedure for a second security system based on the security event data; when the security event procedure for the second security system includes an automatic arming action; transmitting the automatic arming action to the second security system; when the security event procedure for the second security system includes an arming action request: generating and transmitting, to a client device associated with the second security system, the arming action request; in response to transmitting the arming action request, receiving from the client device, an arming action; and transmitting, to the second security system, the arming action.

Figure 8:
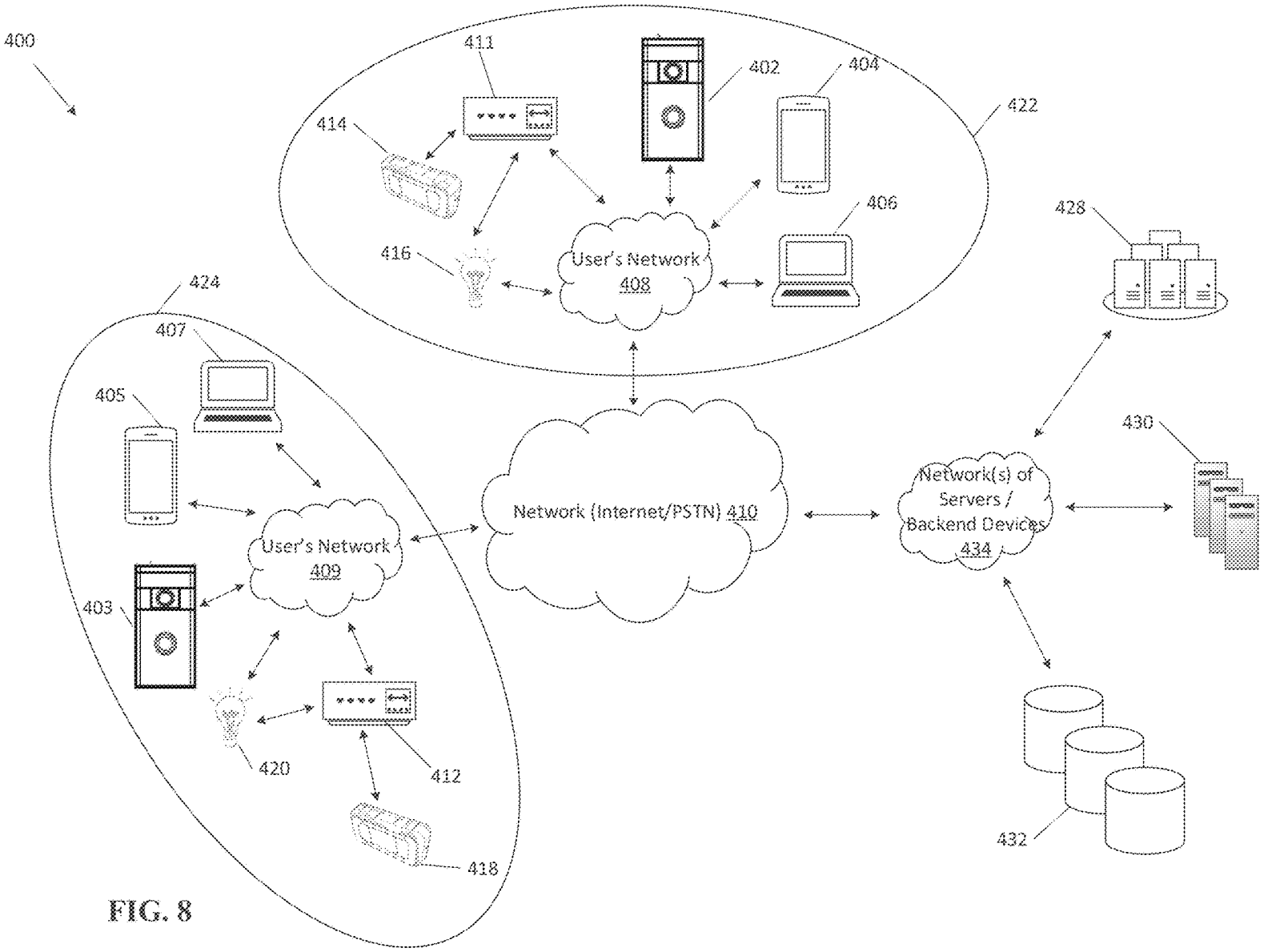
FIG. 8 is a functional block diagram illustrating a system for communicating in a network according to various aspects of the present disclosure.

FIG. 8 is a functional block diagram illustrating a system 400 for communicating in a network according to various aspects of the present disclosure. The system 400 may include one or more first A/V recording and communication devices 402 configured to access a user's network 408 to connect to a network (Internet/PSTN) 410. The system 400 may further include one or more second A/V recording and communication devices 403 configured to access the user's network 409 to connect to the network (Internet/PSTN) 410. The one or more first and second A/V recording and communication devices 402, 403 may include any or all of the components and/or functionality of the A/V recording and communication device 100 (FIGS. 1-2), the A/V recording and communication doorbell 130 (FIGS. 3-4), and/or the A/V recording and communication doorbell 330 (FIGS. 5-7). As discussed herein, the present disclosure provides numerous examples of methods and systems including the first and the second A/V recording and communication devices 402, 403, such as A/V recording and communication doorbells, but the present embodiments are equally applicable for A/V recording and communication devices other than doorbells. For example, the present embodiments may include one or more A/V recording and communication security cameras, one or more A/V recording and communication spotlights, and/or one or more A/V recording and communication security floodlights instead of, or in addition to, one or more A/V recording and communication doorbells. An example A/V recording and communication security camera may include substantially all of the structure and functionality of the doorbell 330, but without the front button 333 and related components.

The user's network 408, 409 may include any or all of the components and/or functionality of the user's network 110 described herein. The system 400 may also include one or more client devices 404, 406, which in various embodiments may be configured to be in network communication and/or associated with the first A/V recording and communication device 402. The system 400 may further include one or more client devices 405, 407, which in various embodiments may be configured to be in network communication and/or associated with the second A/V recording and communication device 403. The client devices 404, 406, 405, 407 may comprise, for example, a mobile phone such as a smartphone, or a computing device such as a tablet computer, a laptop computer, a desktop computer, etc. The client devices 404, 406, 405, 407 may include any or all of the components and/or functionality of the client device 114 and/or the client device 800 described herein. In some embodiments, the client devices 404, 406 may not be associated with the first A/V recording and communication device 402 and the client devices 405, 407 may not be associated with the second A/V recording and communication device 403. In other words, the user/owner of the client device(s) 404, 406, 405, 407 may not also use/own an A/V recording and communication device.

The system 400 may further include a first smart-home hub device 411 (which may alternatively be referred to herein as the first hub device 411) connected to the user's network 408. The first smart-home hub device 411 (also known as a home automation hub, gateway device, etc.), may comprise any device that facilitates communication with and control of the sensors 414, automation devices 416, and/or the one or more first A/V recording and communication devices 402. For example, the first smart-home hub device 411 may be a component of a home automation system installed at a first property. The system 400 may further include a second smart-home hub device 412 (which may alternatively be referred to herein as the second hub device 412) connected to the user's network 409. The second smart-home hub device 412 (also known as a home automation hub, a gateway device, etc.), may comprise any device that facilitates communication with and control of the sensors 418, automation devices 420, and/or the one or more second A/V recording and communication devices 403. For example, the second smart-home hub device 412 may be a component of a home automation system installed at a second property.

Though not shown in FIG. 8, the first A/V recording and communication device 402 may communicate with the first smart-home hub device 411 directly and/or indirectly via the user's network 408. As shown in FIG. 8, the sensors 414 and the automation devices 416 may communicate with the first smart-home hub device 411 directly and/or indirectly via the user's network 408. Though not shown in FIG. 8, the second A/V recording and communication device 403 may similarly communicate with the second smart-home hub device 412 directly and/or indirectly via the user's network 409. As shown in FIG. 8, the sensors 418 and the automation devices 420 may communicate with the second smart-home hub device 412 directly and/or indirectly via the user's network 409.

Home automation, or smart home, is building automation for the home. It involves the control and automation of various devices and/or systems, such as lighting, heating (such as smart thermostats), ventilation, air conditioning (HVAC), blinds/shades, and security, as well as home appliances, such as washers/dryers, ovens, or refrigerators/freezers. Wi-Fi is often used for remote monitoring and control. Smart home devices (e.g., the first and the second hub devices 411, 412, the sensors 414, 418, the automation devices 416, 420, the first and the second A/V recording and communication devices 402, 403, etc.), when remotely monitored and controlled via the network (Internet/PSTN) 410, may be considered to be components of the Internet of Things. Smart home systems may include switches and/or sensors (e.g., the sensors 416, 418) connected to a central hub such as the first smart-home hub device 411 or the second smart-home hub device 412, sometimes called a gateway, from which the system may be controlled with a user interface. The user interface may include any or all of a wall-mounted terminal, software installed on the client devices 404, 405, 406, 407 (e.g., a mobile application), a tablet computer or a web interface, often but not always via Internet cloud services. The home automation system may use one or more communication protocols, including either or both of wired and wireless protocols, including but not limited to Wi-Fi, X10, Ethernet, RS-485, 6LoWPAN, Bluetooth LE (BTLE), ZigBee, and Z-Wave.

The one or more sensors 414, 418 may include, for example, at least one of a door sensor, a window sensor, a contact sensor, a tilt sensor, a temperature sensor, a carbon monoxide sensor, a smoke detector, a light sensor, a glass break sensor, a motion sensor, a thermostat, and/or other sensors that may provide the user/owner of the first security system 422 of a security event at his or her property.

The one or more automation devices 416, 420 may include, for example, at least one of an outdoor lighting system, an indoor lighting system, and indoor/outdoor lighting system, a temperature control system (e.g., a thermostat), a shade/blind control system, a locking control system (e.g., door lock, window lock, etc.), and/or other automation devices.

Figure 13:
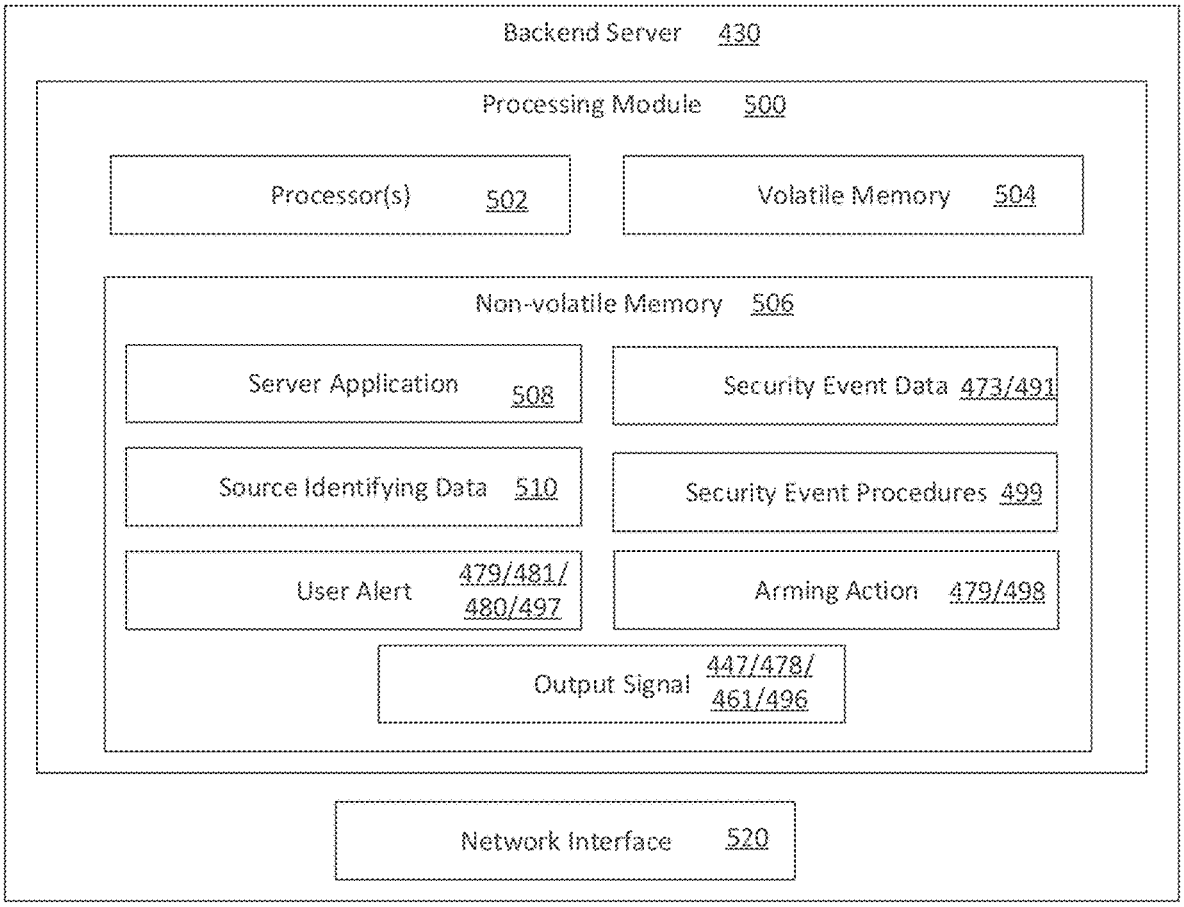
FIG. 13 is a functional block diagram illustrating one embodiment of a backend device according to various aspects of the present disclosure.

As described herein, in some of the present embodiments, some or all of the user's network 408, the client device 404, 406, the first A/V recording and communication device 402, the first smart-home hub device 411, the sensors 414, and the automation devices 416 may be referred to as a first security system 422, which may be installed at a first property or premises. In addition, in some of the present embodiments, some or all of the user's network 409, the client device 405, 407, the second A/V recording and communication device 403, the second smart-home hub device 412, the sensors 418, and the automation devices 420 may be referred to as a second security system 424, which may be installed at a second property or premises. The first security system 422 and the second security system 424 may be part of a network of security systems. Although only the first security system 422 and the second security system 424 are included in the illustration of the system 400, this illustration is not intended to be limiting. In some embodiments, any number of security systems (one or more) may be incorporated into the network of security systems. For example, in an embodiment where the network of security systems includes each of the security systems in a given neighborhood, many of the homes in the neighborhood may have a security system, and as a result, the network of security systems may include the security systems from each of the homes that are part of the network of security systems (e.g., each of the homes that have security systems in the neighborhood that have "opted in" to the network of security systems). In addition, each of the security systems in the network of security systems may have their own security event procedures 499 that may be implemented in response to security events from any other security system in the network of security systems (FIG. 13). In addition, each of the security systems in the network of security systems may each have different security event procedures 499 in response to each of a variety of different security event data 473, 491 (FIG. 13).

With further reference to FIG. 8, the system 400 may also include various backend devices such as (but not limited to) storage devices 432, backend servers 430, and backend APIs 428 that may be in network communication with the first A/V recording and communication device 402, the second A/V recording and communication device 403, the first hub device 411, the second hub device 412, the client devices 404, 405, 406, 407, the sensors 414, 416, and/or the automation devices 416, 410. In some embodiments, the storage devices 432 may be a separate device from the backend servers 430 (as illustrated) or may be an integral component of the backend servers 430. The storage devices 432 may be similar in structure and/or function to the storage device 116 (FIG. 1). In addition, in some embodiments, the backend servers 430 and backend APIs 428 may be similar in structure and/or function to the server 118 and the backend API 120 (FIG. 1), respectively.

Figure 9:
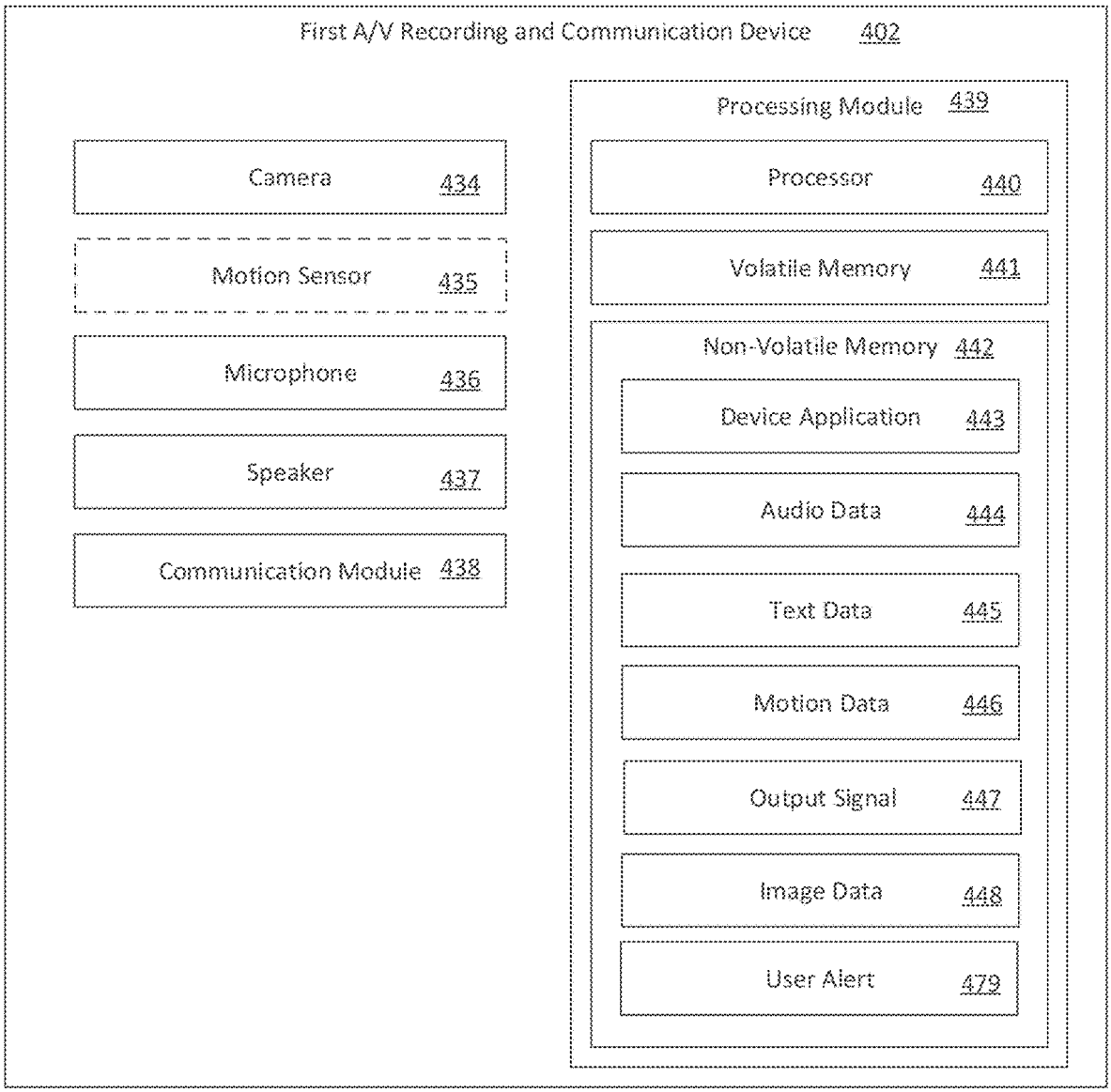
FIGS. 9-10 are functional block diagrams illustrating embodiments of A/V recording and communication devices according to various aspects of the present disclosure.

FIG. 9 is a functional block diagram illustrating an embodiment of the first A/V recording and communication device 402 according to various aspects of the present disclosure. The first A/V recording and communication device 402 may comprise a processing module 439 that is operatively connected to a camera 434, a microphone 436, a speaker 437, a motion sensor 435, and a communication module 438. The processing module 439 may comprise a processor 440, volatile memory 441, and non-volatile memory 442 that includes a device application 443. In various embodiments, the device application 443 may configure the processor 440 to capture image data 448 using the camera 434, audio data 444 using the microphone 436, and/or motion data 446 using the camera 434 and/or the motion sensor 435. In some embodiments, the device application 445 may also configure the processor 440 to generate text data 445 describing the image data 448, such as in the form of metadata, for example. In some of the present embodiments, the device application 443 may configure the processor 440 to transmit the image data 448, the audio data 444, the motion data 446, and/or the text data 445 to the client device 404, 406, the first hub device 411, and/or the backend server 430 using the communication module 448.

In various embodiments, the device application 443 may also configure the processor 440 to generate and transmit an output signal 447 that may include the image data 448, the audio data 444, the text data 445, and/or the motion data 446. In some of the present embodiments, the output signal 447 may be transmitted to the backend server(s) 430 using the communication module 438, and the backend server(s) 430 may transmit (or forward) the output signal 447 to the client device 404, 406, 405, 407. In other embodiments, the output signal 447 may be transmitted directly to the client device 404, 406.

In further reference to FIG. 9, the image data 448 may comprise image sensor data such as (but not limited to) exposure values and data regarding pixel values for a particular sized grid. Further, the image data 448 may comprise converted image sensor data for standard image file formats such as (but not limited to) JPEG, JPEG 2000, TIFF, BMP, or PNG. In addition, the image data 448 may also comprise data related to the still image, video, or combination thereof, included in the image data 448. Such data may include (but is not limited to) image sequences, frame rates, and the like. Moreover, the image data 448 may include data that is analog, digital, compressed, uncompressed, and/or in vector formats.

The image data 448 may include still images, live video, and/or pre-recorded video. The image data 448 may be recorded by the camera 434 in a field of view of the camera 434. The processor 440 may be configured to transmit the image data 448 (e.g., as live streaming video) to the client devices 404, 406, the first hub device 411, and/or the backend server 430. The image data 460 may take on various forms and formats as appropriate to the requirements of a specific application in accordance with the present embodiments. As described herein, the term "record" may also be referred to as "capture" as appropriate to the requirements of a specific application in accordance with the present embodiments.

In further reference to FIG. 9, the motion data 446 may comprise motion sensor data generated in response to motion events. For example, in embodiments using a motion sensor 435, the motion data 446 may include an amount or level of a data type generated by the motion sensor 435. In some of the present embodiments, the motion data 446 may also comprise time-based and/or location-based information such as the amount of time a motion event is detected and/or the location of the motion event in the field of view of the motion sensor 435 (e.g., Zones 1-5 (FIG. 6), the location within one of the Zones 1-5, and/or the proximity to the motion sensor 435). In other embodiments, dependent on the type of motion sensor 435 implemented in a given embodiment, the motion data 446 may include the data type (e.g., voltage) generated specific to the type of motion sensor 435 (e.g., PIR, microwave, acoustic, etc.). The motion data 446 may further include an estimated speed and/or direction data of the person and/or object that caused the motion event.

In some of the present embodiments, such as those where the first A/V recording and communication device 402 is similar to that of the A/V recording and communication doorbell 130 of FIGS. 3-4, the motion data 446 may be generated by the camera 434. In such embodiments, the first A/V recording and communication device 402 may not have a motion sensor 435 (as illustrated by the dashed lines around the motion sensor 435 in FIG. 9). As such, the detection of a motion event, the determination of whether a motion event is caused by the movement of a person in a field of view of the first A/V recording and communication device 402, and/or the speed and/or location of a person and/or object in the field of view of the first A/V recording and communication device 402 may be determined using the motion data 446 generated by the camera 434. In such embodiments, the motion data 446 may include differences between successive frames (e.g., pixels) of the image data 448, where the differences may be the result of motion in the field of view of the camera 434, for example.

With further reference to FIG. 9, in some of the present embodiments, the first A/V recording and communication device 402 may generate a user alert 479. The user alert 479 may be generated, for example, in response to a motion event in the field of view of the first A/V recording and communication device 402 (e.g., the movement of a person, animal, and/or object). The user alert 479 may be programmed to include information representative of the motion event, such as the motion data 446, the image data 448, the audio data 444, and/or the text data 445 (e.g., for display on the client device 404, 406 and/or the client devices associated with other A/V recording and communication devices or security systems, such as the client devices 405, 407).

Figure 10:
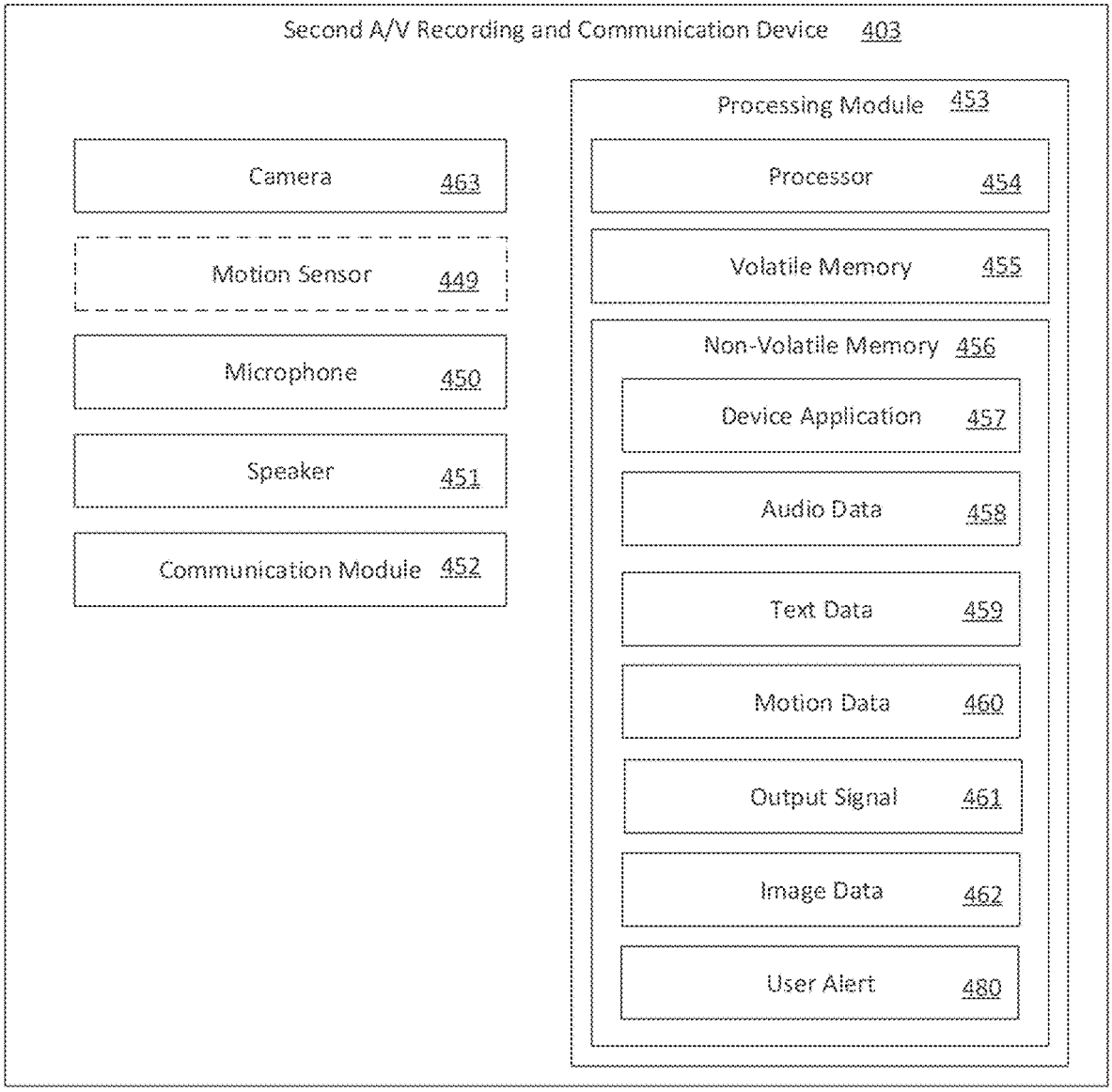

FIG. 10 is a functional block diagram illustrating an embodiment of the second A/V recording and communication device 403 according to various aspects of the present disclosure. The second A/V recording and communication device 403 may comprise a processing module 453 that is operatively connected to a camera 463, a microphone 450, a speaker 451, a motion sensor 449, and a communication module 452. The processing module 453 may comprise a processor 454, volatile memory 455, and non-volatile memory 456 that includes a device application 457. In various embodiments, the device application 457 may configure the processor 454 to capture image data 462 using the camera 463, audio data 458 using the microphone 450, and/or motion data 460 using the camera 463 and/or the motion sensor 449. In some embodiments, the device application 457 may also configure the processor 454 to generate text data 459 describing the image data 462, such as in the form of metadata, for example. In some of the present embodiments, the device application 457 may configure the processor 454 to transmit the image data 462, the audio data 458, the motion data 460, and/or the text data 459 to the client device 405, 407, the second hub device 412, and/or the backend server 430 using the communication module 452.

In various embodiments, the device application 457 may also configure the processor 454 to generate and transmit an output signal 461 that may include the image data 462, the audio data 458, the text data 459, and/or the motion data 460. In some of the present embodiments, the output signal 461 may be transmitted to the backend server(s) 430 using the communication module 452, and the backend server(s) 430 may transmit (or forward) the output signal 461 to the client device 404, 405, 406, 407. In other embodiments, the output signal 461 may be transmitted directly to the client device 405, 407.

In further reference to FIG. 10, the image data 462 may comprise image sensor data such as (but not limited to) exposure values and data regarding pixel values for a particular sized grid. Further, the image data 462 may comprise converted image sensor data for standard image file formats such as (but not limited to) JPEG, JPEG 2000, TIFF, BMP, or PNG. In addition, the image data 462 may also comprise data related to the still image, video, or combination thereof, included in the image data 462. Such data may include (but is not limited to) image sequences, frame rates, and the like. Moreover, the image data 462 may include data that is analog, digital, compressed, uncompressed, and/or in vector formats.

The image data 462 may include still images, live video, and/or pre-recorded video. The image data 462 may be recorded by the camera 463 in a field of view of the camera 463. The processor 454 may be configured to transmit the image data 462 (e.g., as live streaming video) to the client devices 405, 407, the second hub device 412, and/or the backend server 430. The image data 462 may take on various forms and formats as appropriate to the requirements of a specific application in accordance with the present embodiments. As described herein, the term "record" may also be referred to as "capture" as appropriate to the requirements of a specific application in accordance with the present embodiments.

In further reference to FIG. 10, the motion data 460 may comprise motion sensor data generated in response to motion events. For example, in embodiments using a motion sensor 449, the motion data 460 may include an amount or level of a data type generated by the motion sensor 449. In some of the present embodiments, the motion data 460 may also comprise time-based and/or location-based information such as the amount of time a motion event is detected and/or the location of the motion event in the field of view of the motion sensor 449 (e.g., Zones 1-5 (FIG. 6), the location within one of the Zones 1-5, and/or the proximity to the motion sensor 449. In other embodiments, dependent on the type of motion sensor 449 implemented in a given embodiment, the motion data 460 may include the data type (e.g., voltage) generated specific to the type of motion sensor 449 (e.g., PIR, microwave, acoustic, etc.). The motion data 460 may further include an estimated speed and/or direction data of the person and/or object that caused the motion event.

In some of the present embodiments, such as those where the second A/V recording and communication device 403 is similar to that of the A/V recording and communication doorbell 130 of FIGS. 3-4, the motion data 460 may be generated by the camera 463. In such embodiments, the second A/V recording and communication device 403 may not have a motion sensor 449 (as illustrated by the dashed lines around the motion sensor 449 in FIG. 10). As such, the detection of a motion event, the determination of whether a motion event is caused by the movement of a person in a field of view of the second A/V recording and communication device 403, and/or the speed and/or location of a person and/or object in the field of view of the second A/V recording and communication device 403 may be determined using the motion data 460 generated by the camera 463. In such embodiments, the motion data 460 may include differences between successive frames (e.g., pixels) of the image data 462, where the differences may be the result of motion in the field of view of the camera 463, for example.

With further reference to FIG. 10, in some of the present embodiments, the second A/V recording and communication device 403 may generate a user alert 480. The user alert 480 may be generated, for example, in response to a motion event in the field of view of the second A/V recording and communication device 403 (e.g., the movement of a person, animal, and/or object). The user alert 480 may be programmed to include information representative of the motion event, such as the motion data 460, the image data 462, the audio data 458, and/or the text data 459 (e.g., for display on the client device 405, 407 and/or the client devices associated with other A/V recording and communication devices or security systems, such as the client devices 404, 406).

Figure 11:
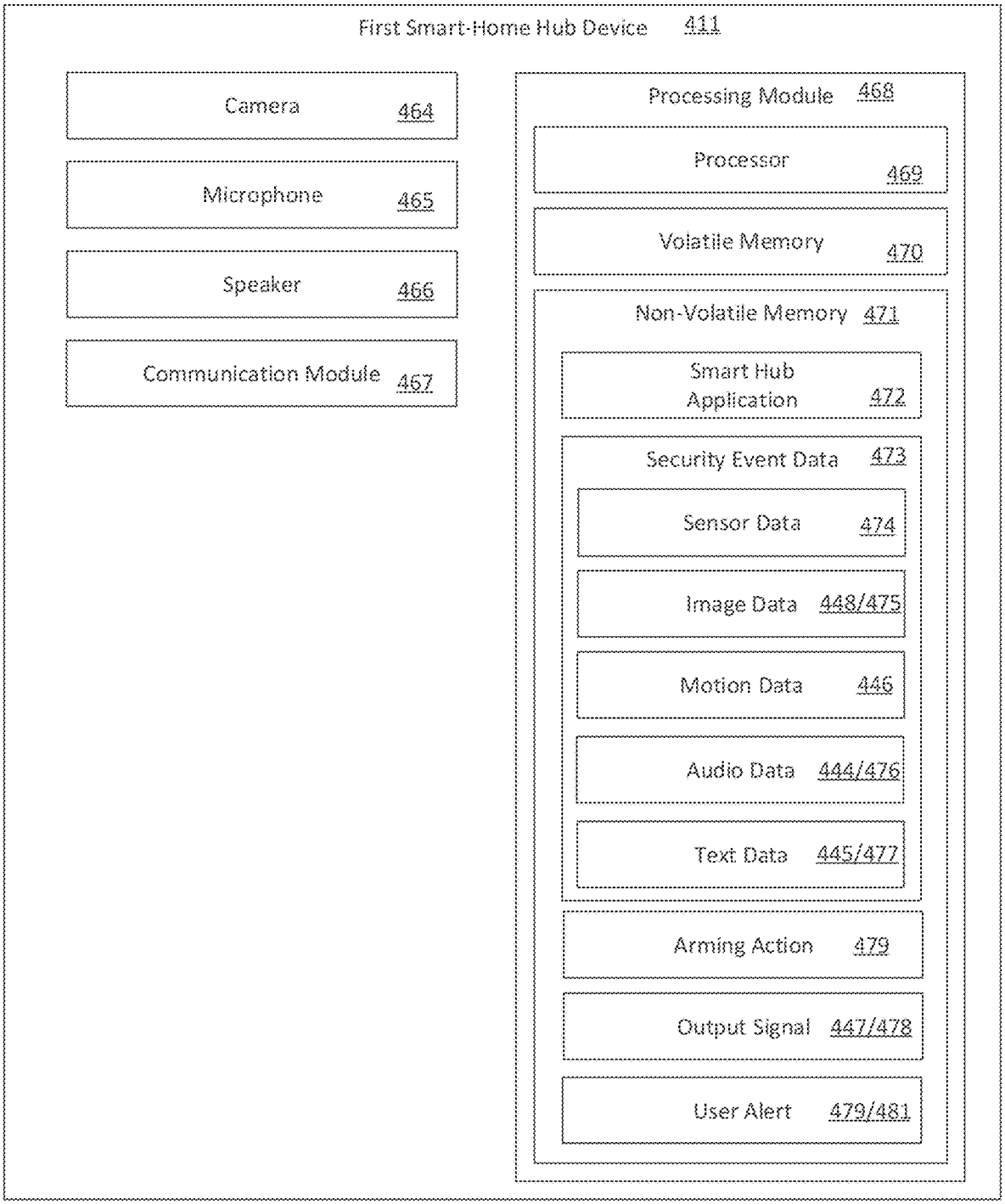
FIG. 11-12 are functional block diagrams illustrating embodiments of smart-home hub devices according to various aspects of the present disclosure.

FIG. 11 is a functional block diagram illustrating an embodiment of the first smart-home hub device 411 (alternatively referred to herein as the first hub device 411) according to various aspects of the present disclosure. The first hub device 411 may be, for example, one or more of a Wi-Fi hub, a smart-home hub, a hub of a home security/alarm system, a gateway device, a hub for a legacy security/alarm system (e.g., a hub for connecting a pre-existing security/alarm system to the network (Internet/PSTN) 410 for enabling remote control of the hub device), and/or another similar device. The first hub device 411 may comprise a processing module 468 that is operatively connected to a camera 464, a microphone 465, a speaker 466, and a communication module 467. In some embodiments, one or more of the camera 464, the microphone 465, and the speaker 466 may be omitted from the first hub device 411. The processing module 468 may comprise a processor 469, volatile memory 470, and non-volatile memory 471 that includes a smart-home hub application 472. In various embodiments, the smart-home hub application 472 may configure the processor 469 to receive sensor data 474 from the sensors 414 and/or the automation devices 416. For example, the sensor data 474 may include a current state (e.g., opened/closed for door and window sensors, motion detected for motion sensors, living room lights on/off for a lighting automation system, etc.) of each of the sensors 414 and/or the automation devices 416. In various embodiments, the smart-home hub application 472 may further configure the processor 469 to capture image data 475 using the camera 464 and/or audio data 476 using the microphone 465. In some embodiments, the smart-home hub application 472 may also configure the processor 469 to generate text data 477 describing the security event data 473, the occupancy data, and/or the arming status of the security system, such as in the form of metadata, for example. In other embodiments, the text data 477 describing the image data 475 may be generated by a user using the client device 404, 406 associated with the first hub device 411.

The smart-home hub application 472 may further configure the processor 469 to generate the user alert 481. The user alert 481 may include the security event data 473 described herein. The user alert 481 may also, in some embodiments, include information from the user alert 479 received from the first A/V recording and communication device 402.

In addition, the smart-home hub application 472 may configure the processor 469 to receive the image data 448, the audio data 444, the text data 445, the motion data 446, and/or the user alert 479 from the first A/V recording and communication device 402 using the communication module 467. In various embodiments, the smart-home hub application 472 may also configure the processor 469 to generate and transmit an output signal 478 that may include the image data 448, 475, the audio data 444, 476, the text data 445, 477, the motion data 446, the sensor data 474, the user alert 479, 481, and/or the arming action 479. In some of the present embodiments, the output signal 478 may be transmitted to the backend server(s) 430 using the communication module 467, and the backend server 430 may transmit the output signal 478 to the client device 404, 406 and/or the client device 405, 407 (e.g., in embodiments where the client device 405, 407 are associated with a security system in the network of security systems). In other embodiments, the output signal 478 may be transmitted directly to the client device 404, 406.

In some of the present embodiments, some or all of the sensor data 474, the image data 448, 475, the motion data 446, the audio data 444, 476, and the text data 445, 477 may be included in the security event data 473. The security event data 473 may comprise all of the data generated in response to a security event. For example, if a person breaks into a home, the security event data 473 may include the sensor data 474 generated by the door or window sensors that were breached, the image data 448 generated by the first A/V recording and communication device 402 at the time of the security event, the motion data 466 generated by the motion sensors of the sensor 414 and/or the motion sensor 435 of the first A/V recording and communication device 402, the audio data 476 recorded by the first hub device 411, and/or the text data 477 describing the security event based on the sensor data 474, the image data 448, the motion data 446, and/or the audio data 476.

In some of the present embodiments, the smart-home hub application 472 may configure the processor 469 to generate the arming action 479. In some embodiments, generating the arming action 479 may include arming/disarming the first security system 422 controlled by the first hub device 411. For example, the arming action 479 may include a disarmed, an armed stay, armed away, armed vacation, or other armed mode for the first security system 422. In some of the present embodiments, the first hub device 411 may generate the arming action 479 in response to receiving the arming action 479 over the user's network 408 and/or the network (Internet/PSTN) 410 (e.g., from the backend server 430 and/or the client device 404, 406). In some embodiments, the smart-home hub application 472 may configure to the processor 469 to transmit information representative of the arming action 479 to the backend server 430 and/or the client device 404, 406. For example, the information representative of the arming action 479 may include the arming status of the first security system 422 (e.g., armed away, armed stay, disarmed, etc.). The smart-home hub application 472 may also configure the processor 469 to monitor the sensors 414, the automation devices 416, and/or the first A/V recording and communication device(s) 402 according to the arming action 479.

The arming actions 479, as described herein, may include an armed stay, an armed away, an armed vacation, a disarmed mode, and/or other modes, such as a custom mode of the user. In the armed stay mode, the sensors 414 inside the property (e.g., motion sensors) may be disarmed while the sensors 414 and/or the first A/V recording and communication devices 402 outside and along the perimeter of the property (e.g., door sensors, window sensors, security cameras, etc.) may be armed. In addition, during the armed stay mode, at least one of the automation devices 416 (e.g., an outdoor lighting automation system) may be activated between certain hours, such as 6:00 p.m. and 4:00 a.m. In an armed away mode, the sensors 414 inside the property (e.g., the motion sensors), the sensors 414 outside and along the perimeter of the property (e.g., door sensors, window sensors, etc.), and/or the first A/V recording and communication devices 402 (e.g., security cameras, floodlight cameras, etc.) may be armed. In addition, during an armed away mode, one or more of the automation devices 416 (e.g., interior and/or exterior lighting automation systems) may be activated according to an activation schedule (e.g., interior lights on from 5:00 p.m. to 9:00 p.m., exterior lights on from 6:00 p.m. to 8:00 p.m., blinds/shades opened from 12:00 p.m. to 5:00 p.m. and closed from 5:00 p.m. to 4:00 a.m., etc.) in order to provide an indication that somebody is home, even when they are not. In an armed vacation mode, the sensors 414, the automation devices 416, and/or the first A/V recording and communication devices 402 may be armed and disarmed similar to the armed away mode, however, any alerts and security events may also be sent to neighbors and/or law enforcement. In a disarmed mode, all of the sensors 414 and/or the automation devices 416 may be deactivated (other than the automation devices 416 in use by the users separate from an arming mode of the first security system 422). However, in a disarmed mode, the one or more first A/V recording and communication devices 402 (e.g., security cameras, floodlight cameras, video doorbells, etc.) may be in an active state for detecting motion and/or recording activity in the field of view of the one or more first A/V recording and communication devices 402. In a custom mode, the user/owner of the first security system 422 may configure each of the sensors 414, the automation devices 416, and/or the first A/V recording and communication devices 402. For example, in a custom mode, "Summer," the user/owner may arm each of the door sensors but disable the window sensors (e.g., where windows may be left open for air flow). In addition, the user/owner may activate each of the first A/V recording and communication devices 402 in the back yard to record between 8:00 am and 5:00 p.m. (e.g., because the kids may regularly play in the back yard during the Summer months).

In further reference to FIG. 11, the sensor data 474 from the sensors 414 and/or the automation devices 416 may include, without limitation, a door open/close status from a door sensor (e.g., located at a front door, a side door, a back door, a door inside the home, etc.), a window open/close status from a window sensor, a garage door open/close status from a tilt sensor, an indoor/outdoor temperature from a thermometer or other temperature sensing device (e.g., thermostat), a carbon monoxide level from a carbon monoxide sensor, a light on/off and/or intensity status from an automated lighting system, a fire alarm status from a fire alarm, motion data from a motion sensor, glass break information from a glass break sensor, a humidity level from a humidity sensor, weather information from a home weather station, lock/unlock status of door/window/garage locks, and/or blinds/shades opened/closed status from a blind/shade automation system. The sensor data 474 may be generated in response to a sensor trigger (e.g., a door opening, a window shutting, etc.), or may be consistently and/or periodically generated to determine a status of the sensors 414 and/or the automation devices 416 and whether or not the status is indicative of a sensor trigger (e.g., a temperature above/below a threshold temperature).

With further reference to FIG. 11, the sensor data 474 may activate the sensor trigger. The sensor trigger may be an event and/or action that takes place that causes the sensors 414 and/or the automation devices 416 to generate the sensor data 474. In response to sensor triggers, the sensor data 474 may be generated by the sensor 414 and/or the automation devices 416 representative of the sensor trigger. The sensor data 474 generated in response to the sensor trigger may be analyzed by the first hub device 411 to determine a proper action based on the sensor trigger, such as transmitting the security event data 473 to the backend server 430 and/or the client device 404, 406. In addition, the sensor trigger may activate the first hub device 411 to activate or alter the status of the sensors 414 (e.g., by arming the door and window sensors), the automation devices 416 (e.g., by turning on lights of the automated lighting system), and/or the first A/V recording and communication device 402 (and/or other A/V recording and communication devices at the property) (e.g., by activating the camera 434 of the first A/V recording and communication device 402 to record the image data 448).

In some of the present embodiments, the first hub device 411 may analyze the sensor data 474, the image data 448, 475, the motion data 446, and/or the audio data 444, 476 to determine occupancy data for the first property. For example, the sensor data 474 may include motion data from motion sensors of the sensors 414 interior to the property and/or data indicative of a light switch interior to the home being turned on/off within the last 10 seconds, 20 seconds, etc. from a lighting automation system of the automation devices 416, the image data 448, 475 may include the presence of person(s) (e.g., based on an analysis using computer vision), the motion data 446 may include an indication of the presence of persons interior to the home (e.g., in embodiments where one of the first A/V recording and communication devices 402 is indoors), and/or the audio data 444, 476 may include voices, which may provide an indication of the presence of person(s). As a result, the first hub device 411 may analyze the sensor data 474, the image data 448, 475, the motion data 446, and/or the audio data 444, 476 to determine the occupancy data. In some of the present embodiments, the occupancy data may be a binary determination, such as occupied and not occupied. In addition, in some embodiments, the occupancy data may also include an estimate of how many people and/or animals are present and/or the location of the people and/or animals at the property (e.g., upstairs, downstairs, in the living room, etc.).

Some non-limiting examples of sensor triggers include, for example, if the sensor 414 is a door or window sensor, the door or window opening or closing. When the door or window is closed, and then is opened, this may be a sensor trigger that results in the door or window sensor generating sensor data 474 representative of the sensor trigger, for example. If the sensor 414 is a smoke detector or other sensor type that activates based on threshold amounts, for example, the sensor trigger may be the threshold amount being reached. For example, the smoke detector may only activate when the smoke levels reach a certain threshold, and when this threshold is reached, the sensor trigger may be said to have occurred, and sensor data 474 may be generated in response. If the sensor 414 is a thermometer, for example, a threshold temperature being reached may be the sensor trigger. In another example, if the sensor 414 is a motion sensor, the sensor trigger may be a threshold amount of detected motion.

In alternative embodiments, the sensor data 474 (including data representative of the sensor trigger) may be received by the first A/V recording and communication device 402 rather than, or in addition to, the first hub device 411. For example, some environments may not have a smart-home hub device. In these environments, the first A/V recording and communication device 402 may perform at least some of the functions of the first hub device 411 described herein, including receiving, processing, and/or transmitting the sensor data 474. For example, the sensors 414 and/or the automation devices 416 may be in communication with the first A/V recording and communication device 402, rather than, or in addition to, the first hub device 411.

Figure 12:
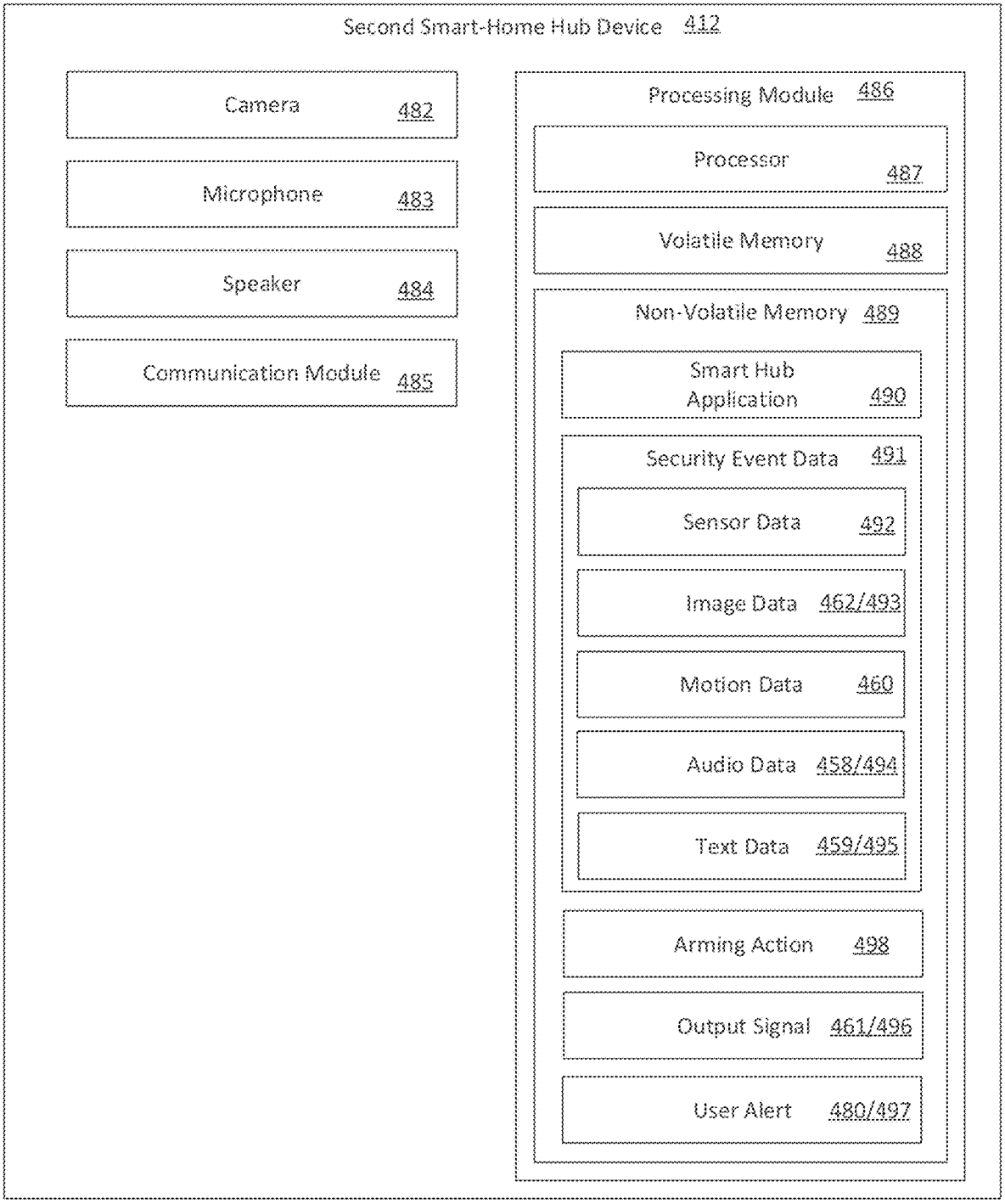

FIG. 12 is a functional block diagram illustrating an embodiment of the second smart-home hub device 412 (alternatively referred to herein as the second hub device 412) according to various aspects of the present disclosure. The second hub device 412 may be, for example, one or more of a Wi-Fi hub, a smart-home hub, a hub of a home security/alarm system, a gateway device, a hub for a legacy security/alarm system (e.g., a hub for connecting a pre-existing security/alarm system to the network (Internet/PSTN) 410 for enabling remote control of the hub device), and/or another similar device. The second hub device 412 may comprise a processing module 486 that is operatively connected to a camera 482, a microphone 483, a speaker 484, and a communication module 485. In some embodiments, one or more of the camera 482, the microphone 483, and the speaker 484 may be omitted from the second hub device 412. The processing module 486 may comprise a processor 487, volatile memory 488, and non-volatile memory 489 that includes a smart-home hub application 490. In various embodiments, the smart-home hub application 490 may configure the processor 487 to receive sensor data 492 from the sensors 418 and/or the automation devices 420. For example, the sensor data 492 may include a current state (e.g., opened/closed for door and window sensors, motion detected for motion sensors, kitchen lights on/off, etc.) of each of the sensors 418 and/or the automation devices 420. In various embodiments, the smart-home hub application 490 may further configure the processor 487 to capture image data 493 using the camera 482 and/or audio data 494 using the microphone 483. In some embodiments, the smart-home hub application 490 may also configure the processor 487 to generate text data 495 describing the security event data 491, occupancy data, and/or the arming status of the security system, such as in the form of metadata, for example. In other embodiments, the text data 495 describing the image data 493 may be generated by a user using the client device 405, 407 associated with the second hub device 412.

The smart-home hub application 490 may further configure the processor 487 to generate the user alert 497. The user alert 497 may include the security event data 491 described herein. The user alert 497 may also, in some embodiments, include the information from the user alert 480 received from the second A/V recording and communication device 403.

In addition, the smart-home hub application 490 may configure the processor 487 to receive the image data 462, the audio data 458, the text data 459, the motion data 460, and/or the user alert 480 from the second A/V recording and communication device 403 using the communication module 485. In various embodiments, the smart-home hub application 490 may also configure the processor 487 to generate and transmit an output signal 496 that may include the image data 462, 493, the audio data 458, 494, the text data 459, 495, the motion data 460, the sensor data 492, the user alert 480, 497, and/or the arming action 498. In some of the present embodiments, the output signal 496 may be transmitted to the backend server(s) 430 using the communication module 485, and the backend server 430 may transmit the output signal 496 to the client device 405, 407 and/or the client device 404, 406 (e.g., in embodiments where the client device 404, 406 are associated with a security system in the network of security systems). In other embodiments, the output signal 496 may be transmitted directly to the client device 405, 407.

In some of the present embodiments, some or all of the sensor data 492, the image data 462, 493, the motion data 460, the audio data 458, 494, and the text data 459, 495 may be included in the security event data 491. The security event data 491 may comprise all of the data generated in response to a security event. For example, if a person breaks into a home, the security event data 491 may include the sensor data 492 generated by the door or window sensors that were breached, the image data 493 generated by the second A/V recording and communication device 403 at the time of the security event, the motion data 460 generated by the motion sensors of the sensor 418 and/or the motion sensor 449 of the second A/V recording and communication device 403, the audio data 494 recorded by the second hub device 412, and/or the text data 495 describing the security event based on the sensor data 492, the image data 462, the motion data 460, and/or the audio data 494.

In some of the present embodiments, the smart-home hub application 490 may configure the processor 487 to generate the arming action 498. In some embodiments, generating the arming action 498 may include arming/disarming the first security system 422 controlled by the second hub device 412. For example, the arming action 498 may include a disarmed, an armed stay, armed away, armed vacation, or other mode for the first security system 422. In some of the present embodiments, the second hub device 412 may generate the arming action 498 in response to receiving the arming action 498 over the user's network 409 and/or the network (Internet/PSTN) 410 (e.g., from the backend server 430 and/or the client device 405, 407). In some embodiments, the smart-home hub application 490 may configure to the processor 487 to transmit information representative of the arming action 498 to the backend server 430 and/or the client device 405, 407. For example, the information representative of the arming action 498 may include the arming status of the first security system 422 (e.g., armed away, armed stay, disarmed, etc.). The smart-home hub application 490 may also configure the processor 487 to monitor the sensors 418, the automation devices 420, and/or the second A/V recording and communication device(s) 403 according to the arming action 498.

The arming actions 498, as described herein, may include an armed stay, an armed away, an armed vacation, a disarmed mode, and/or other modes, such as custom mode of the user. In the armed stay mode, the sensors 418 inside the property (e.g., motion sensors) may be disarmed while the sensors 418 and/or the second A/V recording and communication devices 403 outside and along the perimeter of the property (e.g., door sensors, window sensors, security cameras, etc.) may be armed. In addition, during the armed stay mode, at least one of the automation devices 420 (e.g., an outdoor lighting automation system) may be activated between certain hours, such as 6:00 p.m. and 4:00 a.m. In an armed away mode, the sensors 418 inside the property (e.g., the motion sensors), the sensors 418 outside and along the perimeter of the property (e.g., door sensors, window sensors), and/or the second A/V recording and communication devices 403 (e.g., security cameras, video doorbells, spotlight cameras, etc.) may be armed. In addition, during an armed away mode, one or more of the automation devices 420 (e.g., interior and/or exterior lighting automation systems) may be activated according to an activation schedule (e.g., interior lights on from 5:00 p.m. to 9:00 p.m., exterior lights on from 6:00 p.m. to 8:00 p.m., blinds/shades opened from 12:00 p.m. to 5:00 p.m. and closed from 5:00 p.m. to 4:00 a.m., etc.) in order to provide an indication that somebody is home, even when they are not. In an armed vacation mode, the sensors 418, the automation devices 420, and/or the second A/V recording and communication devices 403 may be armed and disarmed similar to the armed away mode, however, any alerts and security events may also be sent to neighbors and/or law enforcement. In a disarmed mode, all of the sensors 418 and/or the automation devices 420 may be deactivated (except for the automation device 420 in use by the user separate from the arming mode of the second security system 424). However, in a disarmed mode, the one or more second A/V recording and communication devices 403 (e.g., security cameras, floodlight cameras, video doorbells, etc.) may be in an active state for detecting motion and/or recording activity in the field of view of the one or more second A/V recording and communication devices 403. In a custom mode, the user/owner of the second security system 422 may configure each of the sensors 418, the automation devices 420, and/or the second A/V recording and communication devices 403. For example, in a custom mode, "Keep Cool at Home," the user/owner may arm each of the door sensors and the window sensors. In addition, the user/owner may deactivate each of the motion sensors of the sensors 418 inside of the house (e.g., because the user/owner may be inside the home). In addition, the thermostat of the automation devices 420 may be set to 72 degrees (e.g., to keep cool in the heat) and the blinds/shades automation system of the automation devices 420 may be set to a closed state (e.g., to keep direct sunlight out of the house).

In further reference to FIG. 12, the sensor data 492 from the sensors 418 and/or the automation devices 420 may include, without limitation, a door open/close status from a door sensor (e.g., located at a front door, a side door, a back door, a door inside the home, etc.), a window open/close status from a window sensor, a garage door open/close status from a tilt sensor, an indoor/outdoor temperature from a thermometer or other temperature sensing device (e.g., thermostat), a carbon monoxide level from a carbon monoxide sensor, a light on/off and/or intensity status from an automated lighting system, a fire alarm status from a fire alarm, motion data from a motion sensor, glass break information from a glass break sensor, a humidity level from a humidity sensor, weather information from a home weather station, lock/unlock status of door/window/garage locks, and/or blinds/shades opened/closed status from a blind/shade automation system. The sensor data 492 may be generated in response to a sensor trigger (e.g., a door opening, a window shutting, etc.), or may be consistently and/or periodically generated to determine a status of the sensors 418 and/or the automation devices 420 and whether or not the status is indicative of a sensor trigger (e.g., a temperature above/below a threshold temperature).

With further reference to FIG. 12, the sensor trigger may activate the generation of the sensor data 492. The sensor trigger may be an event and/or action that takes place that causes the sensors 418 and/or the automation devices 420 to generate the sensor data 492. In response to sensor triggers, the sensor data 492 may be generated by the sensors 418 and/or the automation devices 420 representative of the sensor trigger. The sensor data 492 generated in response to the sensor trigger may be analyzed by the second hub device 412 to determine a proper action based on the sensor trigger, such as transmitting the security event data 491 to the backend server 430 and/or the client device 405, 407. In addition, the sensor trigger may activate the second hub device 412 to activate or alter the status of the sensors 418 (e.g., by arming the door and window sensors), the automation devices 420 (e.g., by turning on lights of the automated lighting system), and/or the second A/V recording and communication device 403 (and/or other A/V recording and communication devices at the property) (e.g., by activating the camera 463 of the second A/V recording and communication device 403 to record the image data 462).

Some non-limiting examples of sensor triggers include, for example, if the sensor 418 is a door or window sensor, the door or window opening or closing. When the door or window is closed, and then is opened, this may be a sensor trigger that results in the door or window sensor generating sensor data 492 representative of the sensor trigger, for example. If the sensor 418 is a smoke detector or other sensor type that activates based on threshold amounts, for example, the sensor trigger may be the threshold amount being reached. For example, the smoke detector may only activate when the smoke levels reach a certain threshold, and when this threshold is reached, the sensor trigger may be said to have occurred, and sensor data 492 may be generated in response. If the sensor 418 is a thermometer, for example, a threshold temperature being reached may be the sensor trigger. In another example, if the sensor 418 is a motion sensor, the sensor trigger may be a threshold amount of detected motion.

In some of the present embodiments, the second hub device 412 may analyze the sensor data 492, the image data 462, 493, the motion data 462, and/or the audio data 458, 494 to determine occupancy data for the second property. For example, the sensor data 492 may include motion data from motion sensors of the sensors 418 interior to the property and/or data indicative of a light switch interior to the home being turned on/off within the last 10 seconds, 20 seconds, etc. from a lighting automation system of the automation devices 420, the image data 462, 493 may include the presence of person(s) (e.g., based on an analysis using computer vision), the motion data 462 may include an indication of the presence of persons interior to the home (e.g., in embodiments where one of the second A/V recording and communication devices 403 is indoors), and/or the audio data 458, 494 may include voices, which may provide an indication of the presence of person(s). As a result, the second hub device 412 may analyze the sensor data 492, the image data 462, 493, the motion data 462, and/or the audio data 458, 494 to determine the occupancy data. In some of the present embodiments, the occupancy data may be a binary determination, such as occupied and not occupied. In addition, in some embodiments, the occupancy data may also include an estimate of how many people and/or animals are present and/or the location of the people and/or animals at the property (e.g., upstairs, downstairs, in the living room, etc.).

In alternative embodiments, the sensor data 492 (including data representative of the sensor trigger) may be received by the second A/V recording and communication device 403 rather than, or in addition to, the second hub device 412. For example, some environments may not have a smart-home hub device. In these environments, the second A/V recording and communication device 403 may perform at least some of the functions of the second hub device 412 described herein, including receiving, processing, and/or transmitting the sensor data 492. For example, the sensors 418 and/or the automation devices 420 may be in communication with the second A/V recording and communication device 403, rather than, or in addition to, the second hub device 412.

FIG. 13 is a functional block diagram illustrating one embodiment of the backend server(s) 430 according to various aspects of the present disclosure. The backend server(s) 430 may comprise a processing module 500 including a processor 502, volatile memory 504, a network interface 520, and non-volatile memory 506. The network interface 520 may allow the backend server(s) 430 to access and communicate with devices connected to the network (Internet/PSTN) 410 (e.g., the first A/V recording and communication device 402, the second A/V recording and communication device 403, the first hub device 411, the second hub device 412, and/or the client devices 404, 405, 406, 407). The non-volatile memory 506 may include a server application 508 that configures the processor 502 to receive the security event data 473, 491, the user alerts 479, 481, 480, 497, and/or the arming actions 479, 498 from the first A/V recording and communication device 402, the second A/V recording and communication device 403, the first hub device 411, the second hub device 412, and/or the client devices 404, 405, 406, 407 (e.g., in the output signals 447, 478, 461, 496).

In various embodiments, and as described below, in response to a security event detected by the first security system 422 (e.g., by the first hub device 411), the processor 502 of the backend server 430 may receive the security event data 473 from the first security system 422; analyze the security event data 473 to determine a security event procedure 499 for the second security system 424 (e.g., the security system controlled by the second hub device 412) based on the security event data 473; when the security event procedure 499 for the second security system 424 includes an automatic arming action (e.g., the arming action 479 that does not require input from a user of the client device 405, 407): transmit the automatic arming action to the second security system 424; when the security event procedure 499 for the second security system 424 includes an arming action request (e.g., the arming action 498 is determined in response to an input from the user of the client device 405, 407): generate and transmit, to the client device 405, 407 associated with the second security system 424 (e.g., the security system controlled by the second hub device 412), the arming action request; in response to transmitting the arming action request, receive from the client device 405, 407, the arming action 498; and transmit, to the second security system 424 (e.g., the second hub device 412), the arming action 498.

In further reference to FIG. 13, the non-volatile memory 506 may also include source identifying data 510 that may be used to identify the first A/V recording and communication device 402, the second A/V recording and communication device 403, the first hub device 411, the second hub device 412, and/or the client devices 404, 405, 406, 407. In addition, the source identifying data 410 may be used by the processor 502 of the backend server 430 to determine the client devices 404, 405, 406, 407 associated with the first A/V recording and communication device 402, the second A/V recording and communication device 403, the first hub device 411, and/or the second hub device 412. In some of the present embodiments, the source identifying data 510 may be used by the processor 502 of the backend server 430 to determine which other security systems (e.g., smart-home hub devices, client devices, etc.) should be notified when a security event is detected by the first hub device 411 and/or the second hub device 412.

For example, the security system controlled by the first hub device 411 may be part of a network of security systems, and in response to a security event being detected by the first hub device 411, the source identifying data 510 may be used to determine which other smart-home hub devices (e.g., the second hub device 412) are included in the network of security systems that should be notified. This determination may be made based on proximity, in some embodiments. In such embodiments, the location data of the security systems may be used to determine which other smart-home hub devices to notify of the security event. In other embodiments, the determination of which other security systems to notify may be made based on a determination of which security systems have opted-in to the network. For example, a user/owner of a security system may opt-in to receive notifications of security events and/or set a security event procedure 499 for any security events that are detected by any of the security systems in the network(s) of security systems that the security system of the user/owner is included.

In some embodiments, the server application 508 may further configure the processor 502 to generate and transmit a report signal (not shown) to a third-party client device (not shown), which may be associated with a law enforcement agency, for example. The report signal sent to the law enforcement agency may include information indicating an approximate location of where the security event data 473, 491 was captured, which may assist the law enforcement agency with apprehending the criminal perpetrator from the security event data 473, 491.

With further reference to FIG. 13, the security event procedures 499 may include the processes and determinations that the processor 502 of the backend server 430 makes in response to a security event. The security event procedures 499 may be unique to each of the security systems (e.g., each of the hub devices and associated sensors, automation devices, and A/V recording and communication devices). For example, some of the security systems may have automatic arming actions, as described herein, where the security event procedure 499 includes determining the arming action 479, 498 based on the security event data 473, 491, the occupancy data, and/or the arming status of the security system without requiring input from the user/owner of the security system. In another example, some of the security systems may require arming action requests be made to the user/owner of the security system (e.g., by transmitting a request for the arming action 479, 498 to a client device associated with the security system), and the arming actions 479, 498 may be received in response and transmitted to the smart-home hub devices of the security systems.

Figure 20:
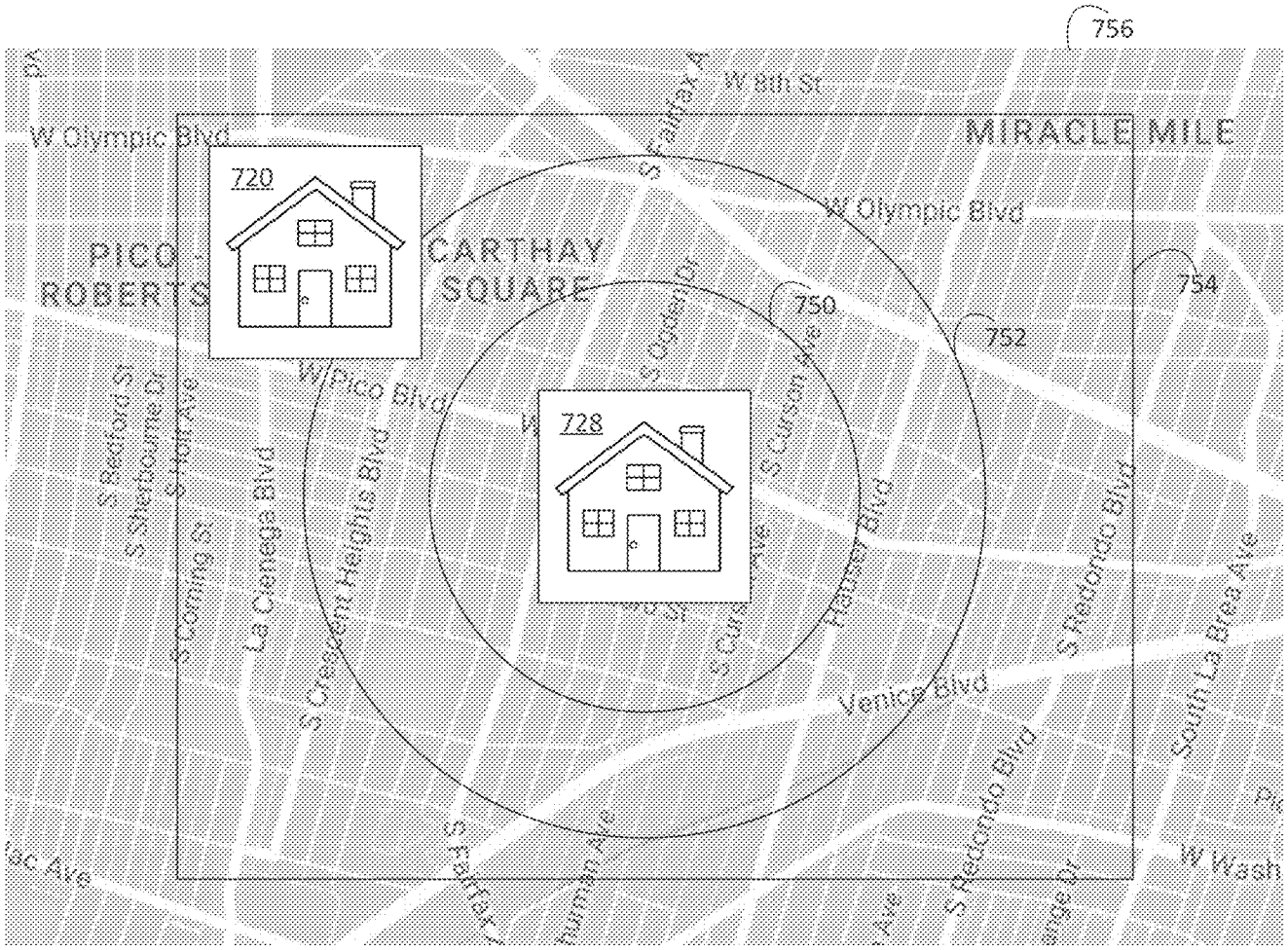
FIG. 20 is a top plan view of a neighborhood with a security system according to various aspects of the present disclosure.

In addition, the security event procedures 499 may differ for each of the security systems based on the threat level of the security event, the proximity of the security system experiencing the security event to the security system the security event procedure 499 relates to (e.g., the threat level of the security event detected by the first hub device 411 and/or the proximity of the first hub device 411 to the second hub device 412), and/or the clock data (e.g., the time of day). With reference to FIG. 20, if a security event is detected by the first hub device 411 located at the first home 728, the processor 502 of the backend server 430 may analyze the threat level of the security event (e.g., by analyzing the security event data 473) to determine the security event procedure 499 for the second hub device 412 located at the second home 720. For example, if the threat level is low, the smart-home hub devices located within the first proximity region 750 may be notified and/or receive an arming action based on the security event procedure 499, if the threat level is medium, the smart-home hub devices located within the second proximity region 752 (e.g., where the second proximity region 752 encompasses and includes the first proximity region 750) may be notified and/or receive an arming action based on the security event procedure 499, and if the threat level is high, the smart-home hub devices located within the third proximity region 754 (e.g., where the third proximity region 754 encompasses and includes the first proximity region 750 and the second proximity region 752) may be notified and/or receive an arming action based on the security event procedure 499. As such, in the above example, if the security event is detected by the first hub device 411 located at the first home 728, and the threat level is determined to be medium or high, the second hub device 412 may be notified and/or receive the arming action 498 based on the security event procedure 499. In addition, depending on whether the threat level is medium or high, the security event procedure 499 for the second hub device 412 may differ. For example, if the threat level is medium, the security event procedure 499 may include an arming action request be transmitted to the client device 405, 407 associated with the second hub device 412. If the threat level is high, the security event procedure 499 may include an automatic arming action for transmitting the arming action 498 to the second hub device 412 without requiring input from the user.

In another example, the proximity of the security systems may be used. For example, with respect to FIG. 20, the security event procedure 499 for the first security system 422 located at the first home 728 may include to receive notifications (e.g., user alerts 480, 497) and/or the arming actions 479 in response to security events detected by security systems within the first proximity region 750, the second proximity region 752 (which may include the second hub device 412 at the second home 720), and/or the third proximity region 754 (which may also include the second hub device 412 at the second home 720). In addition, similar to that described above, the security event procedure 499 may be different for each of the proximity regions (e.g., the first security system 422 may receive notifications only for security events detected by security systems outside of the second proximity region 752 but within the third proximity region 754, arming action requests for security events detected by security systems outside of the first proximity region 750 but within the second proximity region 752, and/or automatic arming actions for security events detected by security systems within the first proximity region 750). In some of the present embodiments, the proximity and the threat level may be used together to determine the security event procedures 499 for each of the security systems.

In some of the present embodiments, in addition to, or in lieu of, the threat level and/or the proximity, clock data may be used by the security systems. For example, with respect to FIG. 20, the security event procedure 499 for the first security system 422 located at the first home 728 may include to receive notifications (e.g., user alerts 480, 497) and/or the arming actions 479 in response to security events detected by security systems within the first proximity region 750, the second proximity region 752 (which may include the second hub device 412 at the second home 720), and/or the third proximity region 754 (which may also include the second hub device 412 at the second home 720) based on the clock data and/or proximity. In addition, similar to that described above, the security event procedure 499 may be different for each of the proximity regions, and within each of the proximity regions may be different dependent on the clock data (e.g., the time of day). For example, the first security system 422 may receive notifications only for security events detected by security systems outside of the second proximity region 752 but within the third proximity region 754. In such an example, the client device 404, 406 may receive the notifications in real time if the security event takes place during a predetermined time period (e.g., between 8:00 a.m. and 5:00 p.m.), and may receive the notification at a predetermined time (e.g., 8:00 a.m. for security events occurring after 5:00 p.m.) if the security event occurs outside of the predetermined time period (e.g., if the security event occurs between 5:00 p.m.

and 8:00 a.m.). In another example, the second security system 422 may receive arming action requests for security events detected by security systems outside of the first proximity region 750 but within the second proximity region 752 within a predetermined time period (e.g., 8:00 a.m. to 5:00 p.m.) but may receive automatic arming actions if the security events take place outside of the predetermined time period and/or within another predetermined time period (e.g., 5:00 p.m. to 8:00 a.m.). In such an example, between 8:00 a.m. and 5:00 p.m. the client device 404, 406 may receive the arming action requests in response to a security event detected by security systems outside of the first proximity region 750 but within the second proximity region 752. However, between 5:00 p.m. and 8:00 a.m., the first hub device 411 may receive the automatic arming action in response to security events detected by security systems outside of the first proximity region 750 but within the second proximity region 752. For another example, the first security system 422 may receive automatic arming actions for security events detected by security systems within the first proximity region 750 at any time of day, but a notification may only be sent to the client device 404, 406 during a predetermined time period (e.g., 8:00 a.m. to 5:00 p.m.). In some of the present embodiments, the proximity, the threat level, and/or the clock data may be used together to determine the security event procedures 499 for each of the security systems.

In some of the present embodiments, the server application 508 may configure the processor 502 of the backend server 430 to determine the occupancy data of the properties where the security systems are located. For example, similar to that described above with respect to the first hub device 411 and the second hub device 412, the backend server 430 may analyze the security event data 473, 491 to determine the occupancy data. In some embodiments, the backend server 430 may query the first hub device 411 and/or the second hub device 412 periodically to determine the occupancy data.

In some of the present embodiments, the security event may be verified by the backend server 430 prior to executing the security event procedures 499 for other security systems in the network of security systems. In some embodiments, the security events may be verified if a user of the security system where the security event was detected performs an action(s) in response to receiving a notification (e.g., user alert) of the security event. For example, if the user of the client device 404, 406 in response to receiving the user alert 479, 481 from the first security system 422 activates an alarm, alerts law enforcement, contacts a security monitoring service, changes the arming action of the first security system 422 (e.g., by executing the arming action 479), and/or performs another action, the security event may be determined to be verified. In any embodiment, the security event may be verified by the security monitoring service, such as where the first security system 422 is configured to transmit the security event data 473 to the security monitoring service. In such embodiments, the security monitoring service may review the security event data 473 and verify the security event (e.g., by alerting law enforcement, sounding an alarm, notifying the user/owner of the first security system 422, providing a verification input, and/or another action). In embodiments where the source (e.g., person, animal, object (e.g., a gun)) of the security event is captured in the image data (e.g., the image data 448, 475 of the first security system), the image data may be analyzed using facial recognition, facial detection, object detection, object recognition, or other biometric analysis, as described above, to determine if the person, animal, and/or object is a threat. To determine if the person, animal, and/or object is a threat, the person, animal, and/or object may be compared to a database of suspicious person (e.g., a police database), a database of dangerous animals, and/or a database of suspicious objects (e.g., guns and other weapons), respectively, for example. The determination of a threat may provide verification of the security event.

Figure 14:
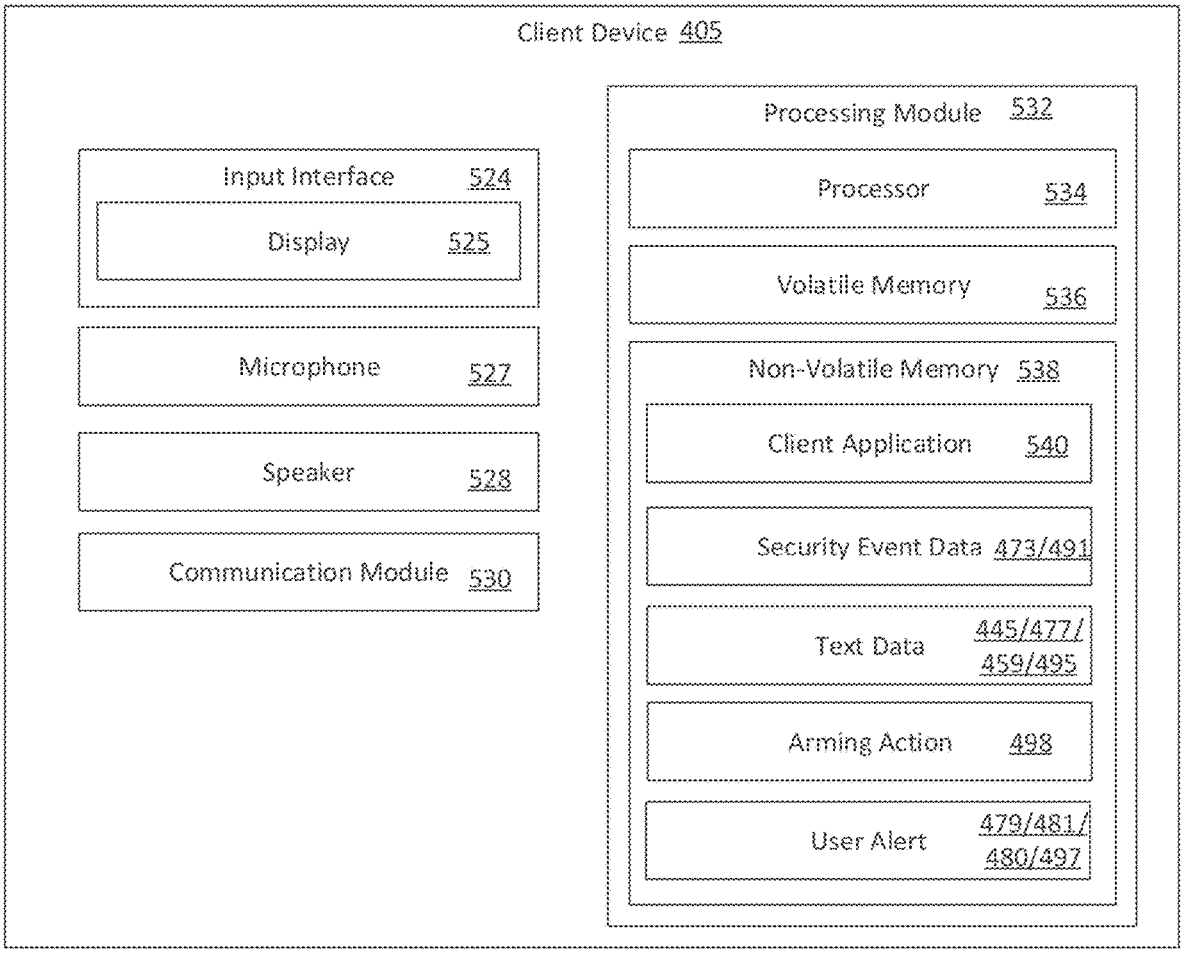
FIG. 14 is a functional block diagram illustrating one embodiment of a client device according to various aspects of the present disclosure.

Now referring to FIG. 14, FIG. 14 is a functional block diagram illustrating one embodiment of a client device 405 according to various aspects of the present disclosure. The client device 405 may comprise a processing module 532 that is operatively connected to an input interface 524, a microphone 527, a speaker 528, and a communication module 530. The client device 405 may further comprise a camera (not shown) operatively connected to the processing module 532. The processing module 532 may comprise a processor 534, volatile memory 536, and non-volatile memory 538 that includes a client application 540. In various embodiments, the client application 540 may configure the processor 534 to receive input(s) to the input interface 524 (e.g., inputs of the arming actions 498). In addition, the client application 540 may configure the processor 534 to transmit the arming actions 498 to the second hub device 412, the second A/V recording and communication device 403, and/or the backend server(s) 430 using the communication module 530. The client application 540 may configure the processor 534 to receive (in some embodiments, via the backend server 430) the security event data 473, 491 and/or the arming action requests from the first hub device 411, the second hub device 412, the first A/V recording and communication device 402 (e.g., the image data 448 and/or the motion data 446), and/or the second A/V recording and communication device 403 (e.g., the image data 462 and/or the motion data 460).

With further reference to FIG. 14, the input interface 524 may include a display 525. The display 525 may include a touchscreen, such that the user of the client device 405 can provide inputs directly to the display 525 (e.g., the arming action 498). In some embodiments, the client device 405 may not include a touchscreen. In such embodiments, the user may provide an input using any input device, such as, without limitation, a mouse, a trackball, a touchpad, a joystick, a pointing stick, a stylus, etc.

In the illustrated embodiment of FIGS. 9-14, the various components including (but not limited to) the processing modules 439, 453, 468, 486, 500, 532 and the communication modules 438, 452, 467, 485, 530, and the network interface 520 are represented by separate boxes. The graphical representations depicted in each of FIGS. 9-14 are, however, merely examples, and are not intended to indicate that any of the various components of the first A/V recording and communication device 402, the second A/V recording and communication device 403, the first hub device 411, the second hub device 412, the client device 405, and/or the backend server(s) 430 are necessarily physically separate from one another, although in some embodiments they might be. In other embodiments, however, the structure and/or functionality of any or all of the components of each of the first A/V recording and communication device, the second A/V recording and communication device 403, the first hub device 411, the second hub device 412, the backend server 430, and/or the client device 405 may be combined. As an example, the structure and/or functionality of any or all of the components of the first A/V recording and communication device 402 may be combined. In addition, in some embodiments the communication module 438 may include its own processor, volatile memory, and/or non-volatile memory. As another example, the structure and/or functionality of any or all of the components of the hub device 411 may be combined. In addition, in some embodiments the communication module 467 may include its own processor, volatile memory, and/or non-volatile memory.

Figure 15:
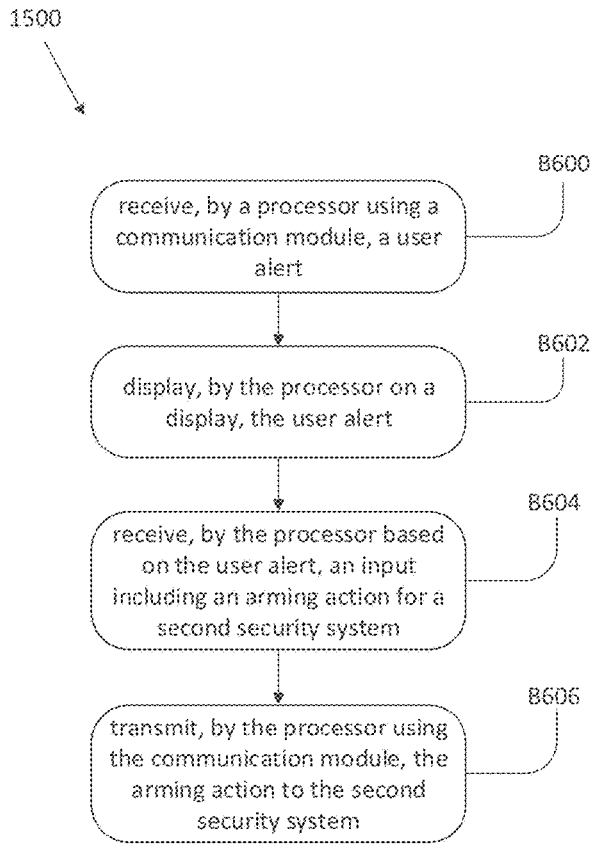
FIGS. 15-18 are flowcharts illustrating processes for arming security systems based on communications among a network of security systems according to various aspects of the present disclosure.

Now referring to FIG. 15, FIG. 15 is a flowchart illustrating a process for arming security systems based on communications among a network of security systems according to various aspects of the present disclosure. The process 1500, at block B600, receives, by a processor using a communication module, a user alert. For example, the processor 534 of the client device 405 using the communication module 530 may receive the user alert 479 generated by the first A/V recording and communication device 402 and/or the user alert 481 generated by the first hub device 411. In some of the present embodiments, the client device 405 may receive the user alert 479, 481 from the backend server 430. For example, the user alert 479 and/or the user alert 481 may be received in response to the backend server 430 analyzing the security event data 473 in response to a security event detected by the first hub device 411 and determining, based on the security event procedures 499 for the second hub device 412, that the client device 405 associated with the second hub device 412 should receive the user alert 479 and/or the user alert 481 (e.g., based on the proximity of the second hub device 412 to the first hub device 411, based on the threat level of the security event, based on the clock data, and/or based on the first security system 422 and the second security system 424 belonging to a network of security systems).

The process 1500, at block B602, displays, by the processor on a display, the user alert. For example, the processor 534 of the client device 405 may display the user alert 479 and/or the user alert 481 on the display 525 of the client device 405. The user alert 479, 481, as described above, may include any of the security event data 473 generated by the first hub device 411 and/or the first A/V recording and communication device 402 including the sensor data 474, the image data 448, 475 (e.g., video data captured by the camera 434 of the first A/V recording and communication device 402 at the time of the security event), the motion data 446, the audio data 444, 476, and/or the text data 445, 477. For example, the user alert 479, 481 may include a description of the type of security alert detected by the first security system 422 (e.g., the first hub device 411 and/or the first A/V recording and communication device 402). In addition, the user alert 479, 481 may include an arming action request (e.g., a request for the arming action 498). The arming action request may include a list of the arming actions 498 available to the user of the client device 405 (e.g., arm away, arm stay, arm vacation, disarm, etc.).

In addition, in some of the present embodiments, the arming action request may include occupancy data of the second property where the second hub device 412 is located. In such an example, the sensor data 492 from the sensors 418 (e.g., the motion data from motion sensors), the motion data 460 from the second A/V recording and communication device 403, and/or the audio data 458, 494 may be used (e.g., by the second hub device 412 and/or the backend server 430) to determine the occupancy data of the second property where the second security system 424 (e.g., the second hub device 412) is installed. In some of the present embodiments, the user alert 479, 481 may also include the arming status of the second security system 424 (e.g., armed away, armed stay, disarmed, etc.). In embodiments where the user alert 479, 481 includes the occupancy data and/or the arming status of the second security system 424, the arming action request may include at least one recommended arming action based on the occupancy data of the second property where the second security system 424 is located and/or the arming status of the second security system 424. For example, if, based on the occupancy data, it is determined that a person is present within the property, the arming action 498 recommendation may include an armed stay mode (or another mode configured for the presence of persons within the property). In another example, if, based on the arming status, it is determined that the second security system 424 is in armed vacation mode, the arming action 498 recommendation may include switching to an armed away mode (which, in some embodiments, may be a more secure setting).

In addition, in some embodiments, the arming action request may include additional arming actions 498 such as activating or adjusting the settings of one or more of the automation devices 420 installed at the second property (e.g., turning on the indoor and/or outdoor lights of a lighting automation system) and/or activating one or more of the A/V recording and communication devices installed at the second property (e.g., activating the second A/V recording and communication device 403 to record the image data 462, activating other security cameras to record image data, and/or turning on floodlights and/or spotlights of A/V recording and communication devices that include floodlights and/or spotlights).

In some of the present embodiments, the user alert 479, 481 displayed on the client device 405 may include the video and/or images recorded by the first A/V recording and communication device 402 during the security event. In other embodiments, the user alert 479, 481 may include live streaming video of the first A/V recording and communication device 402 and/or other A/V recording and communication devices that are part of the first security system 422. Viewing the video and/or images may help the user of the client device 405 determine if the security event is a threat and/or what actions the user of the client device 405 should take. In other embodiments, the image data 462, 493 from the second security system 424 may be streamed to the client device 405 along with the user alert 479, 481. This way, the user of the client device 405 may view his or her property where the second security system 424 is located to determine if his or her property is safe and secure.

With further reference to FIG. 15, the process 1500, at block B604, receives, by the processor based on the user alert, an input including an arming action for a second security system. For example, the processor 534 of the client device 405 may receive, based on the user alert 479, 481, an input including the arming action 498 for the second security system 424 (e.g., the security system controlled by the second hub device 412) installed at the second property. The user of the client device 405 may select the arming action 498 for activating the second security system 424.

The process 1500, at block B606, transmits, by the processor using the communication module, the arming action to the second security system. For example, the processor 534 of the client device 405 using the communication module 530 may transmit the arming action 498 to the second hub device 412 (and/or the second A/V recording and communication device 403) for arming the second security system 424. The arming action 498 may be transmitted to the backend server 430, and the backend server 430 may transmit (or forward) the arming action to the second hub device 412 (and/or the second A/V recording and communication device 403). In other embodiments, the arming action 498 may be transmitted directly to the second hub device 412 and/or the second A/V recording and communication device 403.

Figure 16:
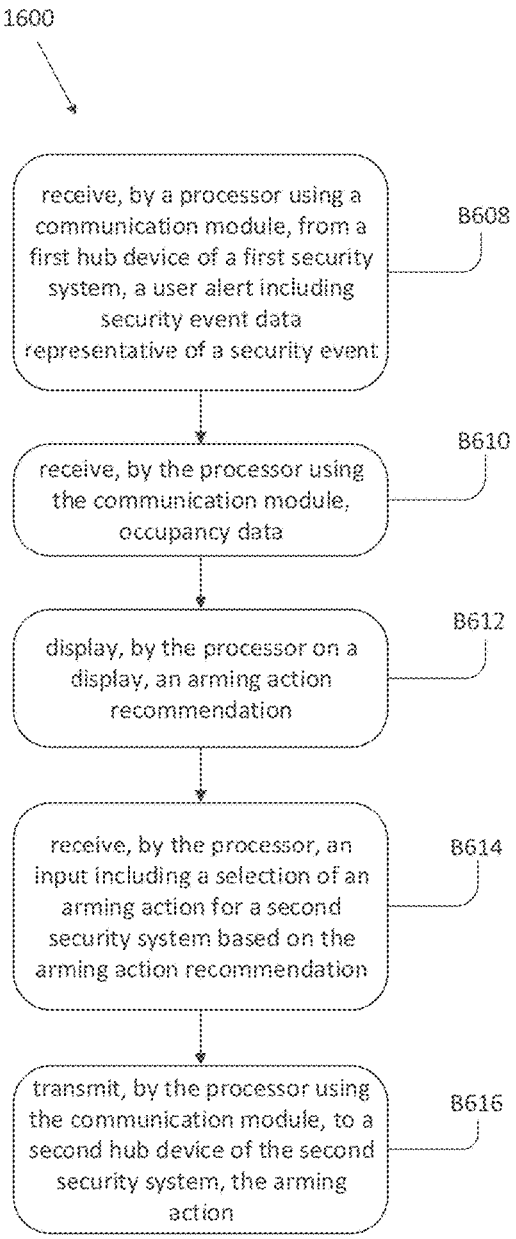

Now referring to FIG. 16, FIG. 16 is a flowchart illustrating a process for arming security systems based on communications among a network of security systems according to various aspects of the present disclosure. The process 1600, at block B608, receives, by a processor using a communication module, from a first hub device of a first security system, a user alert including security event data representative of a security event. For example, in response to a security event at the first property including the first security system 422, the processor 534 of the client device 405, using the communication module 530, may receive the user alert 479, 481 from the first hub device 411 (in some embodiments, via the backend server 430), where the user alert 479, 481 may include the security event data 473 representative of the security event.

For example, the security event data 473 included in the user alert 479, 481 may include the sensor data 474 generated by the sensors 414 and/or the automation devices 418, the image data 448, 475 generated by the first A/V recording and communication device 402 and/or the first hub device 411, the motion data 446 generated by the first A/V recording and communication device 402 and/or a motion sensor of the sensors 414, the audio data 444, 476 generated by the first A/V recording and communication device 402 and/or the first hub device 411, and/or the text data 445, 477 generated by the A/V recording and communication device, the first hub device 411, the backend server 430, and/or a user of the client device 404, 406 associated with the first security system 422. The user alert 479, 481 may display on the display 525 of the client device 405 as a notification, such as a push-notification, for interaction by the user of the client device 405. For example, the user alert 479, 481 may display as the text data 445, 477 describing the security event based on the security event data 473 (e.g., "potential break in at 742 Evergreen Terrace" or "suspicious activity detected at 742 Evergreen Terrace"). For example, in some of the present embodiments, the backend server 430 may receive the security event data 473 from the first A/V recording and communication device 402 and/or the first hub device 411 and analyze the security event data 473 to determine the information to include in the user alert 479, 481 for transmitting to the client device 405. The analysis may be based on the security event procedures 499 for the second security system 424 (e.g., the second hub device 412 and/or the second A/V recording and communication device 403) associated with the client device 405.

The process 1600, at block B610, receives, by the processor using the communication module, occupancy data. For example, the processor 534 of the client device 405, using the communication module 534, may receive the occupancy data pertaining to the second security system 424. In some embodiments, the client device 405 may receive the occupancy data in response to querying the backend server 430 and/or the second hub device 412. In other embodiments, the occupancy data may be retrieved by the backend server 430 and transmitted to the client device 405 in response to the security event (e.g., as part of the security event procedures 499). For example, in such an embodiment, the backend server 430 may receive and/or determine the occupancy data periodically (e.g., without limitation, every 10 seconds, every 30 seconds, every minute, during each check-in by the second hub device 412, etc.). In any embodiment, the occupancy data may be based on the sensor data 492, the audio data 448, 494, the image data 462, 493, and/or the motion data 460. For example, if the sensors 418 include at least one motion sensor interior to the property where the second hub device 412 (and thus the second security system 424) is located, the sensor data 492 may include detected motion by the motion sensors which may be indicative of the property being occupied. In another example, the audio data 458, 494 may be analyzed to determine if voices are heard, which may be indicative of the property being occupied. As another example, the motion data 460 of the second A/V recording and communication device 403 (and/or other A/V recording and communication devices) may be analyzed and, dependent on the location of the second A/V recording and communication device 403 (e.g., inside or outside), the motion data 460 may be indicative of the property being occupied (as mentioned above, in some embodiments, the motion data 460 may be based on the image data 462 generated by the second A/V recording and communication device 403). For another example, the image data 493 generated by the second hub device 412 (e.g., when the second hub device 412 is located interior to the property), may be analyzed to determine if the property is occupied. In some of the present embodiments, as described above, the occupancy data may be a binary determination, such as occupied and not occupied. In addition, in some embodiments, the occupancy data may also include an estimate of how many people and/or animals are present and/or the location of the people and/or animals at the property (e.g., upstairs, downstairs, in the living room, etc.).

In some of the present embodiments, the occupancy data may be used by the backend server 430 and/or the client device 405 to determine the arming actions 498 to recommend (e.g., the arming action recommendation) for the second security system 424. For example, as described above, if the occupancy data is indicative of a person(s) being present within the property, the arming actions 498 recommended may include an armed stay mode. For example, the armed stay mode may include the door and window sensors of the sensors 418 being activated and/or the interior motion sensors of the sensors 418 being disabled (e.g., the motion data generated by the motion sensors interior to the property may be ignored). By analyzing the occupancy data to make the arming action recommendations, the arming actions 498 presented to the user of the client device 405 may be more useful (e.g., may avoid unnecessary alarms, such as where an armed away mode is selected while person(s) are present within the home), and also may enable the user to make decisions more quickly (e.g., because the user may not be required to analyze a long list of potential arming actions 498), thereby securing his or her property sooner.

Figure 21:
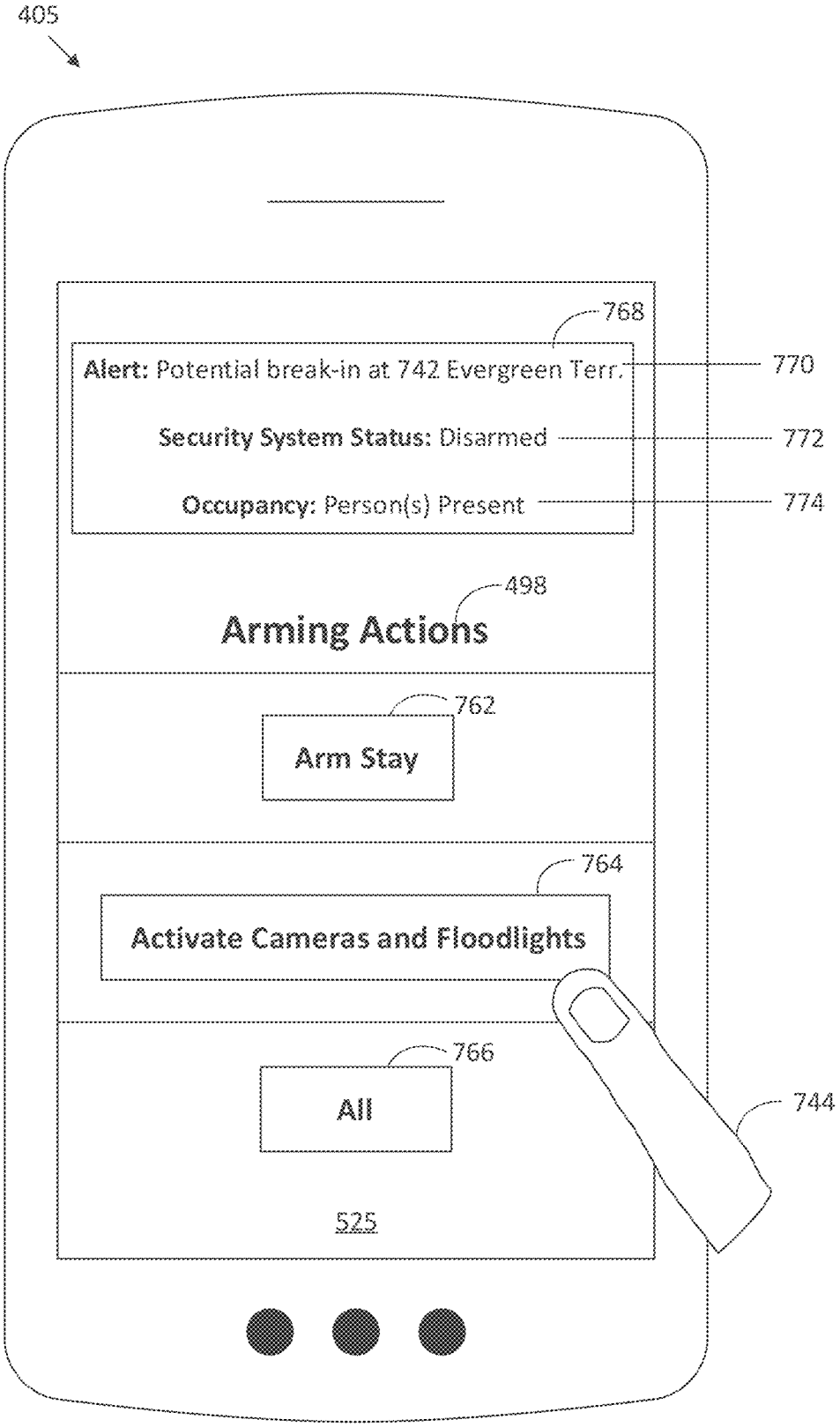
FIG. 21 is a screenshot of a graphical user interface (GUI) illustrating aspects of a process for arming security systems based on communications among a network of security systems according to various aspects of the present disclosure.

The process 1600, at block B612, displays, by the processor on a display, an arming action recommendation. For example, the processor 534 of the client device 405 may display the arming action(s) 498 that is recommended on the display 525. The arming action 498 may be recommended based on the security event procedures 499, the arming status of the second security system 424, and/or the occupancy data, as described above. For example, in response to the security event being detected by the first security system 422, the backend server 430 may analyze the security event procedures 499, the arming status, and/or the occupancy data of the second security system 424 to determine the arming action recommendation. In response to receiving the arming action recommendation, the client device 405 may display the arming actions 498 that are recommended on the display 525 (e.g., as illustrated in FIG. 21).

In some of the present embodiments, the backend server 430 may analyze security event data 473 in view of the security event procedures 499 to determine the arming action recommendation and may transmit the arming action recommendation to the client device 405. In such embodiments, the client device 405 may analyze the occupancy data to determine which of the arming actions 498 received from the backend server 430 should be displayed as the arming action recommendation on the display 525. In any of the embodiments, as illustrated in FIG. 21, the arming actions 498 (e.g., the arming action recommendation) may be displayed in addition to the occupancy data 774, which may aid the user of the client device 405 in making the proper selection of the arming action 498. In FIG. 21, because person(s) may be present, the arming action 498 recommended may include an armed stay mode 762.

The process 1600, at block B614, receives, by the processor, an input including a selection of an arming action for a second security system based on the arming action recommendation. For example, the processor 534 of the client device 405 may receive a selection of the arming action 498 for the second security system 424 based on the arming action recommendation displayed on the display 525. In some of the present embodiments, because the arming action recommendation may be based on the security event procedures 499 (which may be configured by the user of the second security system 424), the arming status, and/or the occupancy data, the user of the client device 405 may be more likely to select the arming action 498 based on the arming action recommendation (which may include one or more arming actions 498).

The process 1600, at block B616, transmits, by the processor using the communication module, to a second hub device of the second security system, the arming action. For example, the processor 534 of the client device 405, using the communication module 530, may transmit the arming action 498 selected by the user of the client device 405 to the second hub device 412 of the second security system 424 (in some embodiments, via the backend server 430). In response to receiving the arming action 498 (e.g., by the second hub device 412 and/or the second A/V recording and communication device 403), the sensors 418, the automation devices 420, and/or the second A/V recording and communication device(s) 403 of the second security system 424 may be armed according to the arming action 498 (e.g., according to the configuration of the second security system 424 for the arming action 498).

The process 1600 of FIG. 16 may be implemented in a variety of embodiments, including those discussed below. However, the below-detailed embodiments are not intended to be limiting, and are provided merely as example embodiments of the present disclosure. Other embodiments similar to those outlined herein may also fall within the scope of the present disclosure.

Figure 19:
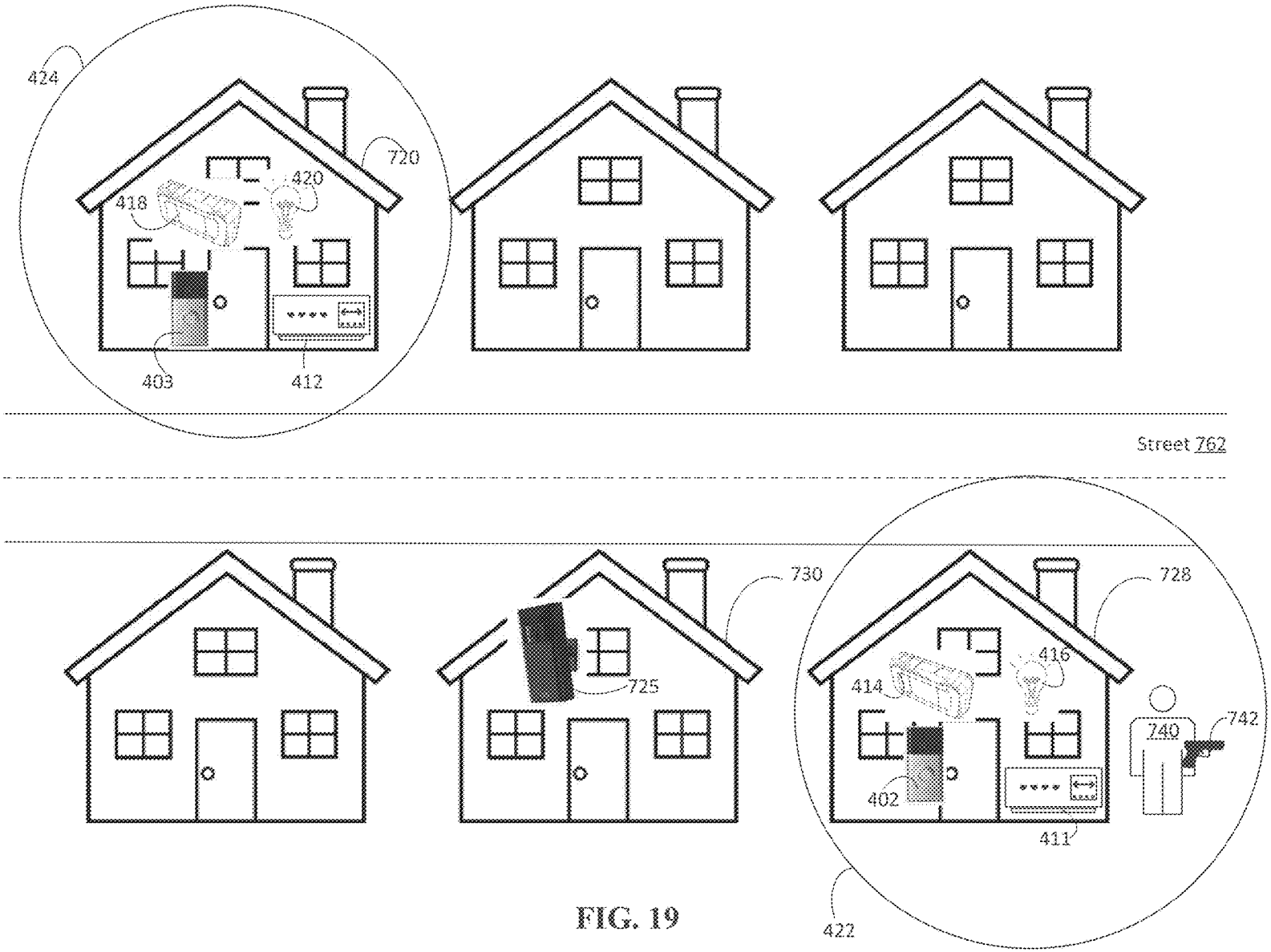
FIG. 19 is an example environment for security systems according to one embodiment of the present disclosure.

With reference to FIGS. 19-21, in an example scenario, a burglar 740 (who may have a weapon 742) triggers a security event at the property where the first security system 422 is located. In such a scenario, the first security system 422 and the second security system 424 may be part of a network of security systems (e.g., each of the security systems installed on the street 762, each of the security systems in a neighborhood, each of the security systems in a predetermined proximity to the security system where the security event is detected (e.g., security systems within the first proximity region 750, the second proximity region 752, etc.), each of the security systems that are opted into the network, etc.).

In response to the burglar 740 breaking into the first home 728, the first hub device 411 and/or the first A/V recording and communication device 402 may transmit the user alert 479, 498 including the security event data 473 representative of the security event triggered by the burglar 740 to the client device 405. In some of the present embodiments, the backend server 430 may receive the user alert 479, 481 and analyze the security event data 473 and/or the security event procedures 499 to determine which other security systems (e.g., the second security system 424) should be notified of the security event. For example, the backend server 430 may determine the network(s) of security systems in which the first security system 422 is included, and which of those security systems in the determined network should receive the user alerts 479, 481 (e.g., the user of the second security system 424 may desire to receive notification of security events from the first security system 422 but the user of the first security system 422 may not desire to receive notification from the second security system 424). In addition, in some of the present embodiments, as described above, the backend server 430 may determine a threat level of the security event based on the analysis of the security event data 473, and based on the threat level, may determine which network(s) of security systems to notify. For example, because the burglar 740 may have the weapon 742 (e.g., as determined using object recognition, or other computer vision, as described above), the threat level may be high. As a result, the third proximity region 754 may be determined to be the network of security systems that should be notified, which may include the second security system 424 located at the second home 720. By contrast, if the burglar 740 was only loitering on the property (e.g., no perimeter breach was detected and/or no weapon 742 was detected), the threat level may be low, and the determination may be that only the security systems in the first proximity region 750 should be notified, which may not include the second security system 424.

In some of the present embodiments, the backend server 430 may also analyze the image data, motion data, sensor data, etc. of other security systems in the network of security systems. For example, the backend server 430 may determine other security systems and/or A/V recording and communication devices installed at homes in close proximity to the first security system 422 (e.g., using location data), such as the A/V recording and communication device 725 installed at the third home 730. For example, the backend server 430 may analyze the image data generated by the A/V recording and communication device 725 to determine if suspicious activity is detected. In an example where the third home 730 also includes a smart-home hub device, the image data, motion data, sensor data, etc. may be analyzed to determine if there is any indication of suspicious activity. In embodiments where it is determined that other security systems and/or A/V recording and communication devices include an indication of suspicious activity, this indication may also be transmitted to the client device 405. For example, the user alert 479, 481 may recite, "Potential break in at 742 Evergreen Terrace at 10:30 a.m. and suspicious person detected at 744 Evergreen Terrace at 10:20 a.m." In such an example, computer vision, as described above, may be used to determine if the suspicious person is the same person that broke into the home at 742 Evergreen Terrace, for example. By providing the user of the client device 405 with the information from surrounding homes, the user of the client device 405 may be more likely to view the threat as requiring action because the information may provide an indication that the potential threat may be moving from house to house.

In response to the determination that the user of the second security system 424 should be notified of the security event, the client device 405 may receive the user alert 479, 481 (at block B608). In addition to the user alert 479, 481, the client device 405 may receive the occupancy data of the second home 720 from the second security system 424 (e.g., from the backend server 430 and/or the second hub device 412) (at block B610).

In response to receiving the user alert 479, 481, and/or the occupancy data, the client device 405 may display the arming action(s) 498 available to the user of the client device 405 for arming the second security system 424 (at block B612). The arming action(s) 498 may include recommended arming actions generated by the backend server 430 and received by the backend server 430, for example. As described above, the arming action recommendation may be based on the occupancy data, the arming status, the security event data 473, and/or the security event procedures 499 for the second security system 424. In some of the present embodiments, as described herein, the arming actions 498 may include, in addition to an option to arm the security system (e.g., to an armed stay mode, an armed away mode, etc., using the arming action activation button 762, for example), the option to activate the automation devices 420 and/or the second A/V recording and communication device(s) 403 (e.g., using the additional activation button 764 in FIG. 21). In some embodiments, the user may be able select the arming actions 498 and the additional activation of the automation device(s) 420, and/or the second A/V recording and communication device(s) 403 using the activate all button 766, for example.

In some of the present embodiments, the display of the arming actions 498 may also include security event information 768 representative of the security event and/or the second security system 424 associated with the client device 405. The security event information 768 may be based on the security event data 473, the occupancy data, and/or the arming status of the second security system 424 (e.g., based on the most recent arming action 498 implemented by the second security system 424). For example, the security event information 768 may include a description of the security event 770, which may be based on the text data 445, 477. In addition, the security event information 768 may include an arming status indicator 772 indicative of the arming status of the second security system 424. In some embodiments, the security event information 768 may include an occupancy indicator 774, which may be based on the occupancy data. The security event information 768 may aid the user of the client device 405 in determining the proper arming action 498 to activate for the second security system 424.

In response to displaying the arming action recommendation and/or the security event information 768, the user may select, and the client device 405 may receive, the arming action (which may be the arming action 498 from the arming action recommendation) for the second security system 424 (at block B614). In response to receiving the selection, the client device 405 may transmit (in some embodiments via the backend server 430) the arming action 498 to the second hub device 412 and/or the second A/V recording and communication device 403 for arming the second security system 424 (at block B616).

In the scenario of FIGS. 19-21, the user of the client device 405 may activate the armed stay mode, which may include arming the window sensors and the door sensors of the sensors 418. In addition, the user may activate the second A/V recording and communication device 403 and/or other cameras of the second security system 424 to begin recording. In addition, the user may activate the floodlights, spotlights, and other lights that may be part of the automation devices 420 and/or the second A/V recording and communication device 403 (in embodiments where the second A/V recording and communication devices 403 include a floodlight, a spotlight, etc.). The user may also activate a blinds/shades automation system of the automation devices 420 to close all of the blinds and/or shades that are part of the blinds/shades automation system. In some of the present embodiments, each of the client devices associated with security systems in the network of security systems may receive an arming action recommendation to activate floodlights, spotlights, cameras, etc., such that each of the properties in the neighborhood, street, town, etc. where the network of security systems is located may be illuminated and image data may be recorded. As a result, the burglar 740 may be scared off and/or become more visible to law enforcement, for example. In addition, the burglar 740 may have his or her movements recorded when he or she enters the field of view of any of the cameras, which may aid law enforcement in identifying the burglar 740.

Figure 17:
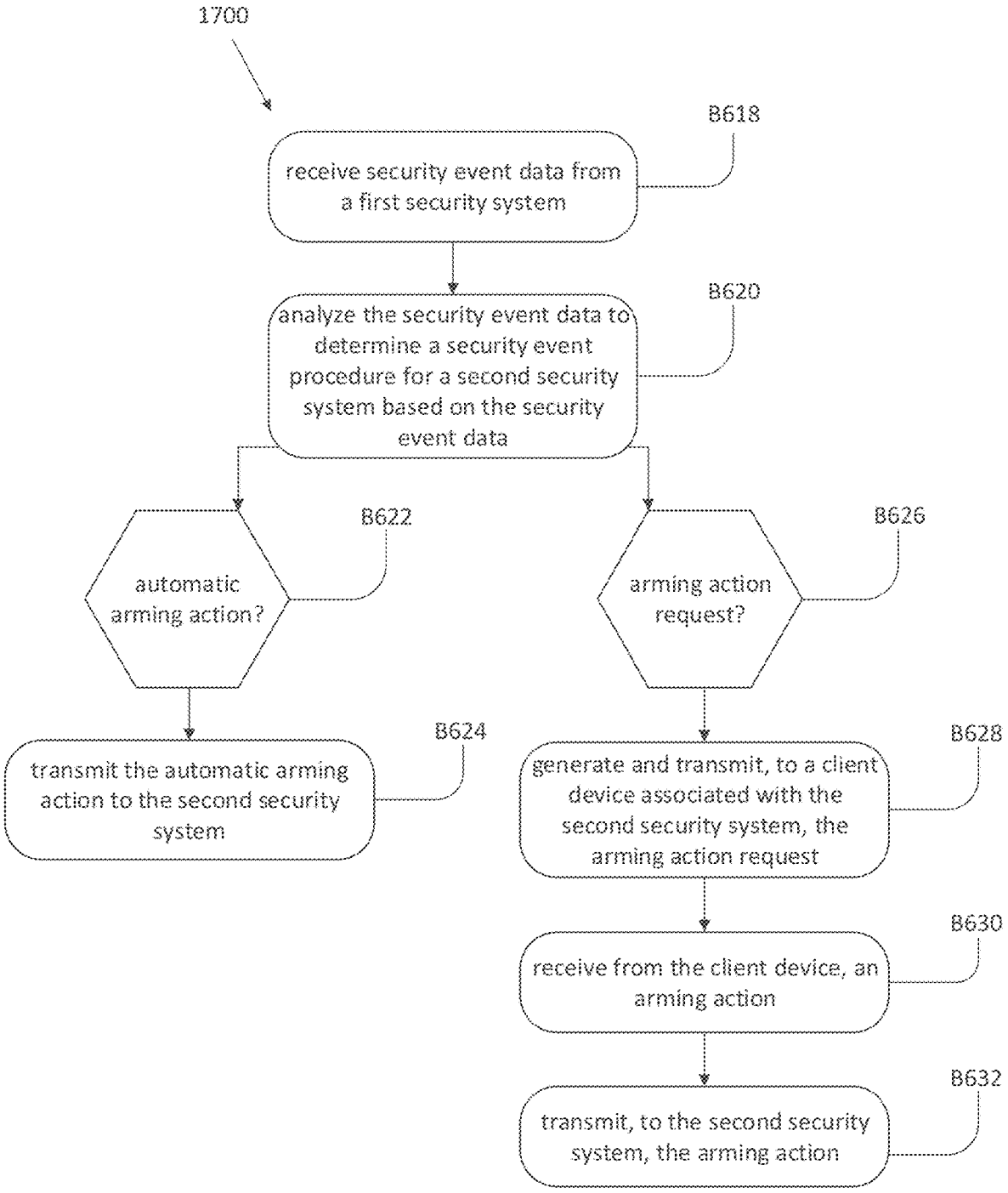

Now referring to FIG. 17, FIG. 17 is a flowchart illustrating a process for arming security systems based on communications among a network of security systems according to various aspects of the present disclosure. The process 1700, at block B618, receives security event data from a first security system. For example, in response to a security event detected by the first security system 422, the processor 502 of the backend server 430 may receive the security event data 473 representative of the security event from the first hub device 411 (and/or the first A/V recording and communication device 402) of the first security system 422.

The process 1700, at block B620, analyzes the security event data to determine a security event procedure for a second security system based on the security event data. For example, the processor 502 of the backend server 430 may analyze the security event data 473 to determine the security event procedure for the second security system 424 based on the security event data 473 (and/or the occupancy data of the property where the second security system 424 is located). For example, as described herein, the backend server 430 may determine the security systems that should be notified in response to security events (e.g., based on proximity, based on inclusion in a network of security systems, etc.) and/or in response to certain types of security events (e.g., based on threat level) detected by the first security system 422. In addition, the backend server 430 may analyze the security event procedures 499 (e.g., the type of notification, the arming action protocol, etc.) for each of the security systems that should be notified, because different security systems may have different security event procedures 499 (e.g., based on the types of sensors, automation devices, and/or A/V recording and communication devices, user preferences, type of security event (e.g., threat level), location of the security event (e.g., proximity), clock data, etc.).

In some of the present embodiments, the security event procedure 499 for some of the security systems may include an automatic arming action. The process 1700, at block B622, determines that the security event procedure is an automatic arming action. When it is determined that the security event procedure 499 is an automatic arming action, the process 1700, at block B624, transmits the automatic arming action to the second security system. For example, the backend server 430 may transmit the arming action 498 to the second security system 424 (e.g., to the second hub device 412 and/or the second A/V recording and communication device 403). In some of the present embodiments, because the arming action 498 may be transmitted automatically, input from the user/owner of the second security system 424 may not be required. However, in some embodiments, in addition to transmitting the arming action 498 to the second security system 424, the backend server 430 may transmit a notification (e.g., the user alert 479, 481) to the client device 405 associated with the second security system 412 with an indication that the arming action 498 was transmitted to the second security system 424 and allow the user to update/change/add to the arming action 498 (e.g., by activating one or more of the automation devices 420 and/or the second A/V recording and communication device 403 that were not included in the arming action 498).

In some of the present embodiments, the security event procedure 499 for some of the security systems may include an arming action request. The process 1700, at block B626, determines that the security event procedure is an arming action request. When it is determined that the security event procedure 499 is an arming action request, the process 1700, at block B628, generates and transmits, to a client device associated with the second security system, the arming action request. For example, the processor 502 of the backend server 430 may generate and transmit, using the network interface 520, the arming action request to the client device 405 associated with the second security system 424.

The process 1700, at block B630, receives from the client device, an arming action. For example, in response to transmitting the arming action request to the client device 405, the processor 502 of the backend server 430, using the network interface 520, may receive the arming action 498 for the second security system 424 from the client device 405.

The process 1700, at block B632, transmits, to the second security system, the arming action. For example, after receiving the arming action 498, the processor 502 of the backend server 430, using the network interface 520, may transmit the arming action 498 to the second hub device 412 and/or the second A/V recording and communication device 403 of the second security system 422.

Figure 18:
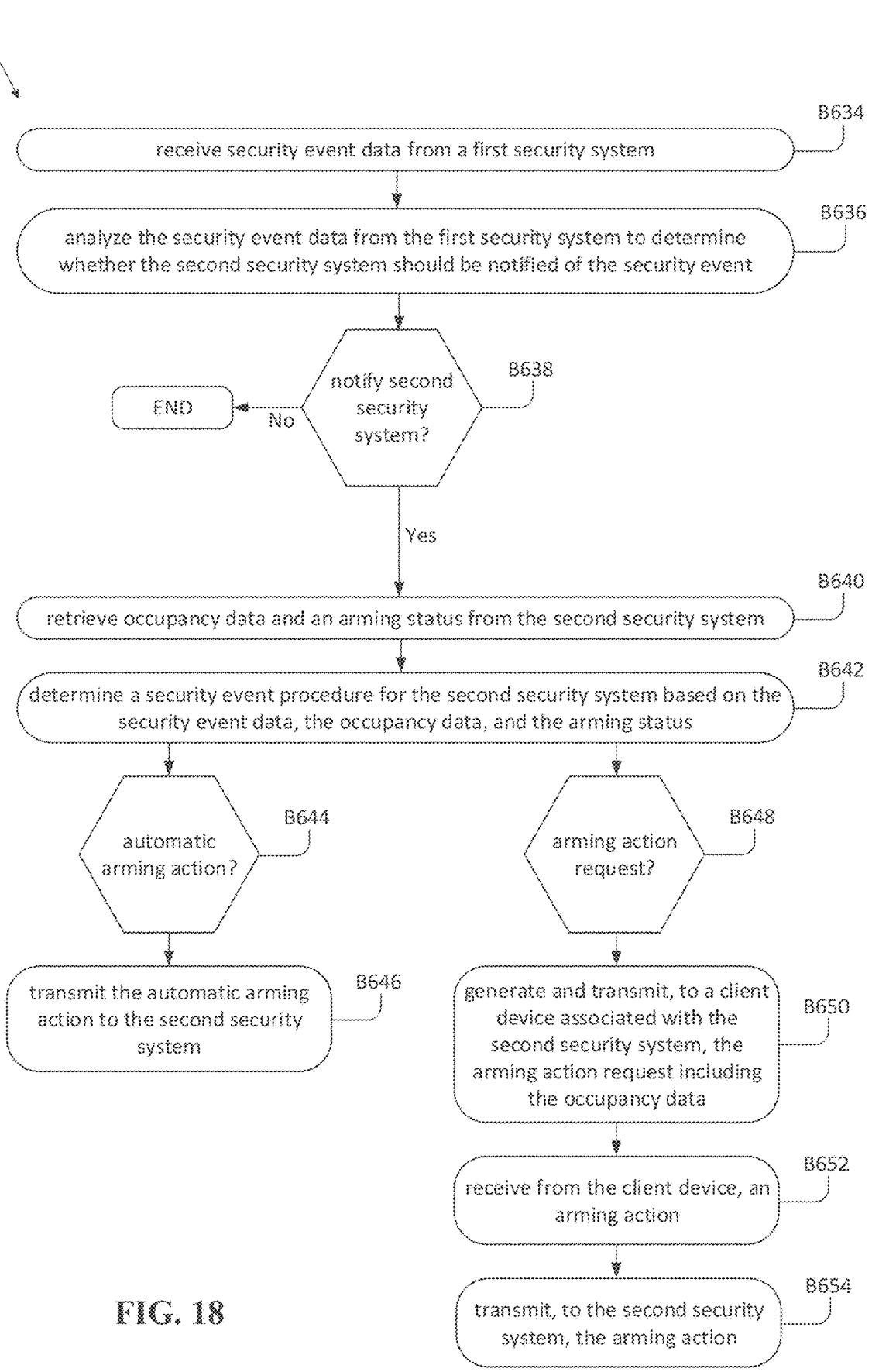

Now referring to FIG. 18, FIG. 18 is a flowchart illustrating a process for arming security systems based on communications among a network of security systems according to various aspects of the present disclosure. The process 1800, at block B634, receives security event data from a first security system. For example, the processor 502 of the backend server 430 may receive the security event data 473 from the first security system 422 (e.g., the first hub device 411 and/or the first A/V recording and communication device 402). This process may be similar to that of block B618 of the process 1700 of FIG. 17, described above.

The process 1800, at block B636, analyzes the security event data from the first security system to determine whether the second security system should be notified of the security event. For example, the processor 502 of the backend server 430 may analyze the security event data 473 generated by the first security system 422 to determine whether the second security system 424 should be notified of the security event. For example, as described herein, the security event data 473 may be analyzed to determine each of the security systems that should be notified of the security event. This determination may be made, as described above, by determining the network(s) of security systems in which the first security system 422 is included (e.g., based on the proximity of other security systems to the first security system, based on "opt-in" information, etc.) and/or by determining the threat level of the security event.

The process 1800, at block B638, determines whether the second security system should be notified. If the answer is no, the process 1800 may end. If the determination is yes, the process 1800 may continue to block B640.

The process 1800, at block B640, retrieves occupancy data and an arming status from the second security system. For example, the processor 502 may retrieve the occupancy data of the second property where the second security system 424 is located and the arming status of the second security system 424 (e.g., based on the most recent arming action 498 implemented by the second security system 424). In some of the present embodiments, the occupancy data and/or the arming status may be retrieved from the memory (e.g., the non-volatile memory 506) of the backend server 430. In such embodiments, the backend server 430 may be configured to determine and/or store the occupancy data and/or the arming status of the second security system 424. The occupancy data and/or the arming status may be determined and/or stored periodically, such as every 5 seconds, every 10 seconds, every 30 seconds, every minute, or at each check-in from the second security system 424 (e.g., each check-in from the second hub device 412). In other embodiments, the backend server 430 may query the second security system 424 for the occupancy data and/or the arming status in response to the security event detected by the first security system 422.

The process 1800, at block B642, determines a security event procedure for the second security system based on the security event data, the occupancy data, and the arming status. For example, the processor 502 of the backend server 430 may determine the security event procedure 499 for the second security system 424 based on the security event data 473, the occupancy data, and/or the arming status. For example, the security event data 473 may be used to determine if the security event is a verifiable security event, such as by analyzing the image data 448, 475 to determine if a suspicious person is present (e.g., using computer vision), by analyzing the sensor data 474 to determine if the perimeter has been breached (e.g., by analyzing the sensor data 474 from the door sensors, the window sensors, and/or the lock sensors), etc. In some of the present embodiments, the security event may be verified based on the actions of the user of the client device 404, 406 associated with the first security system 422 in response to the security event. For example, if the user activated the first A/V recording and communication device 402, activated a lighting automation system, sounded an alarm, alerted law enforcement, etc. in response to the security event (e.g., in response to receiving the user alert 479, 481), the security event may be determined to be verified and the verification may be stored on the backend server 430. In another example, if the security event caused a notification to be sent to a security monitoring service that monitors the first security system 422, the security monitoring service may verify the security event, and the verification may be stored on the backend server 430. In addition, the security event data 473 may be analyzed to determine a threat level, as described above. In some of the present embodiments, the verification of the security event and/or the threat level may be used to determine the security event procedure 499. For example, the security event procedure 499 for the second security system 424 may require notification only when a security event is verified and/or only in response to a threshold threat level, as described above.

In addition, the security event procedure 499 may be determined based on the occupancy data of the property where the second security system 424 is located. For example, the security event procedure 499 may include transmitting an arming action request (at block B648), where the arming action request may include a recommended arming action. As such, the recommended arming action may be based on the occupancy data, as described above.

In some embodiments, the security event procedure 499 may be based on the arming status. For example, if the second security system 424 is already armed (e.g., armed stay, armed away), the security event procedure 499 may not require any additional action or may only require a notification to be sent to the client device 405 associated with the second security system 424. In addition, as described above, the security event procedure 499 may include transmitting an arming action request (at block B648), where the arming action request may include a recommended arming action. As such, the recommended arming action may be based on the arming status. For example, if the system is already armed, such as armed stay, the recommended arming action may only include additional arming actions, such as activating floodlights, closing blinds/shades, and/or recording using the second A/V recording and communication device 403.

In some of the present embodiments, the security event procedure 499 for some of the security systems may include an automatic arming action. The process 1800, at block B644, determines that the security event procedure is an automatic arming action. When it is determined that the security event procedure 499 is an automatic arming action, the process 1800, at block B646, transmits the automatic arming action to the second security system. For example, the backend server 430 may transmit the arming action 498 to the second security system 424 (e.g., to the second hub device 412 and/or the second A/V recording and communication device 403). In some of the present embodiments, because the arming action 498 may be transmitted automatically, input from the user/owner of the second security system 424 may not be required. However, in some embodiments, in addition to transmitting the arming action 498 to the second security system 424, the backend server 430 may transmit a notification (e.g., the user alert 479, 481) to the client device 405 associated with the second security system 412 with an indication that the arming action 498 was transmitted to the second security system 424 and allow the user to update/change/add to the arming action 498 (e.g., by activating one or more of the automation devices 420 and/or the second A/V recording and communication device 403 that were not included in the arming action 498).

In some of the present embodiments, the security event procedure 499 for some of the security systems may include an arming action request. The process 1800, at block B648, determines that the security event procedure is an arming action request. When it is determined that the security event procedure 499 is an arming action request, the process 1800, at block B650, generates and transmits, to a client device associated with the second security system, the arming action request. For example, the processor 502 of the backend server 430 may generate and transmit, using the network interface 520, the arming action request to the client device 405 associated with the second security system 424.

The process 1800, at block B652, receives from the client device, an arming action. For example, in response to transmitting the arming action request to the client device 405, the processor 502 of the backend server 430, using the network interface 520, may receive the arming action 498 for the second security system 424 from the client device 405.

The process 1800, at block B654, transmits, to the second security system, the arming action. For example, after receiving the arming action 498, the processor 502 of the backend server 430, using the network interface 520, may transmit the arming action 498 to the second hub device 412 and/or the second A/V recording and communication device 403.

The process 1800 of FIG. 18 may be implemented in a variety of embodiments, including those discussed below. However, the below-detailed embodiments are not intended to be limiting, and are provided merely as example embodiments of the present disclosure. Other embodiments similar to those outlined herein may also fall within the scope of the present disclosure.

With reference to FIGS. 19-21, in an example scenario, as described above with respect to FIG. 16, a burglar 740 (who may have a weapon 742) triggers a security event at the property where the first security system 422 is located. In such a scenario, the first security system 422 and the second security system 424 may be part of a network of security systems (e.g., each of the security systems installed on the street 762, each of the security systems in a neighborhood, each of the security systems in a predetermined proximity to the security system where the security event is detected (e.g., security systems within the first proximity region 750, the second proximity region 752, etc.), each of the security systems that opted into the network of security systems, etc.).

In response to, and during the presence of the burglar 740 at the first home 728, the first security system 422 may generate the security event data 473. The first security system 422 may transmit the security event data 473 to the backend server 430 and the backend server 430 may receive the security event data 473 (at block B634). In some embodiments, the security event data 473 may also be transmitted by the first hub device 411 to a security monitoring service over the network (Internet/PSTN) 410 (in some embodiments, via the backend server 430).

The backend server 430 may analyze the security event data 473 to determine if the second security system 424 at the second home 720 should be notified (at block B636). For example, the backend server 430 may determine if the first security system 422 and the second security system 424 are included in the same network of security systems 422. As described above, in some of the present embodiments, the network of security systems may be based on location data (e.g., proximity). For example, it may be determined that each of the security systems within the third proximity region 754 should be notified of security events detected by the first security system 422. In some of the present embodiments, the network of security systems may be based on, in addition to or in lieu of the location data, opt-in determinations of security systems (e.g., the users/owners of the security systems opting into the network of security systems). For example, the user/owner of the second security system 424 may be able to opt into the network of security systems that may include all of the security systems in the neighborhood, town, and/or city. In such an example, the second security system 424 may not be configured to receive notifications in response to all security events detected by security systems in the network of security systems, but may include an additional layer of filtering, such as proximity and/or clock data, as described above, threat level, as also described above, verification of the security event, as also described above, and/or property type (e.g., only receive notification in response to security events at homes and not at businesses).

Once a determination is made that the second security system 424 should be notified of the security event, the backend server 430 may retrieve the occupancy data and the arming status of the second security system 424 (at block B640). The backend server 430 may then determine the security event procedure 499 for the second security system 424 based on the security event data 473, the occupancy data, and/or the arming status (at block B642). If it is determined that the security event procedure 499 for the second security system 424 is an automatic arming action, the backend server 430 may determine, based on the security event data, the occupancy data, and/or the arming status, the arming action 498 (e.g., the arming action recommendation) (at block B644). For example, the security event data 473 may indicate that the burglar 740 has broken into the first home 728 and may have a weapon 742. As a result, the arming action 498 may include arming the second security system 424 to an armed stay or armed away mode (e.g., based on the occupancy data), and also may include closing the blinds/shades using a blinds/shades automation system, activating an outdoor lighting automation system, activating the second A/V recording and communication device 403 to record the image data 462, and/or sounding an alarm of the second security system 424 (e.g., using a separate speaker, using the speaker 484 of the second hub device 412, and/or using the speaker 451 of the second A/V recording and communication device 403). In some of the present embodiments, the arming status may be used to determine which of the sensors 418, the automation devices 420, and the second A/V recording and communication devices 403 need to be activated and/or have their status changed based on the arming action 498. For example, if the outdoor lighting automation system is activated already, the arming action 498 may not include any update to the outdoor lighting automation system. If the second security system 424 is in an armed vacation mode, the arming action 498 may update the second security system 424 to be in an armed away mode, which may be more secure than the armed vacation mode.

In some of the present embodiments, as described above, the backend server may also use the clock data to determine the security event procedure 499 for the second security system 424. For example, the security event procedure 499 may be an automatic arming action during a first portion of the day (e.g., 11:00 p.m. to 4:00 a.m.), and/or during a certain day of the week (e.g., Saturdays), while the security event procedure 499 may be an arming action request during other portions of the day (e.g., 9:00 a.m. to 4:00 p.m.), and/or during certain days of week (e.g., Mondays, Tuesdays, and Wednesdays). For example, as described herein, the user of the security system 424 may be able to configure the security event procedures 499. In such examples, the user may set schedules (e.g., hourly schedules, daily schedules, weekly schedules, and so on) as part of the security event procedures 499, such that the backend server 430 may first determine the time and/or day using the clock data, and then use the time and/or day when analyzing the security event procedure 499 to determine the arming action 498 for the second security system 424. As described above, in some of the present embodiments, the clock data may be used along with the proximity information and/or the threat level. For example, the based on the proximity and the time of day, the arming action 498 may include different types of alerts. In such an example, if the security event is detected by a security system within two-hundred-fifty yards of the second security system 424, during daytime hours, the second security system 424 may sound an audible alert and transmit an audible notification to the client device 405. If the security event is detected by a security system within two-hundred-fifty yards of the second security system 424, during evening hours, the second security system 424 may sound a silent alert, automatically arm, and the client device 405 may receive a vibration notification. In another example, if the threat level of the security event is high, and the security event occurs during daytime hours, the second security system 424 may sound an audible alert and transmit an audible notification to the client device 405. If the threat level of the security event is high, and the security event occurs during evening hours, the second security system 424 may sound a silent alert, automatically arm, and the client device 405 may receive a vibration notification.

Once the arming action 498 is determined, the backend server 430 may transmit the arming action 498 to the second security system 424 (at block B646).

If it is determined (at block B648) that the security event procedure 499 is to generate and transmit an arming action request, the backend server 430 may generate and transmit the arming action request to the client device 405 associated with the second security system 424. The arming action request, in some of the present embodiments, may include an arming action recommendation, as described herein. The arming action recommendation may be based on the security event data 473, the occupancy data, and/or the arming status, as described above. In response to transmitting the arming action request, the backend server 430 may receive the arming action 498 from the client device 405 (e.g., after a user of the client device 405 selects the arming action 498) (at block B652). After receiving the arming action 498, the backend server 430 may transmit the arming action 498 to the second security system 424 (e.g., to the second hub device 412 and/or the second A/V recording and communication device 403).

Many of the descriptions above of the embodiments of the present processes (e.g., FIGS. 15-16) refer to the client device 405. It is to be understood, however, that aspects of any method described herein may be performed by any other client device, such as the client devices 404, 406, 407, either alone or in combination with any other of these devices.

In addition, many of the descriptions above of the embodiments of the present processes (e.g., FIGS. 17-18) refer to one of the first hub device 411, the second hub device 412, or the backend server 430. It is to be understood, however, that aspects of any method described herein may be performed by any of these devices, either alone or in combination with any other of these devices.

As a result of the processes described herein, property owners may be made aware of threats to the security of their homes and/or businesses before the threat enters their property. In addition, the property owners may be able to proactively secure their property using their home security systems to prevent the threat from extending onto their property. Ultimately, the safety and security of individual properties, neighborhoods, towns, and cities may be increased thereby contributing to public safety as a whole.

As discussed above, the present disclosure provides numerous examples of methods and systems including A/V recording and communication doorbells, but the present embodiments are equally applicable for A/V recording and communication devices other than doorbells. For example, the present embodiments may include one or more A/V recording and communication security cameras instead of, or in addition to, one or more A/V recording and communication doorbells. An example A/V recording and communication security camera may include substantially all of the structure and functionality of the doorbell 130 (FIG. 3-4), but without the front button 148, the button actuator, and/or the light pipe 232.

Figure 22:
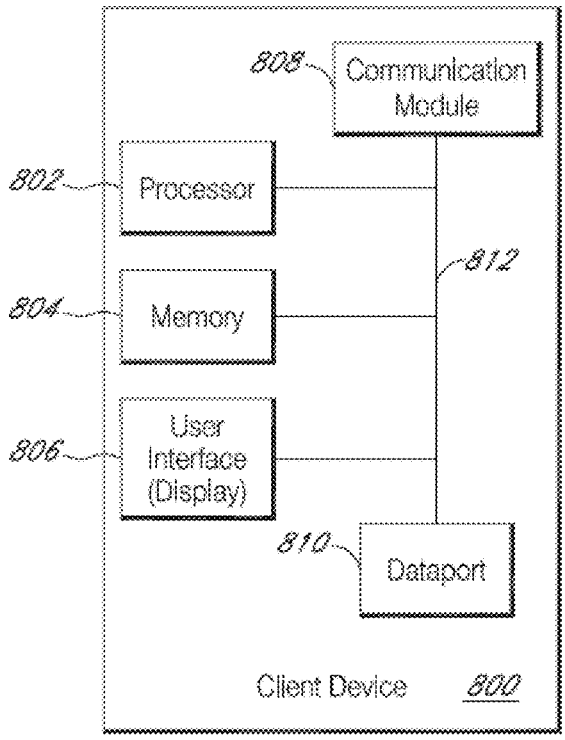
FIG. 22 is a functional block diagram of a client device on which the present embodiments may be implemented according to various aspects of the present disclosure.

FIG. 22 is a functional block diagram of a client device 800 on which the present embodiments may be implemented according to various aspects of the present disclosure. The user's client device 114 described with reference to FIG. 1 may include some or all of the components and/or functionality of the client device 800. The client device 800 may comprise, for example, a smartphone.

With reference to FIG. 22, the client device 800 includes a processor 802, a memory 804, a user interface 806, a communication module 808, and a dataport 810. These components are communicatively coupled together by an interconnect bus 812. The processor 802 may include any processor used in smartphones and/or portable computing devices, such as an ARM processor (a processor based on the RISC (reduced instruction set computer) architecture developed by Advanced RISC Machines (ARM).). In some embodiments, the processor 802 may include one or more other processors, such as one or more conventional microprocessors, and/or one or more supplementary co-processors, such as math co-processors.

The memory 804 may include both operating memory, such as random-access memory (RAM), as well as data storage, such as read-only memory (ROM), hard drives, flash memory, or any other suitable memory/storage element. The memory 804 may include removable memory elements, such as a CompactFlash card, a MultiMediaCard (MMC), and/or a Secure Digital (SD) card. In some embodiments, the memory 804 may comprise a combination of magnetic, optical, and/or semiconductor memory, and may include, for example, RAM, ROM, flash drive, and/or a hard disk or drive. The processor 802 and the memory 804 each may be, for example, located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 802 may be connected to the memory 804 via the dataport 810.

The user interface 806 may include any user interface or presentation elements suitable for a smartphone and/or a portable computing device, such as a keypad, a display screen, a touchscreen, a microphone, and a speaker. The communication module 808 is configured to handle communication links between the client device 800 and other, external devices or receivers, and to route incoming/outgoing data appropriately. For example, inbound data from the dataport 810 may be routed through the communication module 808 before being directed to the processor 802, and outbound data from the processor 802 may be routed through the communication module 808 before being directed to the dataport 810. The communication module 808 may include one or more transceiver modules capable of transmitting and receiving data, and using, for example, one or more protocols and/or technologies, such as GSM, UMTS (3GSM), IS-95 (CDMA one), IS-2000 (CDMA 2000), LTE, FDMA, TDMA, W-CDMA, CDMA, OFDMA, Wi-Fi, WiMAX, or any other protocol and/or technology.

The dataport 810 may be any type of connector used for physically interfacing with a smartphone and/or a portable computing device, such as a mini-USB port or an IPHONE®/IPOD® 30-pin connector or LIGHTNING® connector. In other embodiments, the dataport 810 may include multiple communication channels for simultaneous communication with, for example, other processors, servers, and/or client terminals.

The memory 804 may store instructions for communicating with other systems, such as a computer. The memory 804 may store, for example, a program (e.g., computer program code) adapted to direct the processor 802 in accordance with the present embodiments. The instructions also may include program elements, such as an operating system. While execution of sequences of instructions in the program causes the processor 802 to perform the process steps described herein, hard-wired circuitry may be used in place of, or in combination with, software/firmware instructions for implementation of the processes of the present embodiments. Thus, the present embodiments are not limited to any specific combination of hardware and software.

Figure 23:
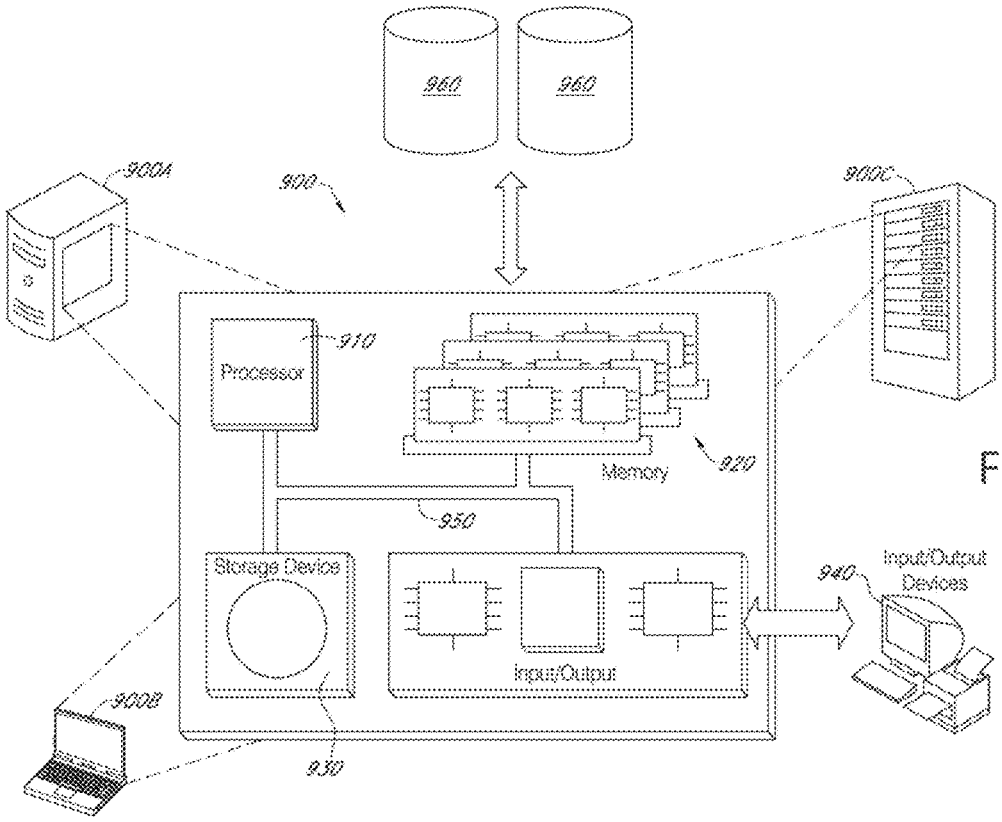
FIG. 23 is a functional block diagram of a general-purpose computing system on which the present embodiments may be implemented according to various aspects of present disclosure.

FIG. 23 is a functional block diagram of a general-purpose computing system on which the present embodiments may be implemented according to various aspects of present disclosure. The computer system 900 may execute at least some of the operations described above. The computer system 900 may be embodied in at least one of a personal computer (also referred to as a desktop computer) 900A, a portable computer (also referred to as a laptop or notebook computer) 900B, and/or a server 900C. A server is a computer program and/or a machine that waits for requests from other machines or software (clients) and responds to them. A server typically processes data. The purpose of a server is to share data and/or hardware and/or software resources among clients. This architecture is called the client-server model. The clients may run on the same computer or may connect to the server over a network. Examples of computing servers include database servers, file servers, mail servers, print servers, web servers, game servers, and application servers. The term server may be construed broadly to include any computerized process that shares a resource to one or more client processes.

The computer system 900 may include at least one processor 910, memory 920, at least one storage device 930, and input/output (I/O) devices 940. Some or all of the components 910, 920, 930, 940 may be interconnected via a system bus 950. The processor 910 may be single- or multi-threaded and may have one or more cores. The processor 910 may execute instructions, such as those stored in the memory 920 and/or in the storage device 930. Information may be received and output using one or more I/O devices 940.

The memory 920 may store information, and may be a computer-readable medium, such as volatile or non-volatile memory. The storage device(s) 930 may provide storage for the system 900, and may be a computer-readable medium. In various aspects, the storage device(s) 930 may be a flash memory device, a hard disk device, an optical disk device, a tape device, or any other type of storage device.

The I/O devices 940 may provide input/output operations for the system 900. The I/O devices 940 may include a keyboard, a pointing device, and/or a microphone. The I/O devices 940 may further include a display unit for displaying graphical user interfaces, a speaker, and/or a printer. External data may be stored in one or more accessible external databases 960.

The features of the present embodiments described herein may be implemented in digital electronic circuitry, and/or in computer hardware, firmware, software, and/or in combinations thereof. Features of the present embodiments may be implemented in a computer program product tangibly embodied in an information carrier, such as a machine-readable storage device, and/or in a propagated signal, for execution by a programmable processor. Embodiments of the present method steps may be performed by a programmable processor executing a program of instructions to perform functions of the described implementations by operating on input data and generating output.

The features of the present embodiments described herein may be implemented in one or more computer programs that are executable on a programmable system including at least one programmable processor coupled to receive data and/or instructions from, and to transmit data and/or instructions to, a data storage system, at least one input device, and at least one output device. A computer program may include a set of instructions that may be used, directly or indirectly, in a computer to perform a certain activity or bring about a certain result. A computer program may be written in any form of programming language, including compiled or interpreted languages, and it may be deployed in any form, including as a stand-alone program or as a module, component, subroutine, or other unit suitable for use in a computing environment.

Suitable processors for the execution of a program of instructions may include, for example, both general and special purpose processors, and/or the sole processor or one of multiple processors of any kind of computer. Generally, a processor may receive instructions and/or data from a read only memory (ROM), or a random-access memory (RAM), or both. Such a computer may include a processor for executing instructions and one or more memories for storing instructions and/or data.

Generally, a computer may also include, or be operatively coupled to communicate with, one or more mass storage devices for storing data files. Such devices include magnetic disks, such as internal hard disks and/or removable disks, magneto-optical disks, and/or optical disks. Storage devices suitable for tangibly embodying computer program instructions and/or data may include all forms of non-volatile memory, including for example semiconductor memory devices, such as EPROM, EEPROM, and flash memory devices, magnetic disks such as internal hard disks and removable disks, magneto-optical disks, and CD-ROM and DVD-ROM disks. The processor and the memory may be supplemented by, or incorporated in, one or more ASICs (application-specific integrated circuits).

To provide for interaction with a user, the features of the present embodiments may be implemented on a computer having a display device, such as an LCD (liquid crystal display) monitor, for displaying information to the user. The computer may further include a keyboard, a pointing device, such as a mouse or a trackball, and/or a touchscreen by which the user may provide input to the computer.

The features of the present embodiments may be implemented in a computer system that includes a back-end component, such as a data server, and/or that includes a middleware component, such as an application server or an Internet server, and/or that includes a front-end component, such as a client computer having a graphical user interface (GUI) and/or an Internet browser, or any combination of these. The components of the system may be connected by any form or medium of digital data communication, such as a communication network. Examples of communication networks may include, for example, a LAN (local area network), a WAN (wide area network), and/or the computers and networks forming the Internet.

The computer system may include clients and servers. A client and server may be remote from each other and interact through a network, such as those described herein. The relationship of client and server may arise by virtue of computer programs running on the respective computers and having a client-server relationship to each other.

The above description presents the best mode contemplated for carrying out the present embodiments, and of the manner and process of practicing them, in such full, clear, concise, and exact terms as to enable any person skilled in the art to which they pertain to practice these embodiments. The present embodiments are, however, susceptible to modifications and alternate constructions from those discussed above that are fully equivalent. Consequently, the present invention is not limited to the particular embodiments disclosed. On the contrary, the present invention covers all modifications and alternate constructions coming within the spirit and scope of the present disclosure. For example, the steps in the processes described herein need not be performed in the same order as they have been presented, and may be performed in any order(s). Further, steps that have been presented as being performed separately may in alternative embodiments be performed concurrently. Likewise, steps that have been presented as being performed concurrently may in alternative embodiments be performed separately.

What is claimed is:

1. A method for a client device associated with a first security system of a security network, the security network including the first security system installed at a first address and associated to a first user, and a second security system installed at a second address and associated to a second user, the client device including a processor, a communication module, and a display, the method comprising:

in response to a security event detected by the second security system at the second address, receiving, by the processor using the communication module, a user alert including a description of the security event at the second address when the second address is within a first proximity region with respect to the first address, and notification of an automatic arming action of the first security system when the second address is within a second proximity region with respect at the first address, the second proximity region being closer to the first address than the first proximity region;

in response to receiving the user alert, displaying, by the processor on the display, the user alert with the description of the security event;

receiving, by the processor based on the user alert, an input including an arming action for the first security system; and in response to receiving the input, transmitting, by the processor using the communication module, the arming action to the first security system.

2. The method of claim 1, wherein the user alert is received by a backend device.

3. The method of claim 2, wherein the backend device is a server.

4. The method of claim 1, wherein the user alert includes security event data representative of the security event.

5. The method of claim 4, wherein the security event data includes at least one of motion data generated by a motion sensor of the second security system, image data generated by a camera of the second security system, and sensor data generated by a sensor of the second security system.

6. The method of claim 5, wherein the sensor includes at least one of a door sensor, a window sensor, a flood sensor, a glass break sensor, a contact sensor, a temperature sensor, a smoke detector, a carbon monoxide detector, and a lock/unlock sensor.

7. The method of claim 1, further comprising:

receiving, by the processor using the communication module, an arming action recommendation; and displaying, by the processor on the display, the arming action recommendation.

8. The method of claim 7, wherein the arming action recommendation includes one of an armed stay mode and an armed away mode based on occupancy data of the first address.

9. The method of claim 1, further comprising:

receiving, by the processor using the communication module, an arming status of the first security system; and displaying, by the processor on the display, the arming status.

10. The method of claim 1, further comprising:

receiving, by the processor using the communication module, occupancy data of the first address; and displaying, by the processor on the display, the occupancy data.

11. The method of claim 1, wherein the arming action includes one of activating an armed stay mode, activating an armed away mode, and activating a custom arming mode of the first security system.

12. The method of claim 11, wherein the arming action further includes activating at least one A/V recording and communication device located at the first address to record image data.

13. The method of claim 12, wherein the at least one A/V recording and communication device includes at least one of a video doorbell, an outdoor security camera, an indoor security camera, a floodlight security camera, and a spotlight security camera.

14. The method of claim 11, wherein the arming action further includes activating at least one automation device located at the first address.

15. The method of claim 14, wherein the at least one automation device includes one of an indoor lighting system, an outdoor lighting system, a temperature control system, a shade/blinds control system, and an entertainment system.

16. A client device associated with a first security system of a security network, the security network including the first security system installed at a first address and associated with a first user, and a second security system installed at a second address and associated with a second user, the client device comprising:

at least one processor;

a communication module;

a display; and a non-transitory machine-readable memory storing a program, the program executable by at least one of the processors, the program comprising sets of instructions for:

in response to a security event detected by the second security system at the second address, receiving, by the processor using the communication module, a user alert including a description of the security event at the second address when the second address is within a first proximity region with respect to the first address, and notification of an automatic arming action of the first security system when the second address is within a second proximity region with respect at the first address, the second proximity region being closer to the first address than the first proximity region;

in response to receiving the user alert, displaying, by the processor on the display, the user alert with the description of the security event;

receiving, based on the user alert, an input including an arming action for the first security system; and in response to receiving the input, transmitting, using the communication module, the arming action to the first security system.

17. The client device of claim 16, wherein the user alert is received by a backend device.

18. The client device of claim 17, wherein the backend device is a server.

19. The client device of claim 16, wherein the user alert includes security event data representative of the security event.

20. The client device of claim 19, wherein the security event data includes at least one of motion data generated by a motion sensor of the second security system, image data generated by a camera of the second security system, and sensor data generated by a sensor of the second security system.

21. The client device of claim 20, wherein the sensor includes at least one of a door sensor, a window sensor, a flood sensor, a glass break sensor, a contact sensor, a temperature sensor, a smoke detector, a carbon monoxide detector, and a lock/unlock sensor.

22. The client device of claim 16, wherein the program further comprises sets of instructions for:

receiving, using the communication module, an arming action recommendation; and displaying, on the display, the arming action recommendation.

23. The client device of claim 22, wherein the arming action recommendation includes one of an armed stay mode and an armed away mode based on occupancy data of the first address.

24. The client device of claim 16, wherein the program further comprises sets of instructions for:

receiving, using the communication module, an arming status of the first security system; and displaying, on the display, the arming status.

25. The client device of claim 16, wherein the program further comprises sets of instructions for:

receiving, using the communication module, occupancy data of the first address; and displaying, on the display, the occupancy data.

26. The client device of claim 16, wherein the arming action includes one of activating an armed stay mode, activating an armed away mode, and activating a custom arming mode of the first security system.

27. The client device of claim 26, wherein the arming action further includes activating at least one A/V recording and communication device located at the first address to record image data.

28. The client device of claim 27, wherein the at least one A/V recording and communication device includes at least one of a video doorbell, an outdoor security camera, an indoor security camera, a floodlight security camera, and a spotlight security camera.

29. The client device of claim 26, wherein the arming action further includes activating at least one automation device located at the first address.

30. The client device of claim 29, wherein the at least one automation device includes one of an indoor lighting system, an outdoor lighting system, a temperature control system, a shade/blinds control system, and an entertainment system.

* * * * *